US010752008B2

(12) United States Patent
Shimizu et al.

(10) Patent No.: US 10,752,008 B2
(45) Date of Patent: Aug. 25, 2020

(54) LIQUID SUPPLY UNIT

(71) Applicant: Seiko Epson Corporation, Tokyo (JP)

(72) Inventors: Yoshiaki Shimizu, Matsumoto (JP); Satoshi Shinada, Shiojiri (JP); Taku Ishizawa, Matsumoto (JP); Noriyuki Fukasawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 37 days.

(21) Appl. No.: 16/065,963

(22) PCT Filed: Nov. 18, 2016

(86) PCT No.: PCT/JP2016/084230
§ 371 (c)(1),
(2) Date: Jun. 25, 2018

(87) PCT Pub. No.: WO2017/115584
PCT Pub. Date: Jul. 6, 2017

(65) Prior Publication Data

US 2019/0009555 A1 Jan. 10, 2019

(30) Foreign Application Priority Data

Dec. 28, 2015 (JP) ..... 2015-256021

(51) Int. Cl.
*B41J 2/175* (2006.01)

(52) U.S. Cl.
CPC ..... *B41J 2/1753* (2013.01); *B41J 2/175* (2013.01); *B41J 2/1752* (2013.01);
(Continued)

(58) Field of Classification Search
None
See application file for complete search history.

(56) References Cited

U.S. PATENT DOCUMENTS 6,554,412 B1 4/2003 Seino et al.
8,297,738 B1 * 10/2012 Kodama ..... B41J 2/1752 347/49

(Continued)

FOREIGN PATENT DOCUMENTS

JP 2001-199082 A 7/2001
JP 2006-043922 A 2/2006

(Continued)

OTHER PUBLICATIONS

Yasuma, Hiromasa, Ink Tank, Ink Tank Holder, Method for Attaching Ink Tank, and Recording Head Cartridge, Feb. 16, 2006, Japan (Year: 2006).*

(Continued)

*Primary Examiner* — Matthew Luu
*Assistant Examiner* — Tracey M McMillion
(74) *Attorney, Agent, or Firm* — Oliff PLC

(57) ABSTRACT

An object is to identify an abnormal mounted state of a liquid supply unit to a liquid ejection apparatus. There is provided a liquid supply unit configured to supply a liquid to a liquid ejection apparatus that comprises a first electrode assembly including a first electrode and a second electrode; an engagement structure; and a mounting structure which the liquid supply unit is mounted to. The liquid supply unit comprises a liquid supply portion; an engaged structure configured to be engaged with the engagement structure in a mounted state and thereby restrict a motion of the liquid supply unit in a first direction that is a direction of dismounting the liquid supply unit; and an electrically conductive portion provided in the engaged structure. The electrically conductive portion is configured to come into contact with the first electrode and the second electrode in an engaged state that the engaged structure is engaged with the engagement structure, so as to provide electrical continuity (Continued)

between the first electrode and the second electrode and cause the liquid ejection apparatus to detect mounting of the liquid supply unit to the liquid ejection apparatus.

9 Claims, 40 Drawing Sheets

(52) U.S. Cl.
CPC ..... *B41J 2/17513* (2013.01); *B41J 2/17523* (2013.01); *B41J 2/17546* (2013.01); *B41J 2/17553* (2013.01); *B41J 2002/17516* (2013.01)

(56) References Cited

U.S. PATENT DOCUMENTS

| | | | | |
|---|---|---|---|---|
| 8,752,944 | B2 | 6/2014 | Nozawa et al. | |
| 9,205,661 | B2 | 12/2015 | Kawate | |
| 2004/0165043 | A1* | 8/2004 | Sakai | B41J 2/17513 347/86 |

FOREIGN PATENT DOCUMENTS

| | | | |
|---|---|---|---|
| JP | 2013-141804 | A | 7/2013 |
| JP | 2013-163371 | A | 8/2013 |
| JP | 2013-163378 | A | 8/2013 |
| JP | 2013-248779 | A | 12/2013 |
| JP | 3190482 | U | 4/2014 |

OTHER PUBLICATIONS

International Search Report dated Feb. 14, 2017 in PCT/JP2016/084230 with English-language translation (4 pgs.).

* cited by examiner

ABNORMAL MOUNTED STATE

LIQUID SUPPLY UNIT

CROSS-REFERENCE TO RELATED APPLICATIONS

This application is a National Phase Entry of PCT/JP2016/084230, filed Nov. 18, 2016; which claims priority to Japanese Appl. No. 2015-2015-256021, filed Dec. 28, 2015; the disclosures of both of which are incorporated by reference herein in their entirety.

FIELD

The present disclosure relates to a liquid supply unit configured to supply a liquid to a liquid ejection apparatus.

BACKGROUND

An ink cartridge (hereinafter may be simply referred to as "cartridge") provided with an IC chip may be used as a cartridge to supply ink to an inject printer (hereinafter may be simply referred to as "printer") (as described in Patent Literature 1). This IC chip is generally configured by a substrate provided with a memory chip and is used to store information regarding ink, for example, information regarding the color of ink contained in the cartridge and to notify the printer of such information. The IC chip is also used to cause a printer main body to detect mounting of the cartridge to a cartridge holder (hereinafter may be simply referred to as "holder") provided in the printer. For such applications, a plurality of electrodes corresponding to the types of applications are provided in the IC chip. When the cartridge is mounted to the holder, the respective electrodes of the IC chip come into contact with corresponding electrodes provided on the holder to provide electrical continuity between the electrodes. For example, when a plurality of predetermined electrodes of the IC chip are connected in advance in the IC chip, mounting of the cartridge to the holder causes a plurality of electrodes provided on the holder to come into contact with the plurality of electrodes of the IC chip and make a short circuit between the plurality of electrodes of the holder. This enables the printer to detect mounting of the cartridge to the holder.

CITATION LIST

Patent Literature

PTL 1: JP 2013-141804A

SUMMARY

Technical Problem

In the configuration that detects mounting of the cartridge by the contact of the electrodes of the IC chip with the electrodes of the holder, even in the case of insufficient mounting of the cartridge to the holder, the printer detects mounting of the cartridge by the contact of the electrodes of the IC chip with the electrodes of the holder. For example, even when a supply port provided to supply ink from the cartridge to the printer is not fully connected with a portion of the holder configured to receive the ink, the printer is likely to detect mounting of the cartridge by the contact of the electrodes of the IC chip with the electrodes of the holder. Using the printer to eject ink in this state, there may be a problem that ink is not supplied from the cartridge to the printer. Additionally, the air is likely to enter from a gap between the portion of the holder configured to receive the ink and the supply port of the cartridge into a flow path of ink that is formed from the portion of receiving the ink to a print head. The air taken into the flow path of the printer may be removed to some extent by a cleaning operation that sucks inside of the flow path from an injection surface side of the head. This cleaning operation is generally provided to forcibly discharge a small amount of the air, which is mixed with ink inside of the cartridge and which is taken along with ink into the flow path, outside of the head. When the printer is used in the state that the supply port is not fully connected, however, a larger amount of the air that is not removable by the general cleaning operation is likely to enter the flow path. When the printer is left for a long time period in the state that the unremovable amount of the air is accumulated in the flow path, this may cause a problem that the ink remaining in the flow path is evaporated and a problem that the remaining ink is dried to be sticky and makes it difficult to eject ink.

Such problems may also arise in an off-carriage type printer in which a holder is placed in a printer main body and does not reciprocate with a carriage. Such problems are not limited to the printer but may also arise in any liquid ejection apparatus configured to eject a liquid. Such problems are also not limited to the cartridge but may arise in any liquid container unit that is mountable to the liquid ejection apparatus. Such problems may further arise in a cartridge that is provided with a terminal portion on the surface of a case of the cartridge, in place of the IC chip. There is accordingly a demand for a technique that causes the liquid ejection apparatus to identify an abnormal mounted state of the liquid supply unit, for example, insufficient mounting of the liquid supply unit to the liquid ejection apparatus.

Solution to Problem

The present disclosure may be implemented by aspects described below, in order to solve at least part of the above problems.

(1) According to one aspect of the present disclosure, there is provided a liquid supply unit configured to supply a liquid to a liquid ejection apparatus. The liquid ejection apparatus includes a first electrode assembly containing a first electrode and a second electrode; an engagement structure; and a mounting structure which the liquid supply unit is mounted to. The liquid supply unit comprises a liquid supply portion configured to supply the liquid to the liquid ejection apparatus; an engaged structure configured to be engaged with the engagement structure and thereby restrict a motion of the liquid supply unit in a first direction that is a direction of dismounting the liquid supply unit from the liquid ejection apparatus, in a mounted state that the liquid supply unit is mounted to the liquid ejection apparatus; and an electrically conductive portion provided in the engaged structure. The electrically conductive portion is configured to come into contact with the first electrode and the second electrode in an engaged state that the engaged structure is engaged with the engagement structure, so as to provide electrical continuity between the first electrode and the second electrode and cause the liquid ejection apparatus to detect mounting of the liquid supply unit to the liquid ejection apparatus.

In the liquid supply unit of this aspect, the engaged structure is provided with the electrically conductive portion that comes into contact with the first electrode and the second electrode in the engaged state that the engaged structure and the engagement structure are engaged with each other. This configuration suppresses the electrical continuity between the first electrode and the second electrode from being provided in the state that the engaged structure is not engaged with the engagement structure and identifies such a state or more specifically an abnormal mounted state of the liquid supply unit to the liquid ejection apparatus.

(2) In the liquid supply unit of the above aspect, the engaged structure may include an engagement projection inserted into a through hole that is provided as the engagement structure in a wall portion of the mounting structure, in the mounted state. The liquid supply unit of this aspect provides electrical continuity between the first electrode and the second electrode only when the engaged structure is inserted into the through hole to be engaged with the engagement structure. This configuration thus more reliably identifies the abnormal mounted state of the liquid supply unit to the liquid ejection apparatus.

(3) In the liquid supply unit of the above aspect, the electrically conductive portion may be provided on the engagement projection and be arranged at a position to come into contact with the first electrode and the second electrode that is placed in the through hole, in the engaged state. In the liquid supply unit of this aspect, the first electrode assembly is formed as part of the engagement structure. This configuration achieves downsizing and cost reduction of the liquid ejection apparatus, compared with a configuration that the first electrode assembly and the engagement structure are formed from separate members. Additionally, this configuration simultaneously achieves the engagement of the engaged structure with the engagement structure and the contact of the electrically conductive portion with the first electrode and the second electrode. This configuration provides electrical continuity between the first electrode and the second electrode only in the case where the engaged structure is engaged with the engagement structure. This configuration thus more reliably identifies the abnormal mounted state of the liquid supply unit to the liquid ejection apparatus.

(4) In the liquid supply unit of the above aspect, the liquid supply portion may have a wall that is provided to be protruded from a face of the liquid supply unit in an opposite direction to the first direction, and in the mounted state, a leading end of the wall may come into contact with an elastic member that is provided in the liquid ejection apparatus, to be biased in the first direction by the elastic member. In the liquid supply unit of this aspect, in the state that the liquid supply unit is mounted to the liquid ejection apparatus, the first face is biased in the first direction by the elastic member. The liquid supply unit is accordingly biased in the first direction. This configuration enhances the effect of restriction a motion of the liquid supply unit in the first direction using the engaged structure.

(5) The liquid supply unit of the above aspect may further comprise a terminal portion. In the mounted state, the terminal portion may come into contact with a second electrode assembly that is provided in the liquid ejection apparatus, to be biased in the first direction by the second electrode assembly. In the liquid supply unit of this aspect, in the state that the liquid supply unit is mounted to the liquid ejection apparatus, the terminal portion is biased in the first direction by the second electrode assembly. The liquid supply unit is accordingly biased in the first direction. This configuration enhances the effect of restriction a motion of the liquid supply unit in the first direction using the engaged structure.

(6) The liquid supply unit of the above aspect may further comprise a first face provided with the liquid supply portion; a second face opposed to the first face in the first direction; a third face arranged to intersect with the first face and the second face; a fourth face arranged to intersect with the first face and the second face and opposed to the third face; a fifth face arranged to intersect with the first face, the second face, the third face and the fourth face; and a sixth face provided with the engaged structure, arranged to intersect with the first face, the second face, the third face and the fourth face, and opposed to the fifth face. When the liquid supply unit is viewed from the first face side in the first direction, the liquid supply portion may be placed at a position on the first face that is nearer to the sixth face than the fifth face, and the terminal portion may be placed at a position on the first face that is nearer to the fifth face than the sixth face. The liquid supply unit of this aspect is biased from the first face side in the first direction by the elastic member and the second electrode assembly provided in the liquid ejection apparatus. In this state, a region of the first face of the liquid container unit near to the sixth face is biased by the elastic member, while a region of the first face near to the fifth face is biased by the second electrode assembly. This configuration accordingly enables the liquid container unit to be biased in the first direction in a balanced manner.

(7) The liquid supply unit of the above aspect may further comprise a first face provided with the liquid supply portion; a second face opposed to the first face in the first direction; a third face arranged to intersect with the first face and the second face; a fourth face arranged to intersect with the first face and the second face and opposed to the third face; a fifth face arranged to intersect with the first face, the second face, the third face and the fourth face; a sixth face arranged to intersect with the first face, the second face, the third face and the fourth face and opposed to the fifth face; and a lever provided on the fifth face and operated to mount the liquid supply unit to the liquid ejection apparatus and to dismount the liquid supply unit from the liquid ejection apparatus. The engaged structure may be provided on the lever. In the liquid supply unit of this aspect, the engaged structure is provided on the lever that is operated to mount the liquid supply unit to the liquid ejection apparatus and to dismount the liquid supply unit from the liquid ejection apparatus. This configuration causes the liquid ejection apparatus to detect mounting of the liquid supply unit to the liquid ejection apparatus when the lever is normally operated to engage the engaged structure with the engagement structure. This configuration thus more reliably suppresses mounting of the liquid supply unit from being detected in the state that the liquid container unit is not sufficient (not firmly) mounted to the liquid ejection apparatus by an inappropriate operation. The first electrode assembly is formed as part of the lever. This configuration achieves downsizing and cost reduction of the liquid ejection apparatus, compared with a configuration that the first electrode assembly and the lever are formed from separate members. Additionally, an operation of the lever simultaneously achieves the engagement of the engaged structure with the engagement structure and the contact of the electrically conductive portion with the first electrode and the second electrode. This configuration provides electrical continuity between the first electrode and the second electrode only when the engaged structure is engaged with the engagement structure. This configuration thus more reliably identifies the abnormal mounted state of the liquid supply unit to the liquid ejection apparatus.

(8) In the liquid supply unit of the above aspect, The liquid supply portion may include a valve configured to open a liquid flow path formed in the liquid supply portion when a liquid intake needle provided in the liquid ejection apparatus is inserted in the liquid supply portion and to close the liquid flow path when the liquid intake needle is not inserted in the liquid supply portion. The valve may include a spring seat that is pressed in the first direction by the liquid intake needle in the mounted state, and a spring that biases the spring seat in a second direction opposite to the first direction. The liquid supply unit of this aspect is biased in the first direction by the repulsion force of the spring n the state that the liquid supply unit is mounted to the liquid ejection apparatus. Accordingly, this configuration enhances the effect of restricting the motion of the liquid supply unit in the first direction using the engaged structure.

(9) The liquid supply unit of the above aspect may further comprise a first face; a second face opposed to the first face; a third face arranged to intersect with the first face and the second face; a fourth face arranged to intersect with the first face and the second face and opposed to the third face; a fifth face provided with the liquid supply portion and arranged to intersect with the first face, the second face, the third face and the fourth face; a sixth face arranged to intersect with the first face, the second face, the third face and the fourth face and opposed to the fifth face in the first direction; and a guide groove provided on the first face to guide the engagement structure of the liquid ejection apparatus in a process of mounting the liquid supply unit to the liquid ejection apparatus and in a process of dismounting the liquid supply unit from the liquid ejection apparatus. The guide groove may comprise: an inlet guide path configured to guide the engagement structure in the process of mounting the liquid supply unit to the liquid ejection apparatus; and an outlet guide path configured to guide the engagement structure in the process of dismounting the liquid supply unit from the liquid ejection apparatus. The engaged structure may be provided at a position between the inlet guide path and the outlet guide path in the guide groove. The liquid supply unit of this aspect provides electrical continuity between the first electrode and the second electrode only when the engagement structure is locked by the engaged structure in the guide groove, i.e., in the engaged state. Accordingly, this configuration more reliably identifies the abnormal mounted state of the liquid supply unit to the liquid ejection apparatus.

(10) According to another aspect of the present disclosure, there is provided a liquid supply unit configured to supply a liquid to a liquid ejection apparatus. The liquid supply unit comprises: at least six faces; a liquid supply portion provided on a first face among the six faces to supply the liquid to the liquid ejection apparatus; a first detector configured to cause the liquid ejection apparatus to detect mounting of the liquid supply unit to the liquid ejection apparatus in a mounted state that the liquid supply unit is mounted to the liquid ejection apparatus; and a second detector configured to cause the liquid ejection apparatus to detect mounting of the liquid supply unit to the liquid ejection apparatus in the mounted state. In planar view of the liquid supply unit from the first face side in a first direction that is a direction of dismounting the liquid supply unit from the liquid ejection apparatus, the first detector is provided on one side relative to the liquid supply portion, and the second detector is provided on an opposite side to the first detector relative to the liquid supply portion. The liquid supply unit of this aspect includes the first detector and the second detector that are provided across the liquid supply portion. This configuration identifies the abnormal mounted state of the liquid supply unit to the liquid ejection apparatus.

All the plurality of components included in each of the aspects of the disclosure described above are not essential, but some components among the plurality of components may be appropriately changed, omitted or replaced with other additional components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the disclosure described above may be combined with part or all of the technical features included in another aspect of the disclosure described above to provide one independent aspect of the disclosure.

The present disclosure may be implemented by various aspects. For example, the present disclosure may be implemented by aspects of a manufacturing method of the liquid supply unit, a manufacturing method of a liquid ejection apparatus, an ink cartridge, and a printer equipped with an ink cartridge mounted thereon.

DESCRIPTION OF EMBODIMENT

A. First Embodiment

A1. Configuration of Printer

Figure 1:
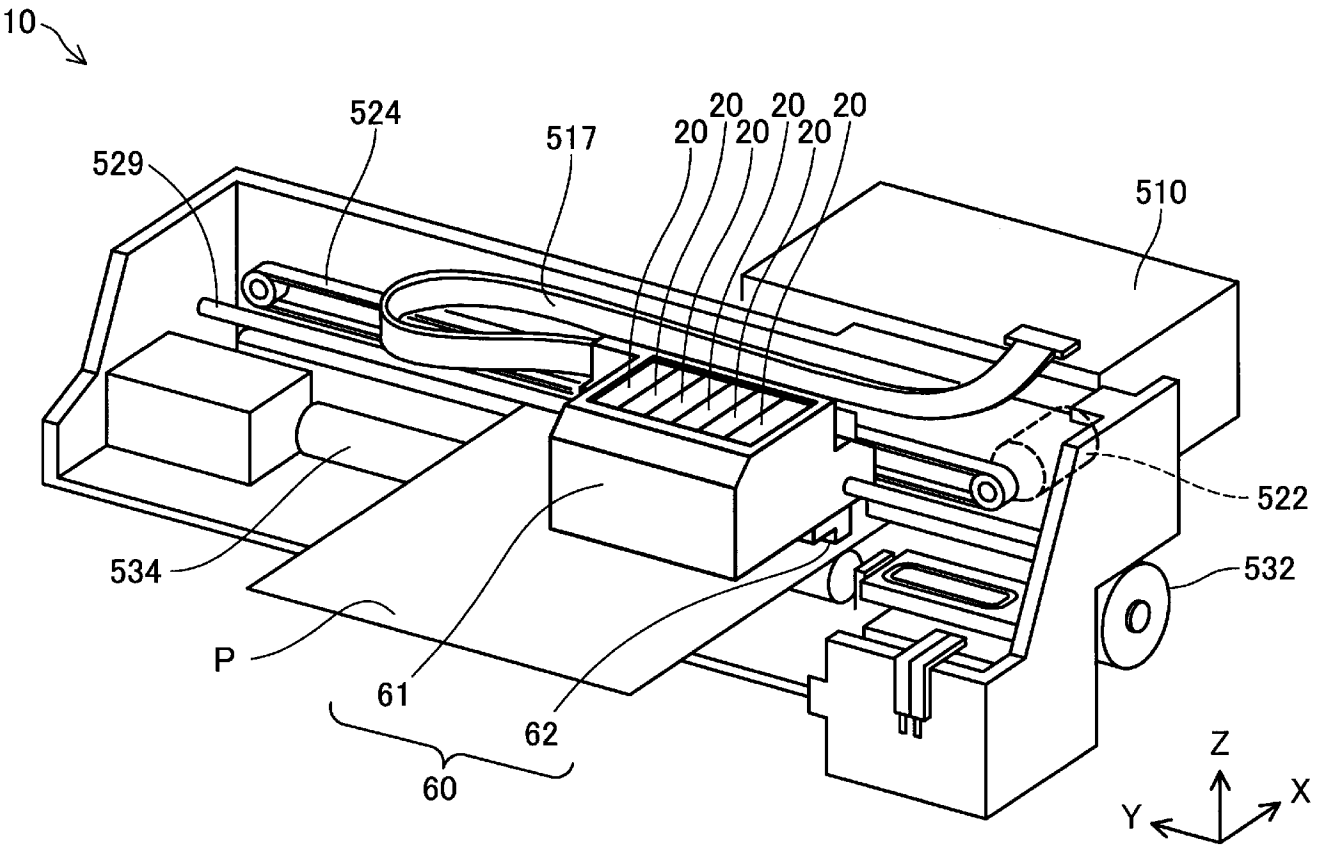
FIG. 1 is a perspective view illustrating the schematic configuration of a printer equipped with ink cartridges as an application of the liquid supply unit according to an embodiment of the present disclosure.

FIG. 1 is a perspective view illustrating the schematic configuration of a printer equipped with ink cartridges as an application of the liquid supply unit according to an embodiment of the present disclosure. FIG. 1 is a partly breakaway view to explicitly illustrate the internal configuration of a printer 10. In FIG. 1, a Z axis is set parallel to a vertical direction. An X axis and a Y axis are set, such that an X-Y plane is parallel to a horizontal plane. A +Z direction indicates a vertically upward direction, and a −Z direction indicates a vertically downward direction. An X axis, a Y axis and a Z axis in subsequent drawings are set along the same directions as those of the X axis, the Y axis and the Z axis in FIG. 1. An X axis, a Y axis and a Z axis in the drawings of the cartridge are based on the state that the cartridge is mounted to the printer.

According to the embodiment, the printer 10 is a small-size inkjet printer for personal use and is configured to perform printing by ejecting multiple different colors of inks. More specifically, the printer 10 is capable of ejecting a total of six different colors (six different types) of inks, black, yellow, magenta, light magenta, cyan and light cyan. The printer 10 may be configured to eject any number of different types of inks, instead of the six different types of inks. Ink is supplied to the printer 10 in the state that the user detachably mounts each ink cartridge 20 (hereinafter also called "cartridge 20") configured to contain each color of ink as described later to the printer 10. The printer 10 is placed on a plane parallel to the horizontal plane, for example, a top face of a desk.

The printer 10 includes a carriage 60, a feed rod 529, a controller 510, a flexible cable 517, a drive belt 524, a carriage motor 522, a feed motor 532, a platen 534, and six cartridges 20.

The carriage 60 includes a holder 61 and a print head 62. According to the embodiment, the printer 10 is an on-carriage-type printer or more specifically has the cartridges 20 that are mounted on the carriage 60 reciprocating in a scanning direction. According to the embodiment, the scanning direction is a direction parallel to the Y axis. The holder 61 allows up to six cartridges 20 to be mounted thereto. Six cartridges 20 are mounted in FIG. 1. The holder 61 is configured to introduce ink from the cartridge 20 mounted thereto to the print head 62. The print head 62 has a large number of non-illustrated nozzles that are opened vertically downward and causes ink droplets to be ejected from these nozzles toward a printing medium P. According to the embodiment, the printing medium P is a sheet of printing paper. The printing medium P is, however, not limited to the printing paper but may be any medium, such as a label or cloth. The feed rod 529 has a long rod-like appearance shape and is placed parallel to the scanning direction. The feed rod 529 supports the carriage 60 to be movable along the scanning direction.

The controller 510 controls the respective parts of the printer 10. The controller 510 and the carriage 60 are electrically connected with each other by the flexible cable 517. The print head 62 ejects ink droplets in response to a control signal output from the controller 510, so as to create characters and images on the printing medium P. The controller 510 determines mounting or non-mounting of the cartridge 20 to the holder 61 and identifies the type of ink contained in the cartridge 20 mounted to the holder 61, based on signals received from the carriage 60 via the flexible cable 517. The detailed configuration of the controller 510 will be described later.

The drive belt 524 is an endless belt and is arranged parallel to the scanning direction and parallel to the feed rod 529. The carriage 60 is mounted to the drive belt 524. The carriage motor 522 drives the drive belt 524. The carriage 60 reciprocates along the scanning direction by driving the drive belt 524.

The feed motor 532 rotates and drives the platen 534. The platen 534 has a columnar appearance shape and has its longitudinal direction (axial direction) that is arranged parallel to the scanning direction. The platen 534 is located vertically below the printing medium P to be in contact with the printing medium P. Rotating and driving the platen 534 feeds the printing medium P in a sub-scanning direction. The sub-scanning direction is a direction perpendicular to the main scanning direction and is a direction parallel to the X axis according to this embodiment. The carriage motor 522 described above and the feed motor 532 are controlled by the controller 510.

A2. Detailed Configuration of Cartridge

Figure 2:
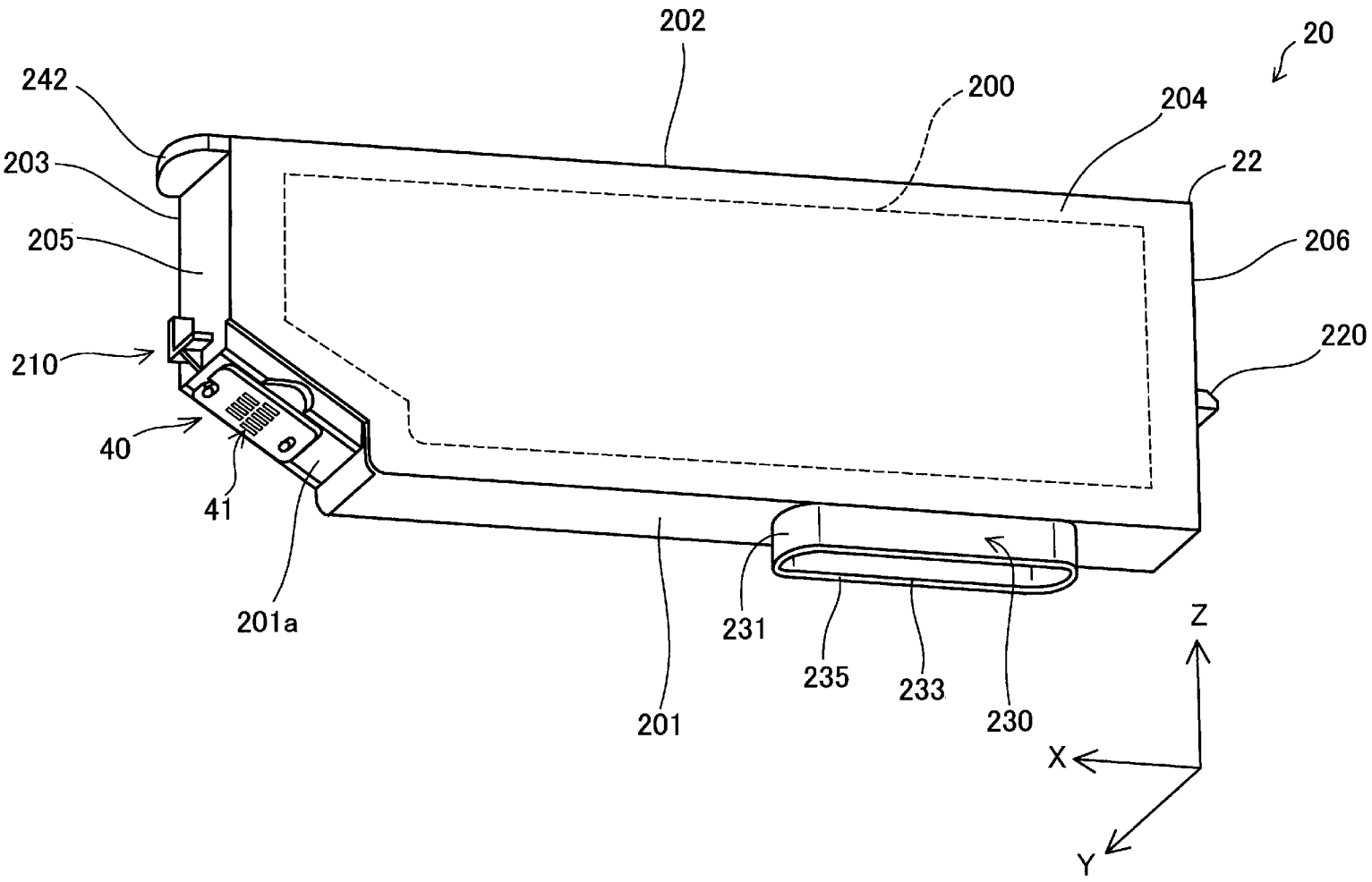
FIG. 2 is an appearance perspective view illustrating a cartridge.
Figure 3:
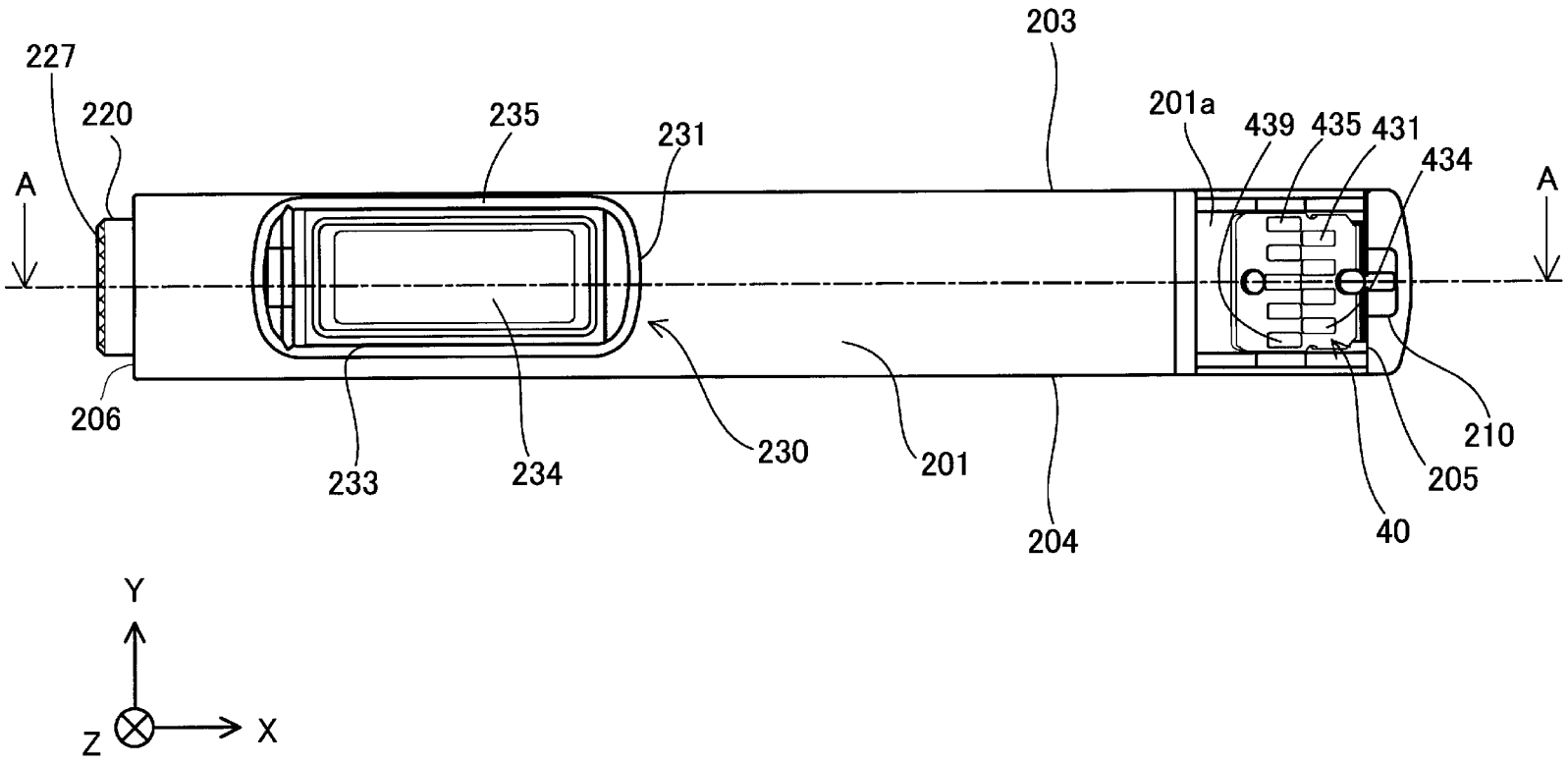
FIG. 3 is a bottom view illustrating the cartridge.
Figure 4:
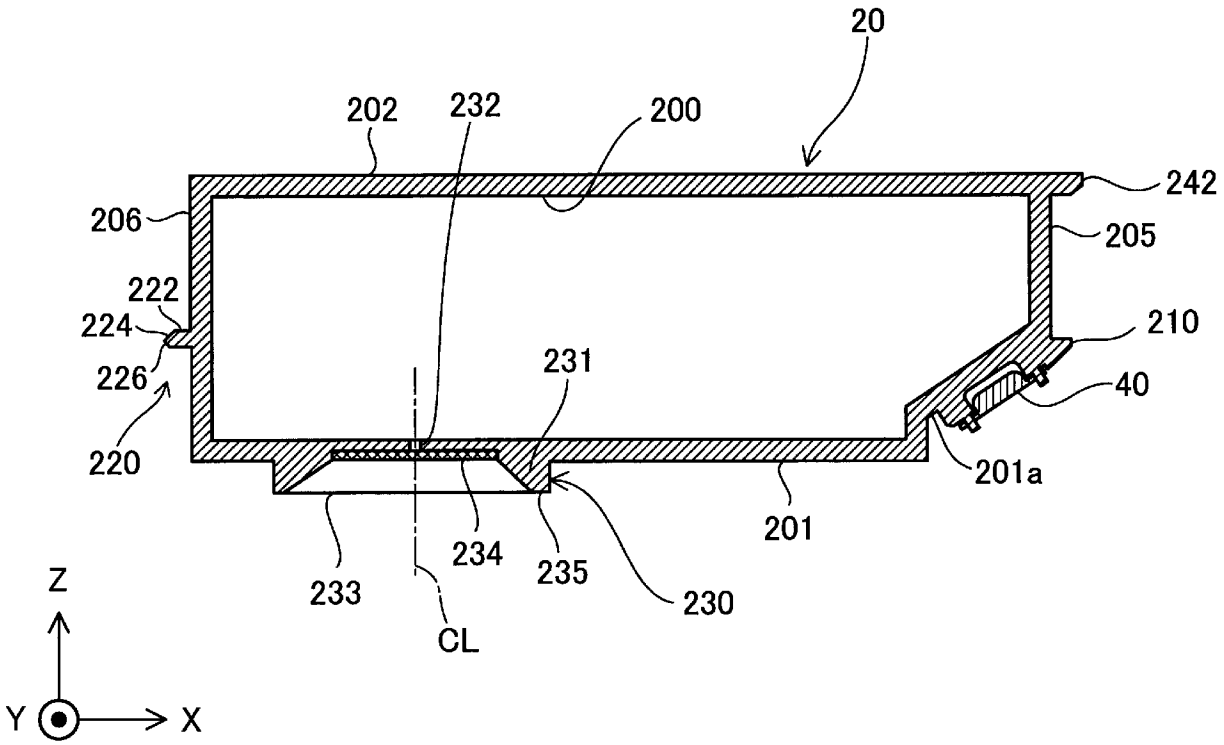
FIG. 4 is a sectional view illustrating the cartridge.
Figure 5:
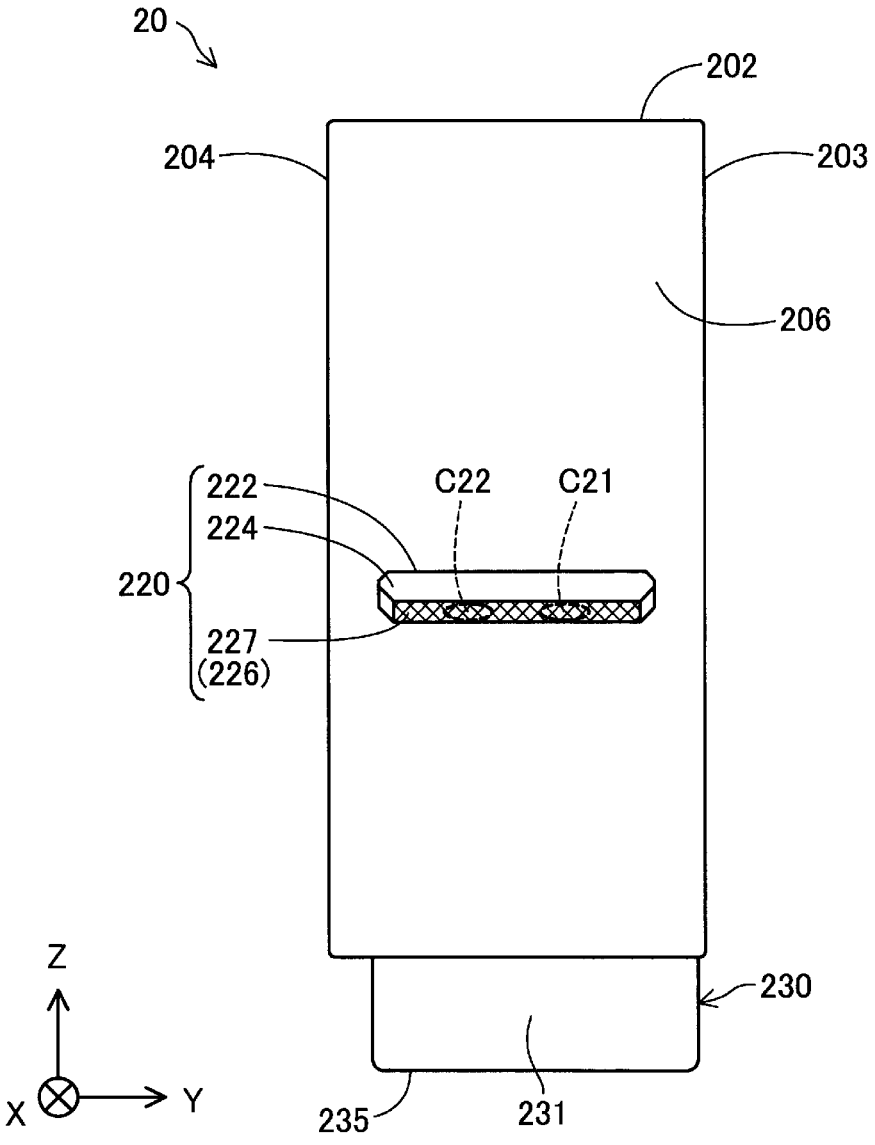
FIG. 5 is a side view illustrating the cartridge.

FIG. 2 is an appearance perspective view illustrating the cartridge 20. FIG. 3 is a bottom view illustrating the cartridge 20. FIG. 4 is a sectional view illustrating the cartridge 20. FIG. 5 is a side view illustrating the cartridge 20. FIG. 4 illustrates an A-A section shown in FIG. 3. The cartridge 20 is a semi-sealed type ink cartridge configured to intermittently introduce the outside air into a liquid container portion 200 with consumption of ink.

The cartridge 20 has an approximately rectangular parallelepiped appearance shape. The cartridge 20 includes an outer shell 22, a liquid container portion 200, a liquid supply portion 230, a first engaged structure 210, a second engaged structure 220, an operation projection 242 and a circuit board 40.

The outer shell 22 has six faces exposed outside or more specifically has a first face 201, a second face 202, a third face 203, a fourth face 204, a fifth face 205 and a sixth face 206. The first face 201 corresponds to a bottom face. The second face 202 corresponds to a top face and is opposed to the first face 201. The third face 203 to the sixth face 206 correspond to side faces. The third face 203 is arranged to intersect with the first face 201 and the second face 202. The term "intersect" is used in a broad sense including the arrangement that partial outer circumferences of respective faces are in contact with each other and the arrangement that virtual faces obtained by extending (stretching) respective faces to be parallel to the respective faces cross each other. The fourth face 204 is arranged to intersect with the first face 201 and the second face 202 and is opposed to the third face 203. The fifth face 205 is arranged to intersect with the first face 201, the second face 202, the third face 203 and the fourth face 204. The sixth face 206 is arranged to intersect with the first face 201, the second face 202, the third face 203 and the fourth face 204 and is opposed to the fifth face 205. The first face 201 described above includes a slope face portion 201*a* on its +X-direction end to form a region including an intersecting part with the fifth face 205. The slope face portion 201*a* and a remaining region of the first face 201 other than the slope face portion 201*a* are respectively formed to be approximately planar. The other five faces 202 to 206 are also respectively formed to be approximately planar. The term "approximately planar" is used in a broad sense including the state that the entire face is perfectly flat and the state that the face partly has some concavity and convexity. Accordingly, even a face partly having some concavity and convexity is expressed as an approximately planar face as long as the face is recognizable as a face or a wall forming the outer shell 22 of the cartridge 20. All the first face 201 to the sixth face 206 have rectangular outer shapes in planar view. The outer shell 22 is made of a synthetic resin such as polypropylene (PP). Part of the outer shell 22 (for example, the fourth face 204) may be made of a resin film.

The liquid container portion 200 is formed inside of the outer shell 22 as a chamber to contain ink therein. The liquid container portion 200 supplies ink to the liquid supply portion 230 via an ink supply path 232 shown in FIG. 4. The liquid container portion 200 is arranged to communicate with a non-illustrated air communication hole provided in the outer shell 22, such that the ambient air is introduced into the liquid container portion 200 with consumption of ink. According to the embodiment, the ink supply path 232 has an approximately cylindrical shape and is arranged to have a center axis CL that is parallel to the Z axis.

The liquid supply portion 230 is provided on the first face 201. The liquid supply portion 230 includes a tubular wall 231 that is protruded from the first face 201 in the −Z direction. An ink intake portion 640 of the holder 61 described later is inserted into the liquid supply portion 230. The liquid supply portion 230 supplies the ink that is supplied from the liquid container portion 200, via the holder 61 to the print head 62. The liquid supply portion 230 is placed on the first face 201 at a position nearer to the fifth face 205 than the sixth face 206. As shown in FIG. 3 and FIG. 4, the liquid supply portion 230 includes a thin plate member 234 provided on a +Z direction end. The thin plate member 234 is made of a resin foam. The thin plate member 234 is arranged to abut on a −Z direction end of the ink supply path 232 and keep the ink supplied from the liquid container portion 200.

The first engaged structure 210 is a projection provided on the fifth face 205. When the cartridge 20 is mounted to the holder 61 described later, the first engaged structure 210 abuts on a lever 80 to restrict the motion of the cartridge 20 in the Z-axis direction. The first engaged structure 210 is placed on a lower side of the fifth face 205 or more specifically in a location near to the intersecting part of the fifth face 205 with the slope face portion 201*a* and is protruded in the +X direction.

The second engaged structure 220 is configured by a projection having a long section in the Y-axis direction. The second engaged structure 220 is provided at the approximate center of the sixth face 206 and is protruded from the sixth face 206 in the −X direction. When the cartridge 20 is mounted to the holder 61 described later, the second engaged structure 220 is inserted into a through hole 620 that is provided in a wall of the holder 61 to engage with the through hole 620 and restrict the motion of the cartridge 20 in the Z-axis direction. This term "engage" is used in a broad sense including the connected state that part of the second engaged structure 220 abuts on an inner wall of the through hole 620 to restrict the motion of the second engaged structure 220, for example, the locking state. The second engaged structure 220 comes into contact with a first electrode assembly 90 of the holder 61 described later in the state that the second engaged structure 220 is engaged with the through hole 620 described later (hereinafter called the "engaged state").

As shown in FIG. 5, the second engaged structure 220 includes a first restriction locking face 222. The first restriction locking face 222 is arranged parallel to the horizontal plane in the engaged state. In the state that the cartridge 20 is mounted to the holder 61 described later (hereinafter called "mounted state"), the first restriction locking face 222 abuts on the through hole 620 of the holder 61 described later to restrict the motion of the cartridge 20 in the +Z direction.

The second engaged structure 220 also includes a first slope face 224 on its leading end. The first slope face 224 intersects with the first restriction locking face 222 and is inclined in a direction including a +Z direction component and a −X direction component. This configuration enables the first restriction locking face 222 to be smoothly introduced into the through hole 620 of the holder 61 described alter in the process of mounting the cartridge 20 to the holder 61.

The second engaged structure 220 further includes an electrically conductive portion 227 on its leading end. According to the embodiment, the electrically conductive portion 227 is a metal layer that is provided at the leading end of the second engaged structure 220 to be arranged on a second slope face 226 that is provided adjacent to the first slope face 224. The second slope face 226 is inclined in a direction including a −Z direction component and a −X direction component. The electrically conductive portion 227 may be formed by, for example, a method of metal plating on the second slope face 226. The electrically conductive portion 227 may be made of an electrically conductive material such as copper, gold or silver.

The electrically conductive portion 227 comes into contact with the first electrode assembly 90 of the holder 61 described later in the engaged state. A contact region C21 that comes into contact with a first electrode 90*a* of the first electrode assembly 90 described later (shown in FIG. 15 and FIG. 16) and a contact region C22 that comes into contact with a second electrode 90*b* of the first electrode assembly 90 are shown by broken lines in FIG. 5. As under stood from the positions of the two broken lines, the contact region C21 and the contact region C22 are provided at positions some distance away from each other in the Y-axis direction. The electrically conductive portion 227 is used by the printer 10 to detect mounting of the cartridge 20 to the holder 61 of the printer 10 (cartridge mounting). When the cartridge 20 is mounted to the holder 61 of the printer 10, the electrically conductive portion 227 provides electrical continuity between the first electrode 90*a* and the second electrode 90*b*. The printer 10 detects that the cartridge 20 is mounted to the holder 61 of the printer 10 by the electrical continuity between the first electrode 90*a* and the second electrode 90*b*. The printer 10-side configuration and detection of the cartridge mounting will be described later more in detail.

According to the embodiment, the second engaged structure 220 is configured by a projection having a long section in the Y-axis direction and includes the electrically conductive portion 227 that is formed on the second slope face 226 at the leading end thereof to be elongated in the Y-axis direction. The shape and the location of the electrically conductive portion 227 are, however, not limited to the configuration of the embodiment. The electrically conductive portion 227 may be formed in any shape and may be provided at any location as long as the electrically conductive portion 227 serve to provide electrical continuity between the contact region C21 and the contact region C22.

Figure 6A:
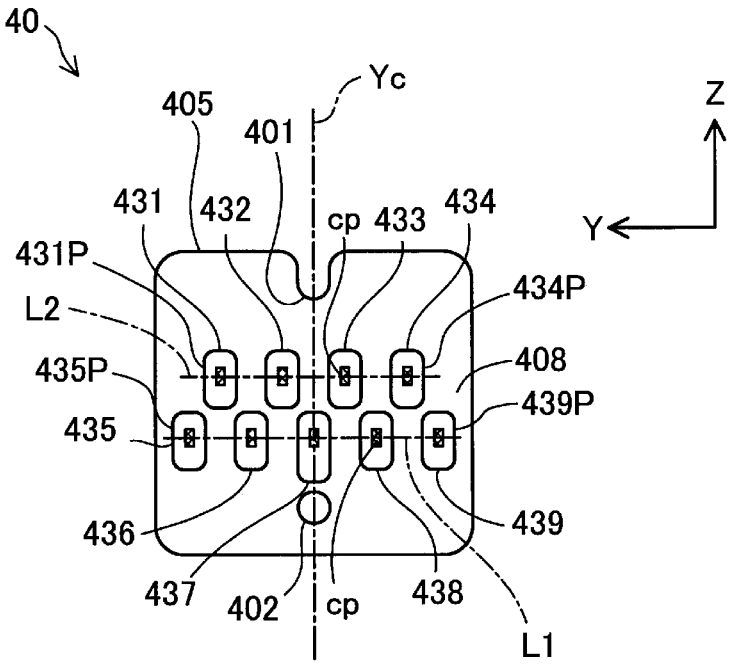
FIG. 6A is diagrams illustrating the configuration of a circuit board.

According to the embodiment, the circuit board 40 is provided with mounting detection elements 435 and 439 (shown in FIG. 6(A)) as described above. These elements are also used to detect the cartridge mounting. With regard to the X-axis direction, the distance between the electrically conductive portion 227 and the liquid supply portion 230 is shorter than the distance between the mounting detection elements 435 and 439 on the circuit board 40 and the liquid supply portion 230. Accordingly, using the electrically conductive portion 227 more accurately detects whether the liquid supply portion 230 is firmly connected with the ink intake portion 640 of the printer 10 (shown in FIG. 15), compared with using the mounting detection elements 435 and 439 on the circuit board 40.

The operation projection 242 shown in FIG. 2 and FIG. 4 is operated by the user in the course of mounting and dismounting of the cartridge 20. The operation projection 242 is placed on a +Z direction end of the fifth face 205 (more specifically, in an intersecting part of the fifth face 205 with the second face 202) and is protruded in the +X direction.

Figure 6B:
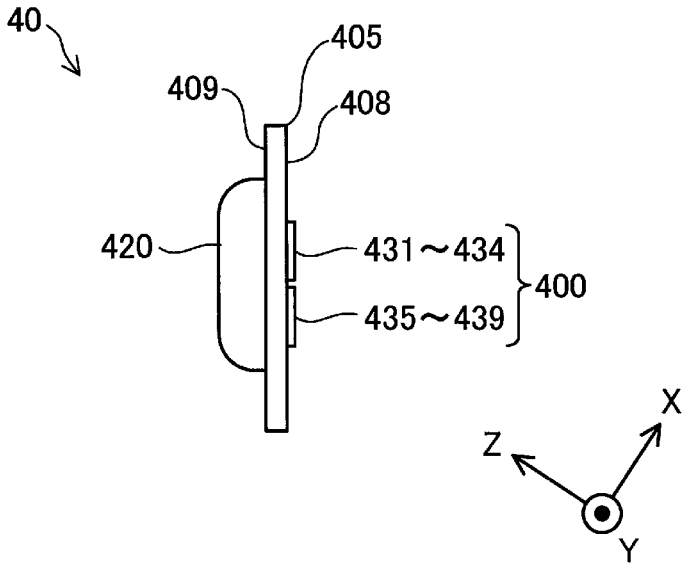
FIG. 6B is diagrams illustrating the configuration of a circuit board.

FIG. 6 is diagrams illustrating the configuration of the circuit board 40. FIG. 6(A) is a plan view illustrating the configuration of the circuit board 40 on its surface side. FIG. 6(B) is a side view illustrating the configuration of the circuit board 40. As shown in FIG. 6, the circuit board 40 is a thin plate-like member including nine terminals 431 to 439 placed on a surface 408 and a storage unit 420 placed on a rear face 409. As shown in FIG. 6(A), a boss groove 401 is formed at a +Z direction end of the circuit board 40, and a boss hole 402 is formed at a −Z direction end of the circuit board 40. The circuit board 40 is fixed to the slope face portion 201*a* of the cartridge 20 by using the boss groove 401 and the boss hole 402. According to the embodiment, the boss groove 401 and the boss hole 402 are provided at positions that cross a plane Yc passing through the center of the width (length in the Y-axis direction) of the cartridge 20. According to another embodiment, at least one of the boss groove 401 and the boss hole 402 may be omitted from the circuit board 40, and the circuit board 40 may be fixed to the slope face portion 201*a* by an adhesive or by using a non-illustrated engagement claw provided on the slope face portion 201*a*.

As shown in FIG. 6(B), the circuit board 40 includes a cartridge-side terminal group 400 provided on the surface 408 and the storage unit 420 provided on the rear face 409. The surface 408 and the rear face 409 are respectively planes. A portion (a side) located on a most +Z direction side of the planar surface 408 in the state attached to the cartridge 20 is called a board end portion 405.

The cartridge-side terminal group 400 is comprised of the nine terminals 431 to 439. The storage unit 420 stores information regarding ink contained in the cartridge 20 (for example, the remaining amount of ink and the color of ink).

As shown in FIG. 6(A), the nine cartridge-side terminals 431 to 439 are formed in approximately rectangular shapes and are arranged to form two terminal arrays (first terminal array L1 and second terminal array L2) that are parallel to each other. These two terminal arrays L1 and L2 are both extended in the width direction (Y-axis direction) of the cartridge 20. Out of the two arrays, the array located on the lower side (in other words, the array nearer to the first face 201 of the cartridge 20) is the first terminal array L1, and the array located on the upper side (in other words, the array nearer to the second face 202 of the cartridge 20) is the second terminal array L2. Accordingly, the first terminal array L1 and the second terminal array L2 have different positions in the Z-axis direction. More specifically, the first terminal array L1 is located on the −Z direction side of the second terminal array L2. Contacts cp are provided on the centers of the respective terminals 431 to 439 to come into contact with corresponding apparatus-side terminals 71 of a second electrode assembly 70 (shown in FIG. 17 and FIG. 18). The first and the second terminal arrays L1 and L2 may be regarded as arrays formed by the plurality of contacts cp.

The respective terminals 431 to 439 may be called as given below from the viewpoints of their functions (applications). In order to clearly distinguish from the terminals on the printer 10-side described later, a prefix "cartridge-side" may be added before the respective names. For example, the "ground terminal 437" may be called "cartridge-side ground terminal 437".

<first terminal array L1>

(1) mounting detection terminal (first terminal) 435

(2) power supply terminal 436

(3) ground terminal 437

(4) data terminal 438

(5) mounting detection terminal (second terminal) 439

<second terminal array L2>

(6) mounting detection terminal (third terminal) 431
(7) reset terminal 432
(8) clock terminal 433
(9) mounting detection terminal (fourth terminal) 434

The respective contacts cp of the terminals 435 to 439 forming the first terminal array L1 and the respective contacts cp of the terminals 431 to 434 forming the second terminal array L2 are arranged alternately. More specifically, the respective contacts cp are arranged in zigzag.

The four mounting detection terminals 431, 434, 435 and 439 are used by the printer 10 to check the quality of electrical contact with corresponding apparatus-side terminals 71 provided on the second electrode assembly 70 of the holder 61 described later and thereby detect whether the cartridge 20 is accurately mounted at a designed mounting position of the holder 61. The four mounting detection terminals 431, 434, 435 and 439 are accordingly also called "mounting detection terminal group". According to the embodiment, the four cartridge-side terminals 431, 434, 435 and 439 are electrically connected with one another inside of the circuit board 40 and are electrically connected with a non-illustrated ground line on the printer 10-side through the ground terminal 437 when the cartridge 20 is mounted to the holder 61. A detection method using the four mounting detection terminals 431, 434, 435 and 439 will be described later.

The other five cartridge-side terminals 432, 433, 436, 437 and 438 are terminals for the storage unit 420. These five terminals 432, 433, 436, 437 and 438 are accordingly also called "memory terminal group".

The reset terminal 432 receives supply of a reset signal RST for the storage unit 420. The clock terminal 433 receives supply of a clock signal SCK for the storage unit 420. The power supply terminal 436 receives supply of a source voltage VDD (for example, rated voltage of 3.3 V) for the storage unit 420. The ground terminal 437 receives supply of a ground voltage VSS (0 V) for the storage unit 420. The data terminal 438 receives supply of a data signal SDA for the storage unit 420.

The ground terminal 437 including the contact cp provided at the center in the Y-axis direction among the contacts cp of the terminals forming the cartridge-side terminal group 400 is placed at a position crossing the plane Yc that passes through the center of the width (length in the Y-axis direction) of the cartridge 20. The contacts cp of the other terminals 431 to 436, 438 and 439 are placed at positions to be symmetric with respect to a line of intersection of the plane Yc and the ground terminal 437. All the plurality of apparatus-side terminals 71 provided in the second electrode assembly 70 have elasticity. Among the plurality of apparatus-side terminals 71, a terminal that comes into contact with the ground terminal 437 is provided to be protruded in the +Z direction from the other terminals. Accordingly, the ground terminal 437 comes into contact with the apparatus-side terminal 71 at the earlier timing than the other cartridge-side terminals 431 to 436, 438 and 439 in the process of mounting the cartridge 20 to the holder 61. The biasing force first applied to the cartridge 20 by the elastic force of the apparatus-side terminal 71 is generated at the center of the width in the Y-axis direction of the cartridge 20. This configuration suppresses this biasing force from acting as a force to incline the cartridge 20 in the Y-axis direction and enables the cartridge 20 to be smoothly mounted at the designed mounting position. Even when a high voltage is applied unintentionally to the cartridge 20-side, the earlier contact of the ground terminal 437 with the apparatus-side terminal 71 than the other cartridge-side terminals 431 to 436, 438 and 439 relieves a trouble caused by the high voltage, for example, breakdown of the circuit of the printer 10, by the grounding function of the ground terminal 437.

According to the embodiment, the ground terminal 437 is formed longer in the direction along the Z axis than the other cartridge-side terminals 431 to 436, 438 and 439. This configuration enables the ground terminal 437 to come into contact with the apparatus-side terminal 71 at the earlier timing than the other terminals 431 to 436, 438 and 439. This more reliably prevents a trouble caused by a high voltage, for example, breakdown of the circuit of the printer 10.

A3. Detailed Configuration of Holder 61

Figure 7:
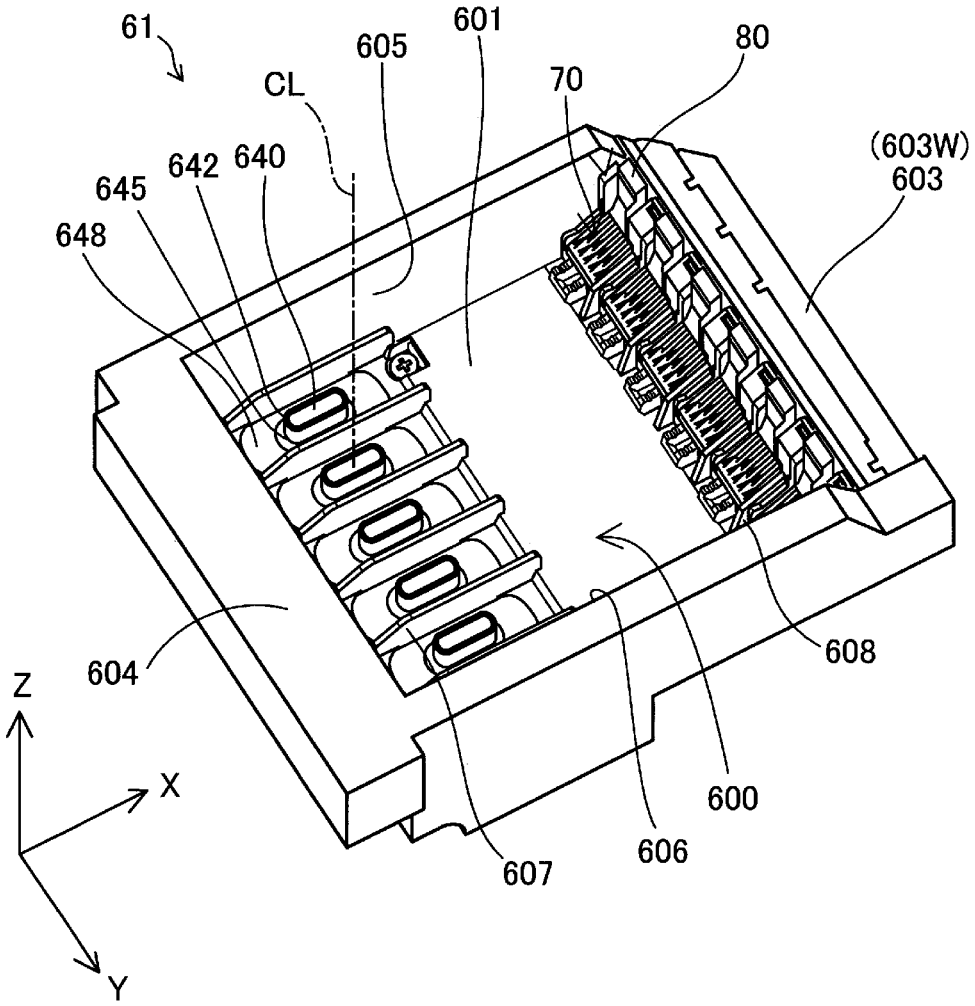
FIG. 7 is a first perspective view illustrating the configuration of a holder.
Figure 8:
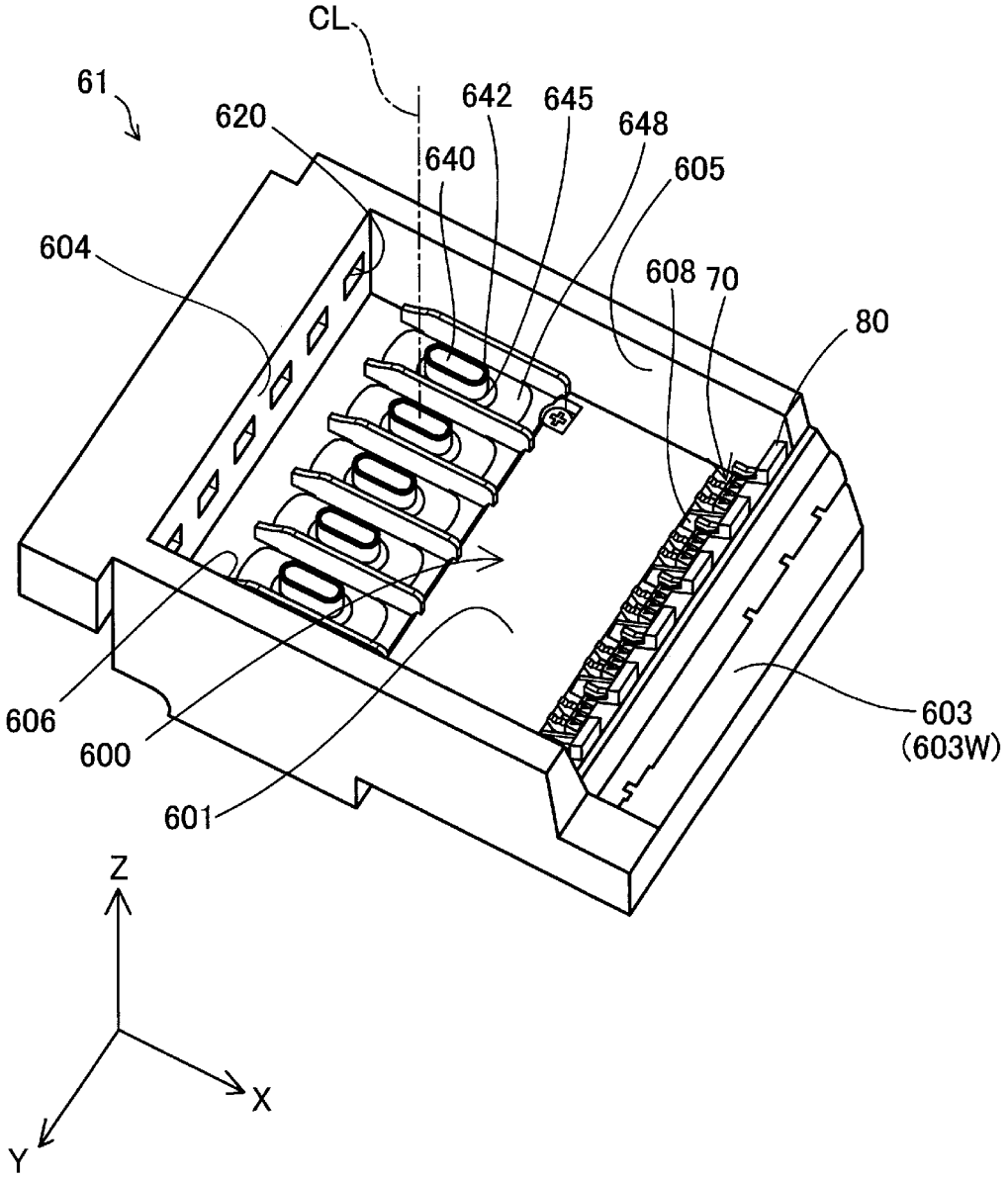
FIG. 8 is a second perspective view illustrating the configuration of the holder.
Figure 9:
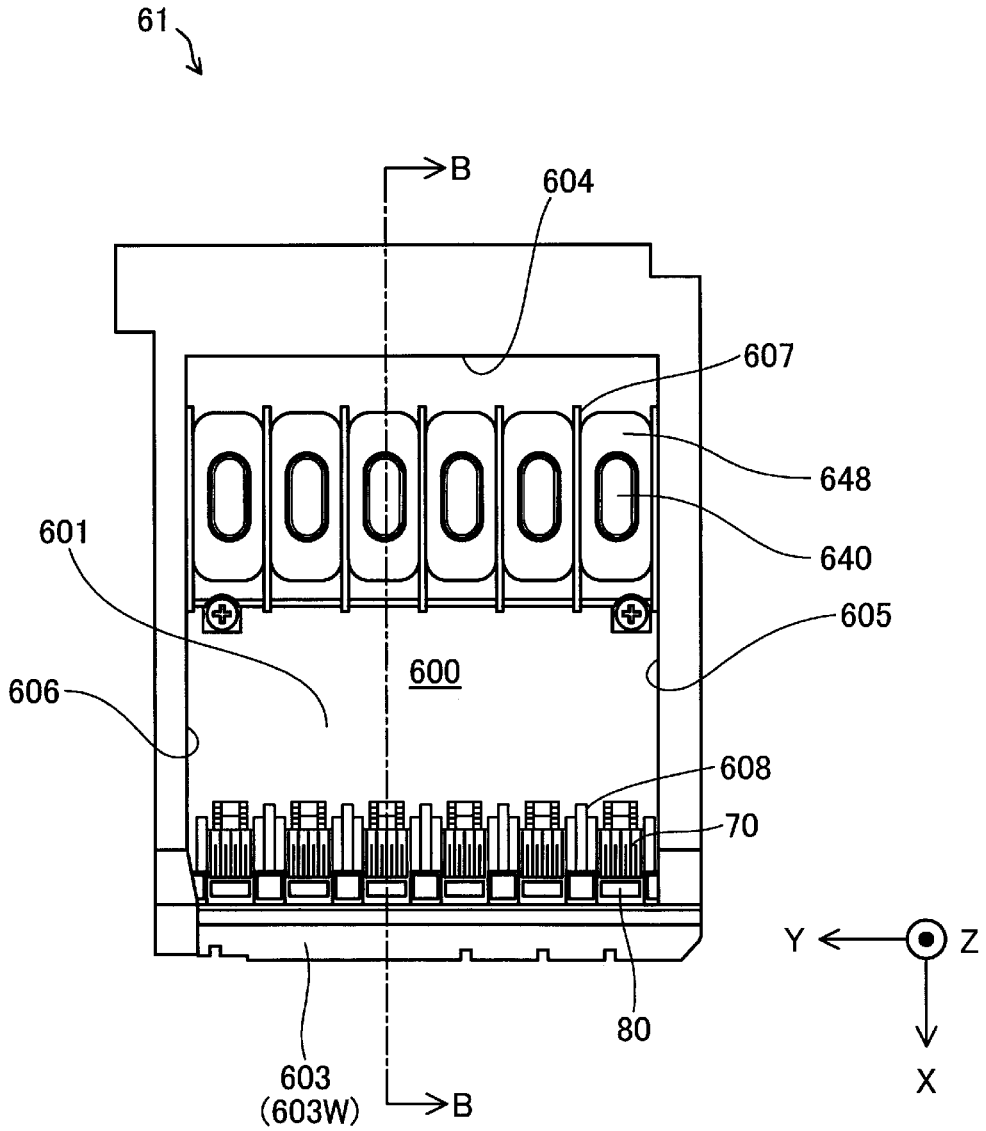
FIG. 9 is a top view illustrating the configuration of the holder.
Figure 10:
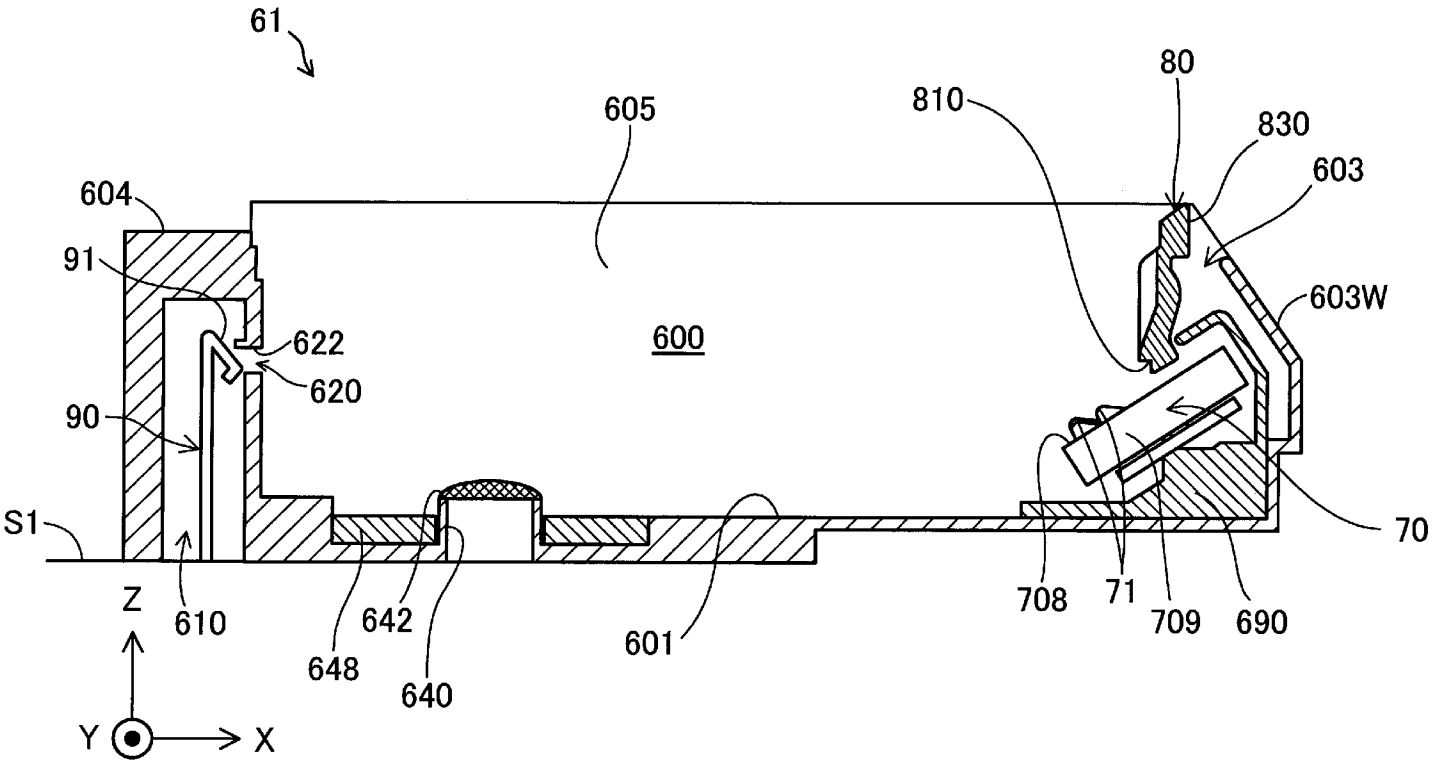
FIG. 10 is a sectional view illustrating the configuration of the holder.

FIG. 7 is a first perspective view illustrating the configuration of the holder 61. FIG. 8 is a second perspective view illustrating the configuration of the holder 61. FIG. 9 is a top view illustrating the configuration of the holder 61. FIG. 10 is a sectional view illustrating the configuration of the holder 61. FIG. 10 illustrates a B-B section shown in FIG. 9.

The holder 61 includes five wall portions 601, 603, 604, 605 and 606 as wall faces defining a cartridge chamber 600 in a recessed shape to receive the cartridges 20 therein. According to the embodiment, the five wall portions 601 to 606 are made from resin plate-like members. According to the embodiment, the five wall portions 601 to 606 are made of a synthetic resin. According to the embodiment, the five wall portions 601 to 606 are made of modified polyphenylene ether (m-PPE).

The wall portion 601 defines a bottom face of the cartridge chamber 600 in the recessed shape. The wall portions 603, 604, 605 and 606 respectively define side faces of the cartridge chamber 600 in the recessed shape.

Six sets of an ink intake portion 640 and a second electrode assembly 70 with an apparatus-side terminal group, which are arrayed along the X-axis direction, are arranged along the Y-axis direction on the wall portion 601. A first partition plate 607 and a second partition plate 608 are placed on the boundary between respective adjacent sets. The first partition plate 607 and the second partition plate 608 are respectively arranged on a −X direction end and on a +X direction end to have their thickness directions parallel to the Y-axis direction. These two different types of partition plates 607 and 608 form six slots (mounting spaces), which the cartridges 20 are respectively mounted to, in the cartridge chamber 600.

The ink intake portion 640 is provided on the wall portion 604-side, and the second electrode assembly 70 is provided on the wall portion 603-side. The ink intake portion 640 is provided on a side nearer to the wall portion 604 than the second electrode assembly 70. The second electrode assembly 70 is provided on a side nearer to the wall portion 603 than the ink intake portion 640.

The ink intake portion 640 has a tubular appearance of an elliptical shape in planar view and is configured to receive ink that is supplied from the liquid supply portion 230 of the ink cartridge 20. The ink intake portion 640 is arranged parallel to the Z-axis direction. As shown in FIG. 10, a porous filter 642 placed on a +Z direction end of the ink intake portion 640. A large number of pores are formed in the porous filter 642 to keep ink therein. The porous filter 642 is arranged to be in contact with the thin plate member 234 of the cartridge 20.

An elastic member 648 is provided around the ink intake portion 640 on the wall portion 601. The elastic member 648 seals an opening 233 of the liquid supply portion 230 of the cartridge 20 in the mounted state, so as to prevent leakage of ink from the liquid supply portion 230 to the periphery and suppress the air from flowing from a gap between the liquid supply portion 230 and the wall portion 601 into the ink intake portion 640. This configuration prevents the ink remaining in the holder 61 or in the print head 62 (ink remaining between the ink intake portion 640 and the print head 62) from being evaporated or from being dried to be sticky. The elastic member 648 generates a biasing force in a direction pressing back the liquid supply portion 230 (+Z direction) in the state that the cartridge 20 is mounted to the holder 61.

The second electrode assembly 70 is provided in an intersecting part of the wall portion 601 and the wall portion 603 of the holder 61. The second electrode assembly 70 comes into contact with the circuit board 40 of the ink cartridge 20 to electrically connect with the respective terminals 431 to 439 on the circuit board 40 in the mounted state. As shown in FIG. 10, the second electrode assembly 70 includes the plurality of apparatus-side terminals 71 that correspond to and come into contact with the respective terminals 431 to 439 of the cartridge 20, and a terminal base 709 provided to hold the plurality of apparatus-side terminals 71. An upper face of the terminal base 709 is formed as a slope face 708 that is inclined in the −X direction and in the −Z direction. An angle of the slope face 708 with respect to the horizontal plane is approximately equal to an angle of the slope face portion 201*a* of the cartridge 20 with respect to the horizontal plane in the mounted state. The apparatus-side terminals 71 are placed on the slope face 708 to be protruded in the −X direction and in the +Z direction.

As shown in FIG. 7 and FIG. 10, a side opposed to the wall portion 601 (top face side) across the cartridge chamber 600 is formed as an opening to be open. The cartridge 20 passes through the opening on the top face side when the cartridge 20 is mounted to and dismounted from the holder 61.

The wall portion 603 is provided to stand on a +X direction end of the wall portion 601. According to the embodiment, an outer wall 603W is provided on a +X direction end of the wall portion 603. The outer wall 603W forms a front face of the holder 61. The outer wall 603W is extended along an array direction of the cartridges 20 (Y-axis direction) in the state that the plurality of cartridges 20 are mounted. A lever 80 is provided on the wall portion 603 and is used for mounting and dismounting the cartridge 20. The lever 80 is fixed in a rotatable manner to the wall portion 603 via a holding member 690 shown in FIG. 10. In other words, the lever 80 is fixed to the holding member 690 that forms part of the wall portion 603. The lever 80 has a rotation axis that is parallel to the Y-axis direction.

As shown in FIG. 10, an operating part 830 is provided on a +Z direction end of the lever 80. When the user presses this operating part 830 from the +X direction toward the −X direction, the lever 80 is rotated about the rotation axis clockwise viewed in the −Y direction. The lever 80 accordingly rotates on an X-Z plane. An engagement structure 810 is formed on a −Z direction end of the lever 80. The engagement structure 810 is formed as a step that is extended along the Y-axis direction.

The wall portion 604 is provided to stand on a −X direction end of the wall portion 601. The wall portion 604 is opposed to the wall portion 603 across the cartridge chamber 600. According to the embodiment, the wall portion 604 forms a rear face of the holder 61. The wall portion 604 is extended along the array direction of the cartridges 20 (Y-axis direction) in the state that the plurality of cartridges 20 are mounted. As shown in FIG. 10, a placing portion 610 is formed inside of the wall portion 604. The placing portion 610 is a chamber formed inside of the wall portion 604 to place the first electrode assembly 90 therein. The detailed configuration of the first electrode assembly 90 is described below. A through hole 620 is formed in the wall portion 604 to cause the placing portion 610 described above to communicate with the cartridge chamber 600. An upper inner wall portion 622 of the inner wall of the wall portion 604 that faces the through hole 620 is in contact with the first restriction locking face 222 of the second engaged structure 220 in the engaged state.

Figure 11:
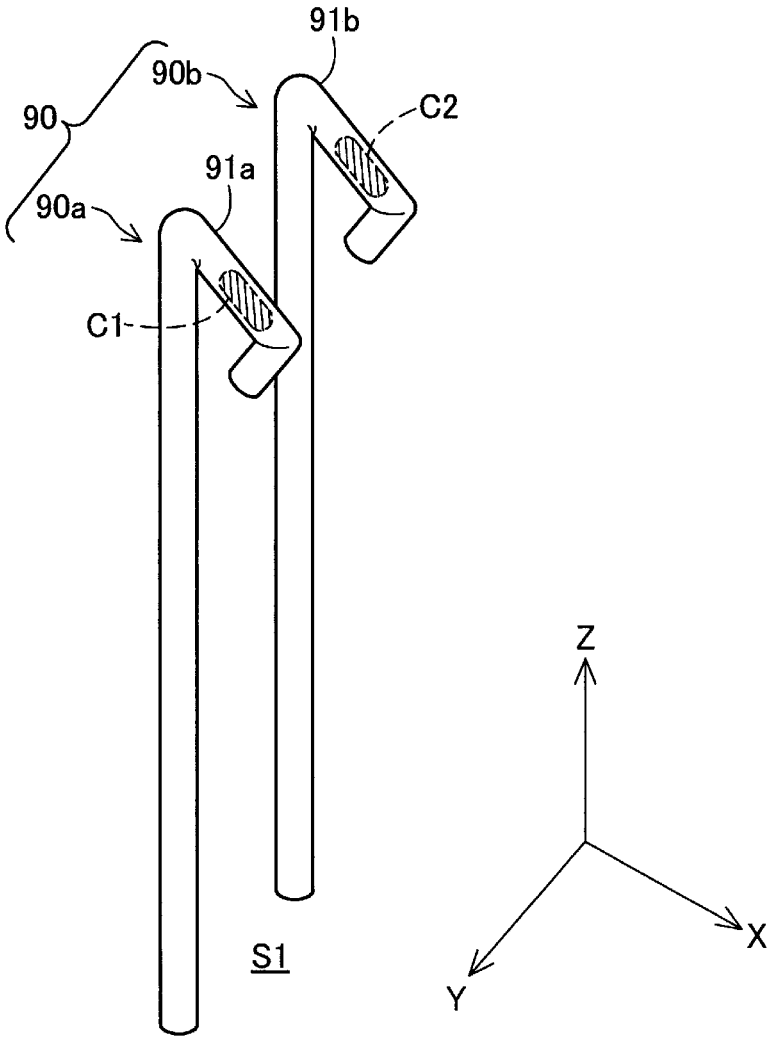
FIG. 11 is a perspective view illustrating the detailed configuration of a first electrode assembly shown in FIG. 10.

FIG. 11 is a perspective view illustrating the detailed configuration of the first electrode assembly 90 shown in FIG. 10. The first electrode assembly 90 includes two electrodes (first electrode 90*a* and second electrode 90*b*) that are placed away from each other by a predetermined distance along the Y-axis direction. Both the two electrodes 90*a* and 90*b* have columnar rod-like appearance shapes to be extended in the +Z direction from a bottom face S1 of the wall portion 604. Both the two electrodes 90*a* and 90*b* are made from thin metal rod-like members to be bendable at least in the X-axis direction. Base ends (−Z direction ends) of the two electrodes 90*a* and 90*b* are electrically connected with a second mounting detection circuit 553 of the controller 510 described later.

A bent portion 91*a* is provided on a +Z direction leading end of the first electrode 90*a*. The bent portion 91*a* is bent from the base end portion in the +X direction and in the −Z direction. A leading end of the bent portion 91*a* is further bent in the −X direction and in the −Z direction. In the engaged state, a contact region C1 of the bent portion 91*a* comes into contact with the contact region C21 of the electrically conductive portion 227 of the cartridge 20.

The second electrode 90*b* has a similar configuration to the configuration of the first electrode 90*a* described above. More specifically, a bent portion 91*b* that has a similar configuration to that of the bent portion 91*a* is provided on a leading end of the second electrode 90*b*. In the engaged state, a contact region C2 of the bent portion 91*b* comes into contact with the contact region C22 of the electrically conductive portion 227 of the cartridge 20.

As shown in FIG. 7 to FIG. 10, the wall portion 605 is provided to stand on a −Y direction end of the wall portion 601. According to the embodiment, the wall portion 605 forms a right side face of the holder 61. The wall portion 605 is connected with the wall portions 603 and 604. The wall portion 605 is extended along the X-axis direction to intersect with the array direction of the cartridges 20 (Y-axis direction).

The wall portion 606 is provided to stand on a +Y direction end of the wall portion 601. The wall portion 606 is opposed to the wall portion 605 across the cartridge chamber 600. According to the embodiment, the wall portion 606 forms a left side face of the holder 61. The wall portion 606 is connected with the wall portions 603 and 604. The wall portion 606 is extended along the X-axis direction to intersect with the array direction of the cartridges 20 (Y-axis direction).

The relationship of the wall portions 601 and 603 to 606 described above provides the following arrangement. The direction perpendicular to the wall portion 601 is the Z-axis direction. The direction in which the wall portion 603 and the wall portion 604 are opposed to each other is the X-axis direction. The direction in which the wall portion 605 and the wall portion 606 are opposed to each other is the Y-axis direction. The direction in which the wall portion 601 and the opening are opposed to each other is the Z-axis direction.

A4. Description of Mounted State and Mounting Operation

Figure 12:
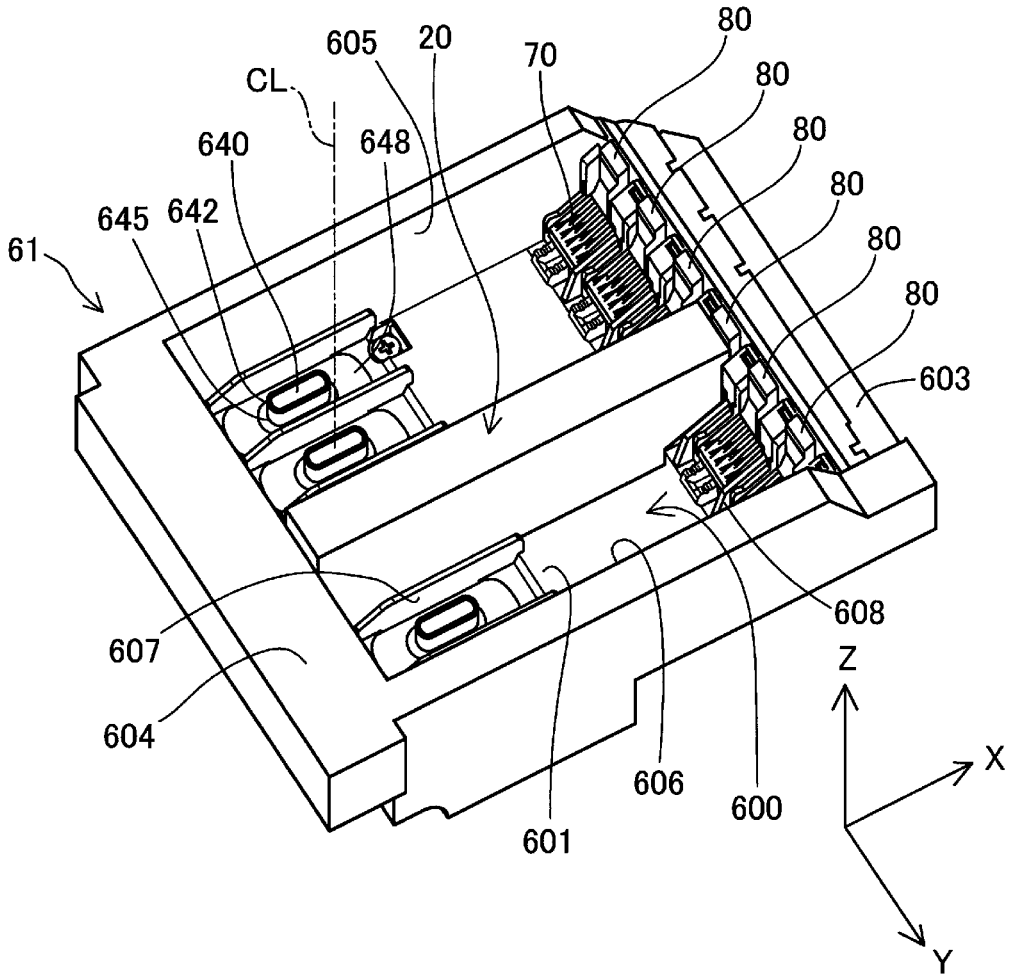
FIG. 12 is a first perspective view illustrating the configuration of the cartridge and the holder in a mounted state.
Figure 13:
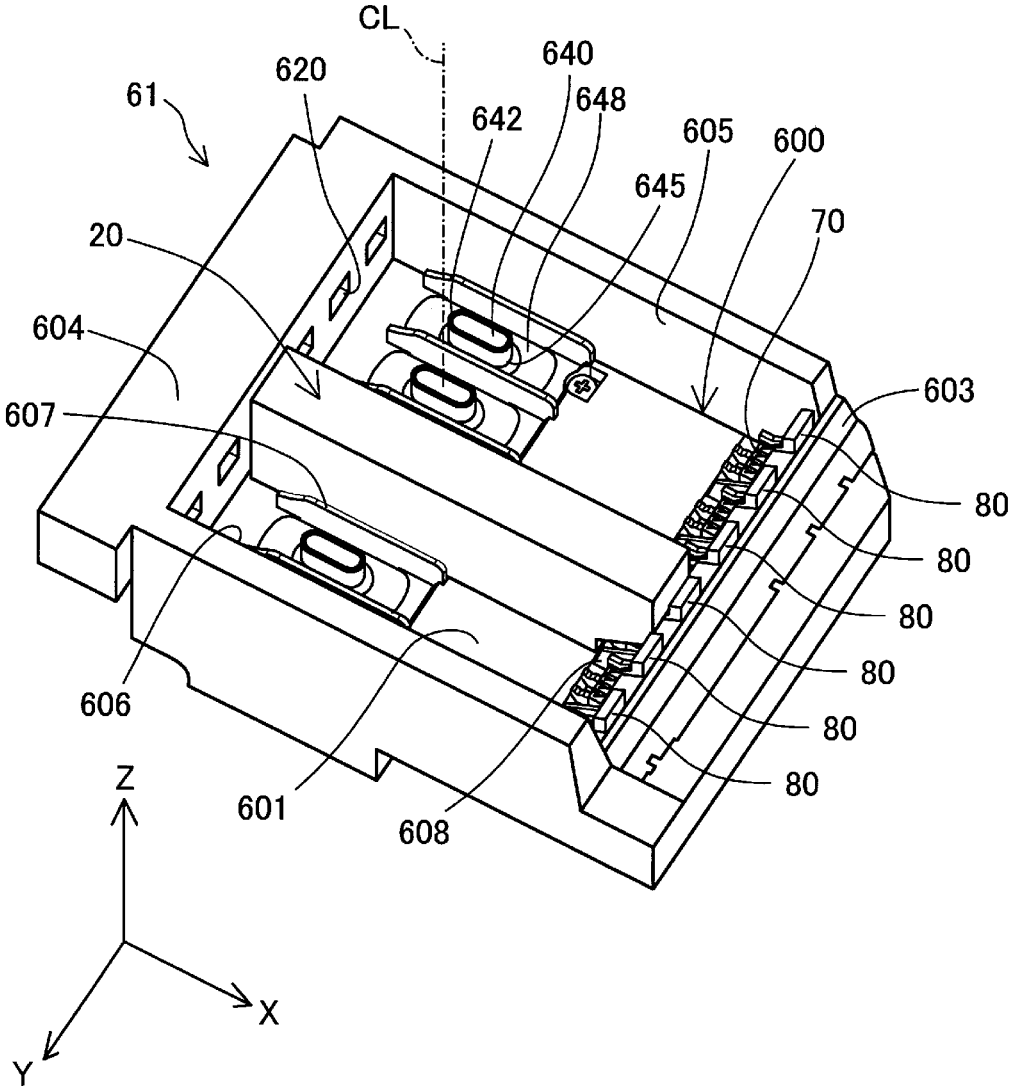
FIG. 13 is a second perspective view illustrating the configuration of the cartridge and the holder in the mounted state.
Figure 14:
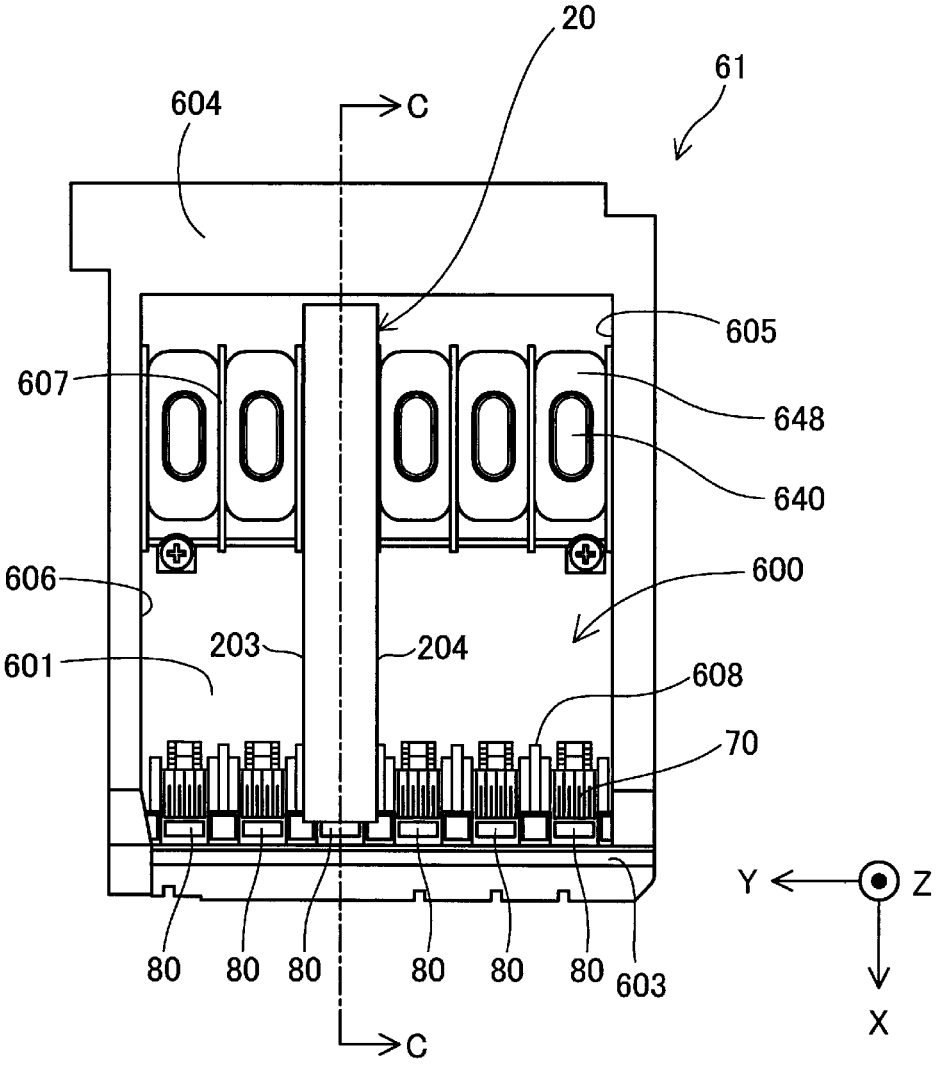
FIG. 14 is a top view illustrating the configuration of the cartridge and the holder in the mounted state.
Figure 15:
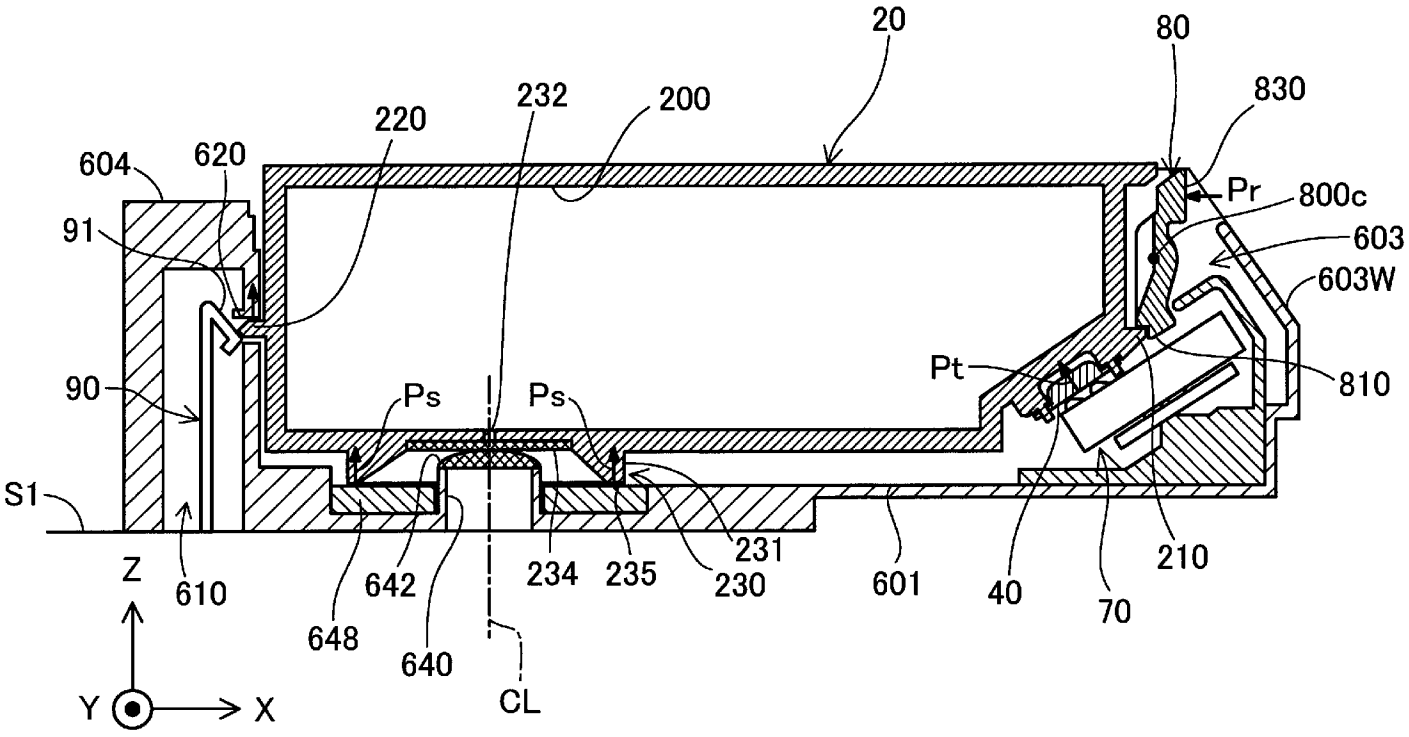
FIG. 15 is a sectional view illustrating the configuration of the cartridge and the holder in the mounted state.
Figure 16:
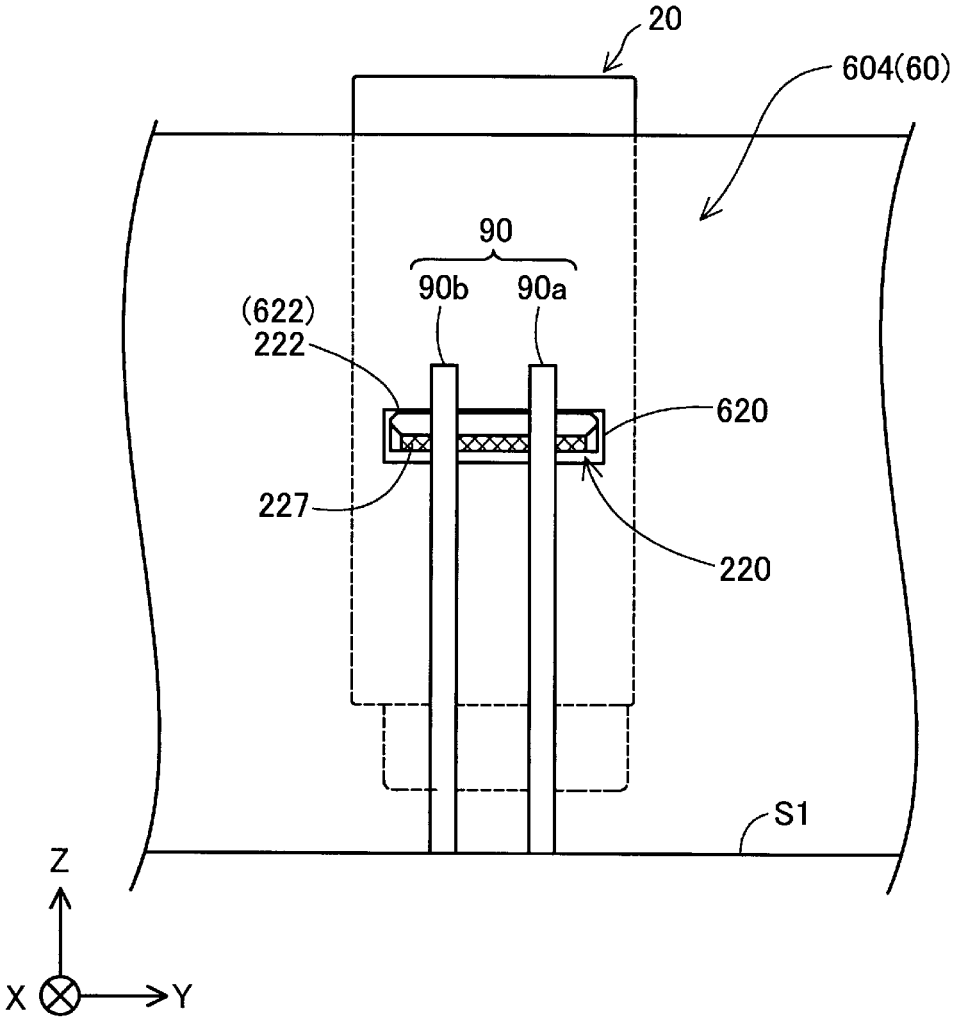
FIG. 16 is a diagram illustrating the configuration of the cartridge and the first electrode assembly in the mounted state.

FIG. 12 is a first perspective view illustrating the configuration of the cartridge 20 and the holder 61 in the state that the cartridge 20 is normally mounted to the holder 61 (hereinafter simply referred to the "mounted state"). FIG. 13 is a second perspective view illustrating the configuration of the cartridge 20 and the holder 61 in the mounted state. FIG. 14 is a top view illustrating the configuration of the cartridge 20 and the holder 61 in the mounted state. FIG. 15 is a sectional view illustrating the configuration of the cartridge 20 and the holder 61 in the mounted state. FIG. 15 illustrates a C-C section shown in FIG. 14. FIG. 12 to FIG. 14 illustrate the state that the cartridge 20 is mounted to a second slot from the wall portion 601-side in the cartridge chamber 600. FIG. 16 is a diagram illustrating the configuration of the cartridge 20 and the first electrode assembly 90 in the mounted state. FIG. 16 illustrates the configuration of the cartridge 20 and the first electrode assembly 90 viewed in the +X direction from inside of the placing portion 610.

As shown in FIG. 12, FIG. 13, and FIG. 15, the first face 201 of the cartridge 20 is arranged to be opposed to the wall portion 601 of the holder 61 and to be parallel to the wall portion 601. As shown in FIG. 14, the third face 203 of the ink cartridge 20 is arranged to be parallel to the wall portion 606 of the holder 61, and the fourth face 204 of the cartridge 20 is arranged to be parallel to the wall portion 605 of the holder 61.

As shown in FIG. 15, in the mounted state, the second engaged structure 220 is inserted into the through hole 620 to be engaged with the through hole 620. Accordingly, the state that the cartridge 20 is normally mounted to the holder 61 provides the engaged state that the second engaged structure 220 is engaged with the through hole 620. In the engaged state, the leading end of the second engaged structure 220 comes into contact with the first electrode assembly 90.

The following gives the more detailed description based on FIG. 5, FIG. 11, FIG. 15 and FIG. 16. In the engaged state, the two electrodes 90*a* and 90*b* constituting the first electrode assembly 90 come into contact with the electrically conductive portion 227 provided on the leading end of the second engaged structure 220. More specifically, the contact region C1 of the bent portion 91*a* of the first electrode 90*a* (shown in FIG. 11) comes into contact with the contact region C21 of the electrically conductive portion 227 (shown in FIG. 5). The contact region C2 of the bent portion 91*b* of the second electrode 90*b* (shown in FIG. 11) comes into contact with the contact region C22 of the electrically conductive portion 227 (shown in FIG. 5). In the engaged state, the two electrodes 90*a* and 90*b* in contact with the electrically conductive portion 227 in this way provides electrical continuity between the first electrode 90*a* and the second electrode 90*b*. As described above, the electrically conductive portion 227 is used by the printer 10 to detect the cartridge mounting. In the engaged state, the electrical continuity between the first electrode 90*a* and the second electrode 90*b* via the electrically conductive portion 227 enables the printer 10 to detect mounting of the cartridge 20 to the holder 61 of the printer 10. Such detection of the mounting will be described more in detail later.

In the mounted state, the cartridge-side terminals (not shown) provided on the circuit board 40 are in contact with the apparatus-side terminals (not shown) provided in the second electrode assembly 70. In this state, the circuit board 40 is placed, such that the surface 408 of the circuit board 40 is parallel to the slope face 708 of the terminal base 709 of the second electrode assembly 70. A leading end 235 (−Z direction end face) of the wall 231 of the liquid supply portion 230 is in contact with the elastic member 648 of the holder 61. The center axis CL of the ink supply path 232 is identical with a center axis of the ink intake portion 640. The thin plate member 234 is in contact with the porous filter 642. Ink contained in the liquid container portion 200 is supplied through the ink supply path 232 to the thin plate member 234 to be temporarily kept therein. The ink kept in the thin plate member 234 is supplied through the porous filter 642 to the ink intake portion 640, accompanied with ejection of ink from the print head 62.

The leading end 235 (−Z direction end face) of the wall 231 of the liquid supply portion 230 receives a biasing force Ps in the +Z direction from the elastic member 648. The circuit board 40 receives a biasing force Pt in the −X direction and in the +Z direction from the second electrode assembly 70. The cartridge 20 as a whole accordingly receives a stress from the holder 61 in a mounting direction, i.e., in the +Z direction opposite to the −Z direction. This stress causes the first restriction locking face 222 of the second engaged structure 220 to come into contact with the upper inner wall portion 622 of the through hole 620 (shown in FIG. 10) and to be pressed against the upper inner wall portion 622 in the +Z direction. This configuration restricts the motion of the cartridge 20 in the +Z direction.

Figure 17:
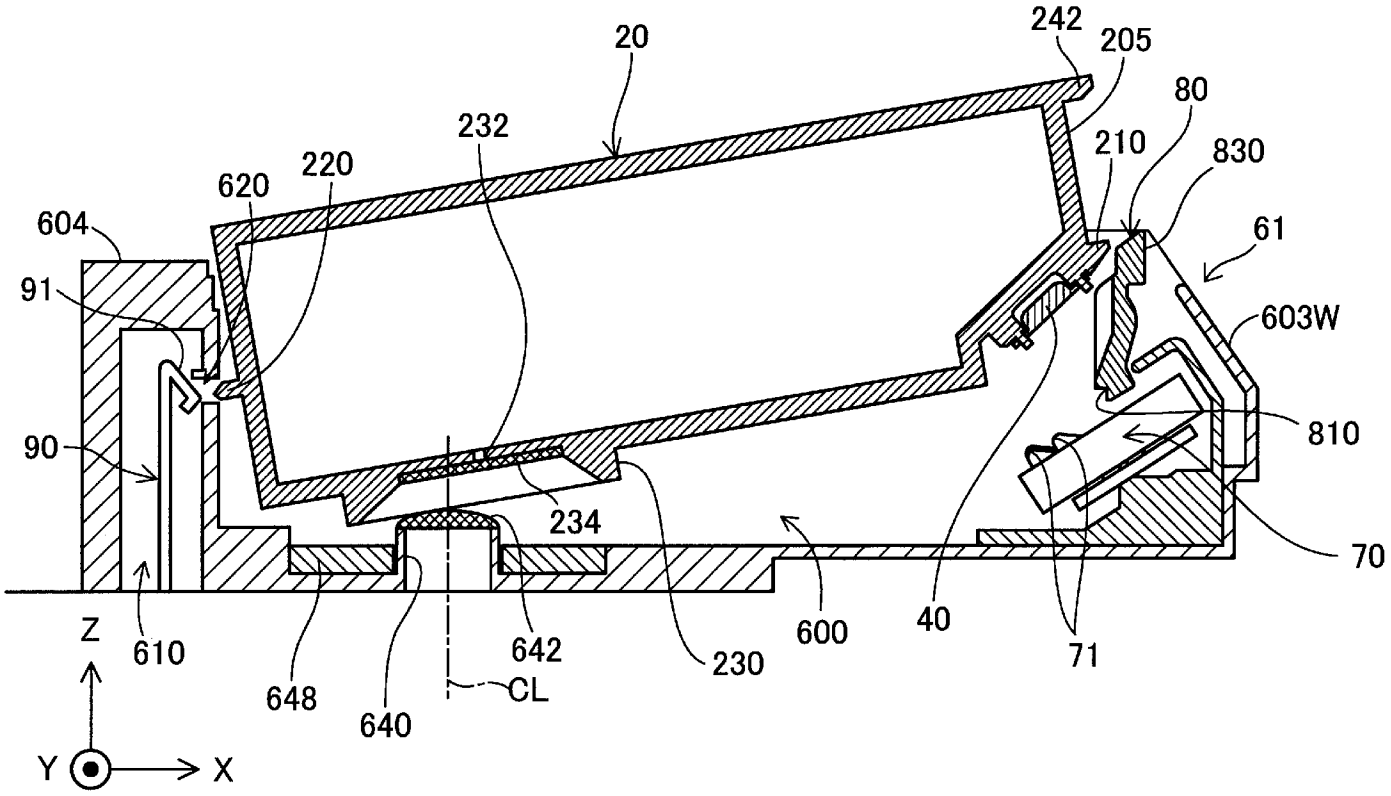
FIG. 17 is a first sectional view illustrating the configuration of the cartridge and the holder in the middle of a mounting operation.
Figure 18:
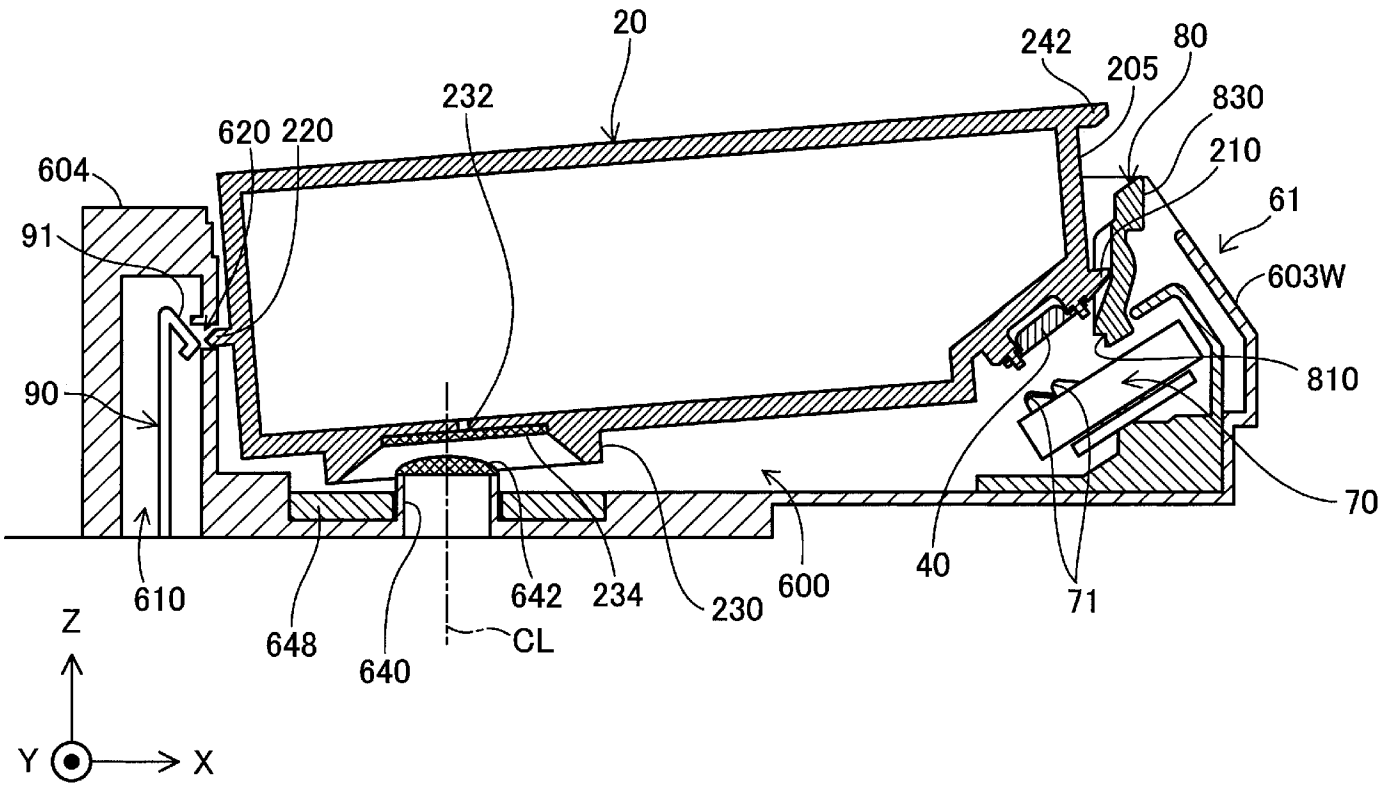
FIG. 18 is a second sectional view illustrating the configuration of the cartridge and the holder in the middle of the mounting operation.

FIG. 17 is a first sectional view illustrating the configuration of the cartridge 20 and the holder 61 in the middle of a mounting operation. FIG. 18 is a second sectional view illustrating the configuration of the cartridge 20 and the holder 61 in the middle of the mounting operation. FIG. 17 and FIG. 18 illustrate the sections of the cartridge 20 and the holder 61 at a position similar to the position of FIG. 15. FIG. 17 and FIG. 18 show a change in time series.

In the process of mounting the cartridge 20, the user inserts the second engaged structure 220 into the through hole 620 as shown in FIG. 17, while lowering the cartridge 20 downward (−Z direction) through the upper opening of the cartridge chamber 600. In this state, the ink intake portion 640 is not yet inserted into the liquid supply portion 230.

The user subsequently rotates the cartridge 20 clockwise viewed in the +Y direction from the state shown in FIG. 17 about the second engaged structure 220 inserted in the through hole 620 as the rotation fulcrum, so as to press in the fifth face 205 of the cartridge 20 across the wall portion 603 of the holder 61 toward the wall portion 601. The first engaged structure 210 then moves in the −Z direction along a −X direction end face of the lever 80 as shown in FIG. 18. At this moment, part of the upper side of the ink intake portion 640 starts to be placed inside of the liquid supply portion 230 as shown in FIG. 18.

When the user further rotates the cartridge 20 from the state shown in FIG. 18 to further press in the fifth face 205 of the cartridge 20, the first engaged structure 210 is further pressed in the −Z direction. This causes the first engaged structure 210 to be engaged with the engagement structure 810 as shown in FIG. 15. As described above, the second engaged structure 220 is fully inserted into the through hole 620, and the thin plate member 234 of the liquid supply portion 230 is brought into close contact with the porous filter 642 of the ink intake portion 640.

In the process of dismounting the cartridge 20 from the holder 61, the user presses the operating part 830 of the lever 80 in the direction of an arrow Pr shown in FIG. 15. This causes the first engaged structure 210 and the engagement structure 810 to be disengaged from each other. The circuit board 40-side part of the cartridge 40 is slightly popped up in the +Z direction by the biasing force Pt applied to the circuit board 40. The user then pulls out the second engaged structure 220 from the through hole 620 and takes out the cartridge 20 from the holder 61.

As described above, according to the embodiment, various motions are included in the process of mounting the cartridge 20 to the printer 10 (holder 61) and in the process of dismounting the cartridge 20 from the printer 10 (holder 61). These motions are all designed for the purpose of firmly connecting the liquid supply portion 230 including the ink supply path 232 that has the center axis CL parallel to the Z-axis direction with the ink intake portion 640 that also has the center axis parallel to the Z-axis direction. Each of these motions includes a motion of the cartridge 20 in the −Z direction or in the +Z direction. According to the embodiment, the "mounting direction of the cartridge 20 to the printer 10" is thus regarded as the −Z direction, and the "dismounting direction of the cartridge 20 from the printer 10" is regarded as the +Z direction.

Figure 19:
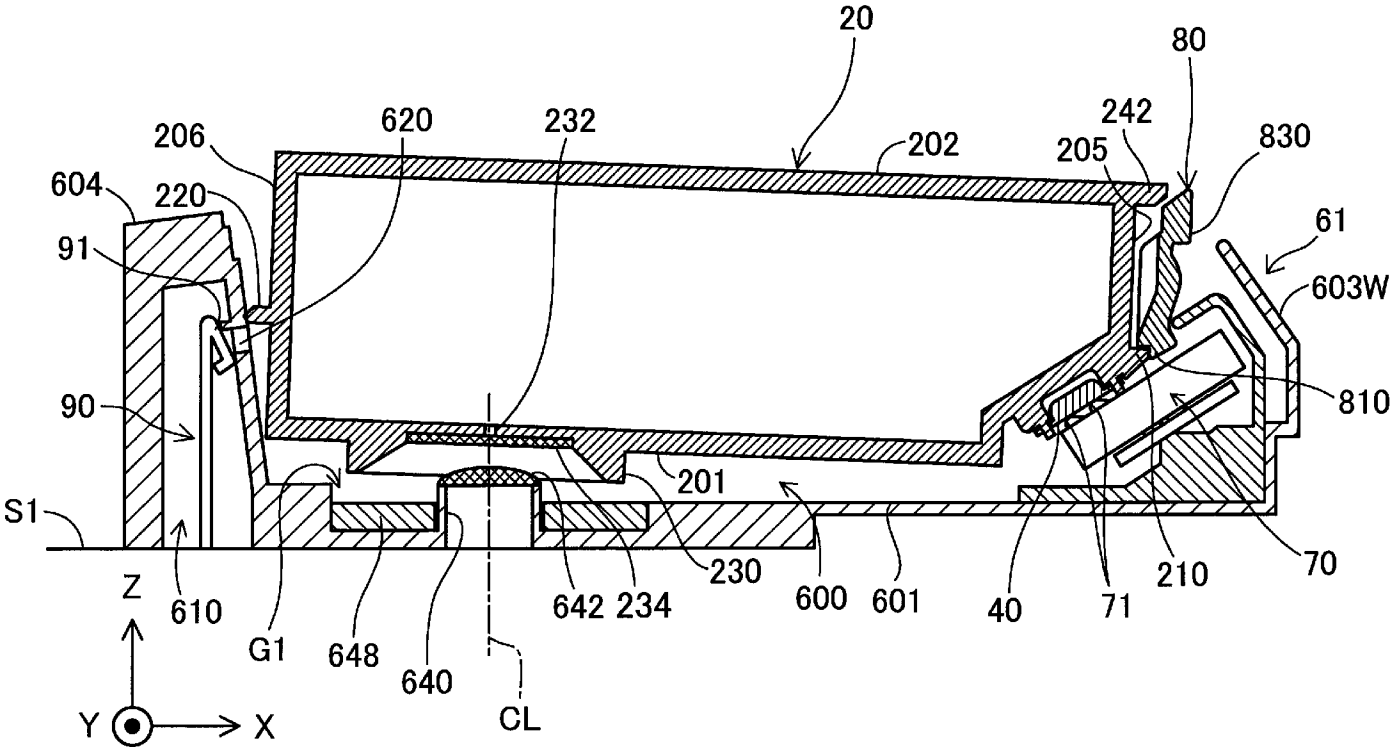
FIG. 19 is a sectional view illustrating the configuration of the cartridge and the holder in an abnormal mounted state.

FIG. 19 is a sectional view illustrating the configuration of the cartridge 20 and the holder 61 in an abnormal mounted state. FIG. 19 illustrates the sections of the cartridge 20 and the holder 61 at a position similar to the position of FIG. 15.

In the normal mounted state shown in FIG. 15, the first face 201 and the second face 202 of the cartridge 20 are approximately horizontal. In the abnormal mounted state shown in FIG. 19, on the other hand, the cartridge 20 is caught on the inner wall of the holder 61 and the first face 201 and the second face 202 of the cartridge 20 are inclined to the horizontal plane. More specifically, the sixth face 206-side of the cartridge 20 rises in the +Z direction. In this state, the second engaged structure 220 is not inserted in the through hole 620. The second engaged structure 220 is caught on an inner face (face exposed on the cartridge chamber 600) of the wall portion 604 of the holder 61 above the through hole 620. The wall portion 604 of the holder 61 is deformed by the stress that raises the sixth face 206-side of the cartridge 20 in the +Z direction in the state that the second engaged structure 220 is caught on the wall portion 604. In this state, the ink intake portion 640 is not fully connected with the liquid supply portion 230. A small region of a leading end of the ink intake portion 640 is placed inside of the liquid supply portion 230, but the porous filter 642 is not in contact with the thin plate member 230. The liquid supply portion 230 is also not in contact with the elastic member 648, and there is a gap G1 between the liquid supply portion 230 and the elastic member 648. The cartridge-side terminals (not shown) provided on the circuit board 40 are, on the other hand, in contact with the apparatus-side terminals (not shown) provided in the second electrode assembly 70, as in the normal mounted state shown in FIG. 15. The first engaged structure 210 is engaged with the engagement structure 810 of the lever 80. Such an abnormal state may arise, for example, when the user forcibly presses in the fifth face 205-side of the cartridge 20 in the −Z direction without inserting the second engaged structure 220 into the through hole 620 and forcibly engages the first engaged structure 210 with the engagement structure 810 in the process of mounting the cartridge 20 to the holder 61. When the printer 10 tries to inject ink from the print head 62 in this state, the printer 10 fails to suck ink from the liquid container portion 200 due to the presence of the above gap G1. The printer 10 takes in the air instead of ink. The air taken into the flow path of the printer 10 may be removed to some extent by a cleaning operation that sucks inside of the flow path from an injection surface side of the print head 62. This cleaning operation is generally provided to forcibly discharge a small amount of the air, which is mixed with ink inside of the cartridge 20 and which is taken along with ink into the flow path, outside of the head. When the printer 10 is used in the state that the ink intake portion 640 is not fully connected with the liquid supply portion 230, however, a larger amount of the air that is not removable by the general cleaning operation is likely to enter the flow path. When the printer 10 is left for a long time period in the state that the unremovable amount of the air is accumulated in the flow path, this makes it likely that the ink remaining in the flow path is evaporated or is dried to be sticky and makes it difficult to eject the ink. The printer 10 of this embodiment is configured to identify such an abnormal mounted state, to prevent ink from being ejected in the abnormal mounted state and to give a warning notification to the user in the abnormal mounted state.

A5. Detection of Mounting

Figure 20:
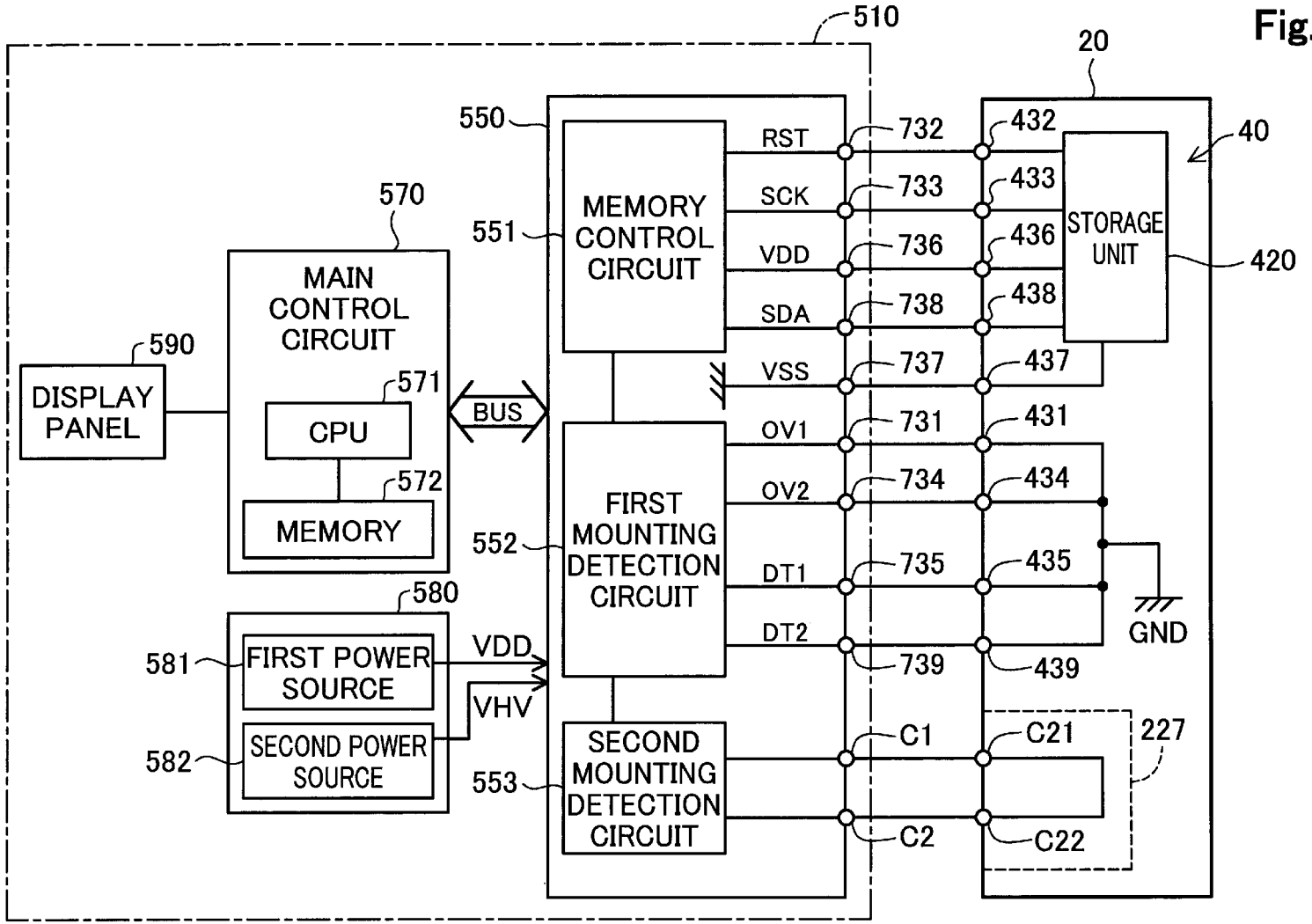
FIG. 20 is a block diagram illustrating the electric configuration of the circuit board of the cartridge and a controller of the printer according to the first embodiment.

FIG. 20 is a block diagram illustrating the electric configuration of the circuit board 40 of the cartridge 20 and the controller 510 of the printer 10 according to the first embodiment. The controller 510 includes a display panel 590, a power supply circuit 580, a main control circuit 570 and a sub control circuit 550. The display panel 590 is configured to notify the user of various information, for example, the operating state of the printer 10 and the mounted state of the cartridge 20. The display panel 590 may be provided, for example, on a front face panel of the printer 10 that is visible from outside of the printer 10. The power supply circuit 580 includes a first power source 581 configured to generate a first source voltage VDD and a second power source 582 configured to generate a second source voltage VHV. The first source voltage VDD is a general source voltage (rated voltage of 3.3 V) used for a logic circuit. The second source voltage VHV is a high voltage (for example, rated voltage of 42V) used to drive the print head 62 to eject ink. These voltages VDD and VHV are supplied to the sub control circuit 550 and may also be supplied to other circuits as needed basis. The main control circuit 570 includes a CPU 571 and a memory 572. The sub control circuit 550 includes a memory control circuit 551, a first mounting detection circuit 552, and a second mounting detection circuit 553. A circuit including the main control circuit 570 and the sub control circuit 550 may be called "control circuit".

Among the nine terminals 431 to 439 provided on the circuit board 40 of the cartridge, the reset terminal 432, the clock terminal 433, the power supply terminal 436, the ground terminal 437, and the data terminal 438 are electrically connected with the storage unit 420. The storage unit 420 is a non-volatile memory configured without an address terminal to determine a memory cell to be accessed, based on the number of pulses of the clock signal SCK input from the clock terminal 433 and command data input from the data terminal 438, and to receive data from the data terminal 438 or to send data from the data terminal 438 in synchronism with the clock signal SCK. The clock terminal 433 is used to supply the clock signal SCK from the sub control circuit 550 to the storage unit 420. The source voltage (for example, rated voltage of 3.3 V) used to drive the storage unit 420 and the ground voltage (0 V) are respectively supplied from the printer 10 to the power supply terminal 436 and to the ground terminal 437. The source voltage used to drive the storage unit 420 may be a voltage directly applied from the first source voltage VDD or may be a voltage that is generated from the first source voltage VDD and that is lower than the source voltage VDD. The data terminal 438 is used to transmit the data signal SDA between the sub control circuit 550 and the storage unit 420. The reset terminal 432 is used to supply the reset signal RST from the sub control circuit 550 to the storage unit 420. The four mounting detection terminals 431, 434, 435 and 439 are connected with one another via wiring inside of the circuit board 40 of the cartridge 20 (shown in FIG. 3) and are all grounded. For example, the mounting detection terminals 431, 434, 435 and 439 are connected with the ground terminal 437 to be grounded. The mounting detection terminals 431, 434, 435 and 439 may be grounded by any route other than the ground terminal 437. As understood from this description, the mounting detection terminals 431, 434, 435 and 439 may be connected with part of the memory terminals (or with the storage unit 420). It is however, preferable that the mounting detection terminals 431, 434, 435 and 439 are not connected with any memory terminal other than the ground terminal 437 or with the storage unit 420. The configuration that the mounting detection terminals are not at all connected with any memory terminal or with the storage unit 420 is especially preferable, since this configuration prevents any signal or voltage other than a mounting detection signal from being applied to the mounting determination terminals and ensures the more accurate mounting detection. In the illustrated example of FIG. 20, the four mounting detection terminals 431, 434, 435 and 439 are connected with one another by wiring, but part of the wiring used for such connection may be replaced with a resistance.

In FIG. 20, wiring names SCK, VDD, SDA, RST, OV1, OV2, DT1 and DT2 are allocated to wiring routes arranged to respectively connect apparatus-side terminals 731 to 739 with the cartridge-side terminals 431 to 439 of the circuit board 40. Among these wiring names, the same names as the signal names are allocated to the wiring routes for the storage unit 420.

Figure 21:
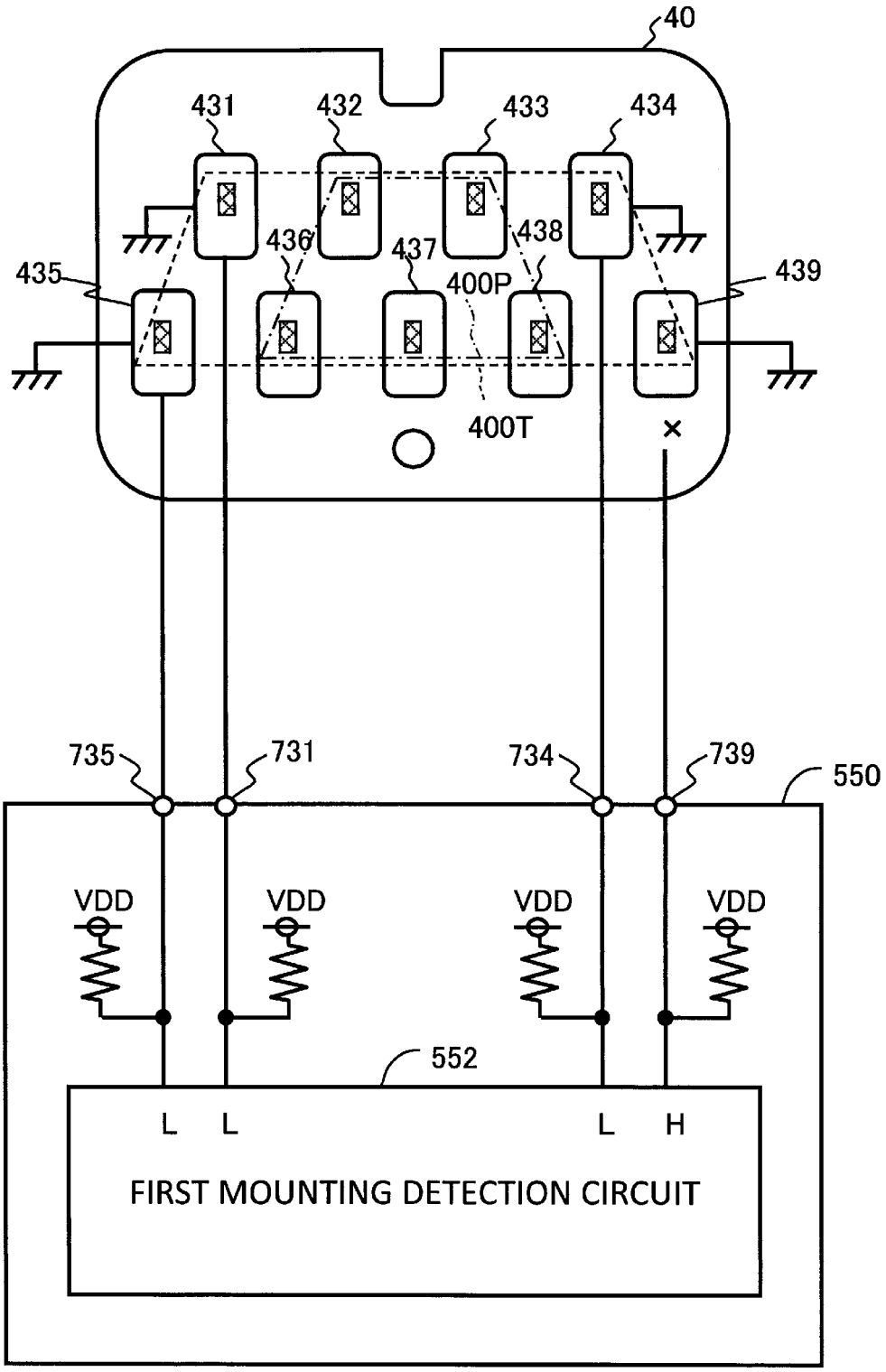
FIG. 21 is a diagram illustrating the connecting state of the circuit board with a first mounting detection circuit.

FIG. 21 is a diagram illustrating the connecting state of the circuit board 40 with the first mounting detection circuit 552. The four mounting detection terminals 431, 434, 435 and 439 of the circuit board 40 are connected with the first mounting detection circuit 552 via the corresponding apparatus-side terminals 731, 734, 735 and 739. The four mounting detection terminals 431, 434, 435 and 439 of the circuit board 40 are also grounded. The wirings arranged to connect the apparatus-side terminals 731, 734, 735 and 739 with the first mounting detection circuit 552 are respectively connected with the source voltage VDD (rated voltage of 3.3 V) in the sub control circuit 550 via pullup resistances.

When the cartridge 20 is significantly inclined to the normal mounted attitude, the circuit board 40 is also inclined. This is likely to cause one or more poor contact conditions among the contact conditions of the four mounting detection terminals 431, 434, 435 and 439 with the terminals 731, 734, 735 and 739 for the storage unit. In the illustrated example of FIG. 21, the three terminals 431, 434 and 435 out of the four mounting detection terminals 431, 434, 435 and 439 of the circuit board 40 have good contact conditions with the corresponding apparatus-side terminals 731, 734 and 735. The fourth mounting detection terminal 439, on the other hand, has a poor contact condition with the corresponding apparatus-side terminal 739. The voltages of the wirings of the three apparatus-side terminals 731, 734 and 735 having the good contact conditions are an L level (ground voltage level), while the voltage of the wiring of the apparatus-side terminal 739 having the poor contact condition is an H level (source voltage VDD level). Accordingly, the first mounting detection circuit 552 checks the voltage levels of the respective wirings and thereby detect the good/poor contact condition with regard to each of the four apparatus-side terminals 731, 734, 735 and 739. As described above, the connection of the four mounting detection terminals 431, 434, 435 and 439 with the first mounting detection circuit 532 of the printer 10 enables the printer 10 to detect mounting of the cartridge 20 to the printer 10. Accordingly, the four mounting detection terminals 431, 434, 435 and 439 serve as the first detector to cause the printer 10 to detect mounting of the cartridge 20 to the printer 10.

The respective contacts cp of the four mounting detection terminals 431, 434, 435 and 439 of the circuit board 40 are placed outside of a first region 400P of the contacts cp of the terminals 432, 433, 436, 437 and 438 for the storage unit. The respective contacts cp of the four mounting detection terminals 431, 434, 435 and 439 are placed outside of the first region 400P. The contacts cp of the four mounting detection terminals 431, 434, 435 and 439 are placed at four corners of a quadrilateral second region 400T that includes the first region 400P. The shape of the first region 400P is preferably a quadrilateral shape of the smallest area that includes the contacts cp of the five terminals 432, 433, 436, 437 and 438 for the storage unit. The shape of the second region 400T is preferably a quadrilateral shape of the smallest area that includes all the contacts cp of the cartridge-side terminals 431 to 439.

Figure 22:
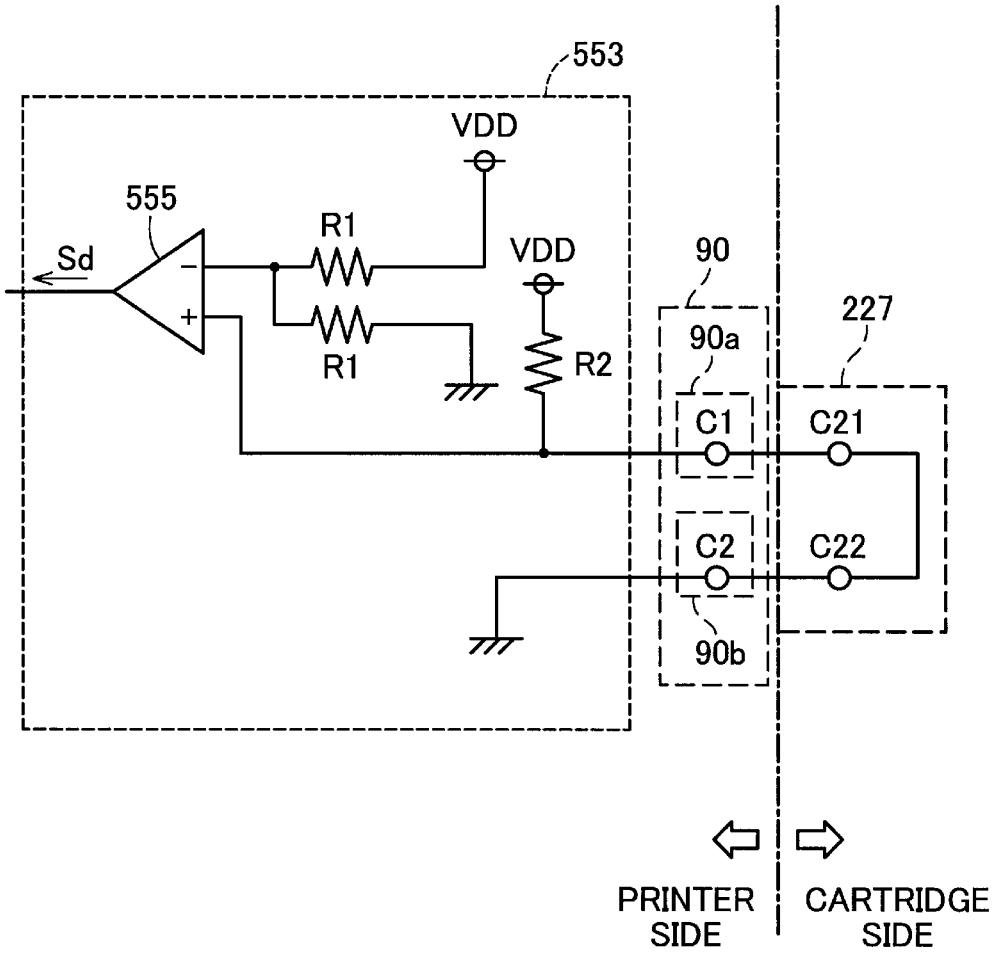
FIG. 22 is a diagram illustrating the electrical connection of a first electrode assembly, a second mounting detection circuit and an electrically conductive portion.

FIG. 22 is a diagram illustrating the electrical connection of the first electrode assembly 90, the second mounting detection circuit 553 and the electrically conductive portion 227.

The second mounting detection circuit 553 includes a comparator 555, two resistances R1, and a pullup resistance R2. The two resistance R1 have an identical resistance value and are connected in series with each other. The two resistances R1 respectively have one ends that are connected with a negative-side input terminal of the comparator 555. The other end of one resistance R1 is connected with the source voltage VDD (rated voltage of 3.3 V) in the sub control circuit 550. The other end of the other resistance R1 is grounded. Accordingly, the voltage of the input terminal of the comparator 555 is always half (1.65 V) the source voltage VDD.

A positive-side input terminal of the comparator 555 is electrically connected with the contact region C1 of the first electrode assembly 90. The second contact region C2 is grounded.

In the non-engaged state, i.e., in the state that the engaged structure 220 (shown in FIGS. 4 and 5) is not engaged with the through hole 620 (shown in FIG. 10), the two electrodes 90*a* and 90*b* constituting the first electrode assembly 90 are not in contact with the electrically conductive portion 227. In this state, the contact region C1 is in the open state, and the positive-side input terminal of the comparator 555 is connected with the source voltage VDD (rated voltage of 3.3 V) via the pullup resistance R2. In this state, the voltage of the positive-side input terminal of the comparator 555 is accordingly the source voltage VDD (rated voltage of 3.3 V). In this state, the voltage of the positive-side input terminal of the comparator 555 is higher than the voltage of the negative-side input terminal, so that the comparator 555 provides an output signal Sd of the H level (source voltage VDD level).

In the engaged state, i.e., in the state that the engaged structure 220 (shown in FIGS. 4 and 5) is engaged with the through hole 620 (shown in FIG. 10), on the other hand, the two electrodes 90*a* and 90*b* constituting the first electrode assembly 90 are in contact with the electrically conductive portion 227. In this state, the contact region C1 of the electrode 90*a* is in contact with the contact region C21 of the electrically conductive portion 227, and the contact region C2 of the electrode 90*b* is in contact with the contact region C22 of the electrically conductive portion 227. Accordingly, the two electrodes 90*a* and 90*b* are electrically connected with each other by the electrically conductive portion 227. The contact region C2 is also grounded. Accordingly, the positive-side input terminal of the comparator 555 is grounded via the electrically conductive route of the first electrode 90*a* (contact region C1), the electrically conductive portion 227 (contact region C21 and contact region C22) and the second electrode 90*b* (contact region C2) and has a voltage of 0 V. In this state, the voltage of the positive-side input terminal of the comparator 555 is lower than the voltage of the negative-side input terminal, so that the comparator 555 provides the output signal Sd of the L level (0 V).

As described above, the output signal Sd output from the comparator 555 has different levels in the engaged state and in the non-engaged state. The engaged state or the non-engaged state is thus identifiable by checking this level. The main control circuit 570 identifies the engaged state or the non-engaged state, based on the level of this output signal Sd. As described above, the connection of the electrically conductive portion 227 with the second mounting detection circuit 553 of the printer 10 enables the printer 10 to detect mounting of the cartridge 20 to the printer 10. Accordingly, the electrically conductive portion 227 serves as the second detector to cause the printer 10 to detect mounting of the cartridge 20 to the printer 10.

The main control circuit 570 determines whether the cartridge 20 is normally mounted, based on the determination result by the first mounting detection circuit 552 and the determination result by the second mounting detection circuit 553. When it is determined that the cartridge 20 is normally mounted, the main control circuit 570 sends a signal corresponding to a printing instruction to the print head 62 to perform printing or more specifically to eject ink. When it is determined that the cartridge 20 is not mounted or that the mounted state of the cartridge 20 is abnormal, on the other hand, the main control circuit 570 causes information indicating, for example, no mounting of the cartridge 20 or the abnormal mounted state to be displayed on the display panel 590. The embodiment uses both the determination result by the first mounting detection circuit 552 and the determination result by the second mounting detection circuit 553 to identify the mounted state of the cartridge 20 more precisely. For example, when the detection by the first mounting detection circuit 552 provides the determination result of "good contact condition" and the detection by the second mounting detection circuit 553 provides the determination result of "engaged state", it is identified that the cartridge 20 is normally mounted. When the detection by the first mounting detection circuit 552 provides the determination result of "good contact condition" and the detection by the second mounting detection circuit 553 provides the determination result of "non-engaged state", it is identified that the cartridge 20 is mounted but the attitude of the cartridge 20 is abnormal or more specifically that the engaged structure 220 is not engaged with the through hole 620. When the detection by the first mounting detection circuit 552 provides the determination result of "poor contact condition" and the detection by the second mounting detection circuit 553 provides the determination result of "engaged state", it is identified that the cartridge 20 is mounted but the attitude of the cartridge 20 is abnormal or more specifically that the cartridge 20 is inclined. When the detection by the first mounting detection circuit 552 provides the determination result of "poor contact condition" and the detection by the second mounting detection circuit 553 provides the determination result of "non-engaged state", it is identified that the cartridge 20 is not mounted.

The above through hole 620 is one example of the engagement structure in the claims. The printer 10 is one example of the liquid ejection apparatus in the claims. The cartridge 20 is one example of the liquid supply unit in the claims. The second engaged structure 220 is one example of the engaged structure or one example of the engagement projection in the claims. The electrically conductive portion 227 is one example of the electrically conductive portion in the claims. The second electrode assembly 70 is one example of the second electrode assembly in the claims. The circuit board 40 is one example of the terminal portion in the claims. The elastic member 648 is one example of the first biasing portion in the claims The cartridge 20 of the first embodiment described above has the second engaged structure 220 that is engaged with the through hole 620 of the holder 61 in the mounted state that the cartridge 20 is mounted to the printer 10. The second engaged structure 220 engages with the through hole 620 in the mounted state to restrict the motion of the cartridge 20 in the +Z direction. The engaged structure 220 of the cartridge 20 is provided with the electrically conductive portion 227. The electrically conductive portion 227 is configured to come into contact with the first electrode 90*a* and the second electrode 90*b* provided on the printer 10 in the engaged state that the second engaged structure 220 is engaged with the through hole 620, so as to provide electrical continuity between the first electrode 90*a* and the second electrode 90*b* and cause the printer 10 to detect mounting of the cartridge 20 to the printer 10. As described above, in the cartridge 20 of the embodiment, the second engaged structure 220 includes the electrically conductive portion 227 that comes into contact with the first electrode 90*a* and the second electrode 90*b* in the engaged state that the second engaged structure 220 is engaged with the through hole 620. This configuration suppresses electrical continuity between the first electrode 90*a* and the second electrode 90*b* from being provided in the non-engaged state that the second engaged structure 220 is not engaged with the through hole 620. This configuration accordingly enables the printer 10 (controller 510) to identify the abnormal mounted state of the cartridge 20 to the printer 10, for example, insufficient mounting of the cartridge 20 to the holder 61.

In the mounted state, the cartridge-side terminal group 400 (terminals 431 to 439) provided on the circuit board 40 of the cartridge 20 come into contact with the second electrode assembly 70 (terminals 731 to 739) provided on the holder 61 to be biased in the +Z direction. This biasing force presses the second engaged structure 220 against the upper inner wall portion 622 of the through hole 620 to more effectively restrict the motion of the cartridge 20 in the +Z direction, i.e., the motion of the cartridge 20 in the dismounting direction.

The liquid supply portion 230 of the cartridge 20 includes the wall 231 provided to be protruded in the −Z direction from the first face 201. In the mounted state, the leading end 235 (−Z direction end face) of the wall 231 comes into contact with the elastic member 648 provided in the holder 61 to be biased in the +Z direction by the elastic member 648. Accordingly, this configuration enhances the effect of restricting the motion of the cartridge 20 in the +Z direction using the second engaged structure 220. The liquid supply portion 230 is provided on the sixth face 206-side of the first face 201 of the cartridge 20, and the circuit board 40 is provided on the fifth face 205-side of the first face 201. In the mounted state, this configuration causes the sixth face 206 side of the first face 201 to be biased in the +Z direction by the elastic member 648 and causes the fifth face 205-side of the first face 201 to be biased in the +Z direction by the second electrode assembly 70 (terminals 731 to 739). This configuration accordingly biases the cartridge 20 in the +Z direction in a balanced manner.

The electrically conductive portion 227 is provided on the second slope face 226 of the second engaged structure 220. In other words, the electrically conductive portion 227 is formed as part of the second engaged structure 220. This configuration achieves downsizing and cost reduction of the printer 10, compared with a configuration that the electrically conductive portion 227 and the second engaged structure 220 are formed from separate members. Additionally, this configuration simultaneously achieves the engagement of the second engaged structure 220 with the through hole 620 and the contact of the electrically conductive portion 227 with the first electrode 90*a* and the second electrode 90*b*. This configuration provides electrical continuity between the first electrode 90*a* and the second electrode 90*b* only in the case where the second engaged structure 220 is engaged with the through hole 620. This configuration thus more reliably identifies the abnormal mounted state of the cartridge 20 to the holder 61.

The first electrode assembly 90 is configured such that the first electrode 90*a* and the second electrode 90*b* come into contact with the second engaged structure 220 only in the engaged state that the electrically conductive portion 227 of the second engaged structure 220 is engaged with the through hole 620. This configuration more reliably identifies the abnormal mounted state of the cartridge 20 to the holder 61.

As shown in FIG. 3, when the cartridge 20 is viewed in the +Z direction from the first face 201-side, the terminals 431, 434, 435 and 439 on the circuit board 40 configured as the first detector are provided on the +X direction side of the liquid supply portion 230, and the electrically conductive portion 227 configured as the second detector is provided on the −X direction side. The configuration that the first detector and the second detector are provided across the liquid supply portion 230 enables the printer 10 (controller 510) to identify the abnormal mounted state of the cartridge 20 to the printer 10, for example, insufficient mounting of the cartridge 20 to the holder 61. The configurations and the positions of the first detector and the second detector are not limited to those described in this embodiment. The requirement is that at least one electrically conductive portion usable for detection of mounting is provided on the +X direction side and at least one electrically conductive portion usable for detection of mounting is provided on the −X direction side of the liquid supply portion 230 when the cartridge 20 is viewed in the +Z direction from the first face 201-side. The first detector and the second detector may be provided on the first face 201. In other words, the first detector and the second detector may have any configurations that enable the printer to detect mounting of the cartridge 20 and are not limited to the configurations and the positions described in this embodiment. The same applies to the first electrode assembly 90 and the second electrode assembly 70 provided on the holder 61.

B. Second Embodiment

A printer of a second embodiment has a basic configuration similar to that of the printer 10 of the first embodiment but includes a cartridge and a holder of different configurations from those of the printer 10 of the first embodiment. Like components in the printer of the second embodiment to those in the printer 10 of the first embodiment are expressed by like reference signs, and their detailed description is omitted.

Figure 23:
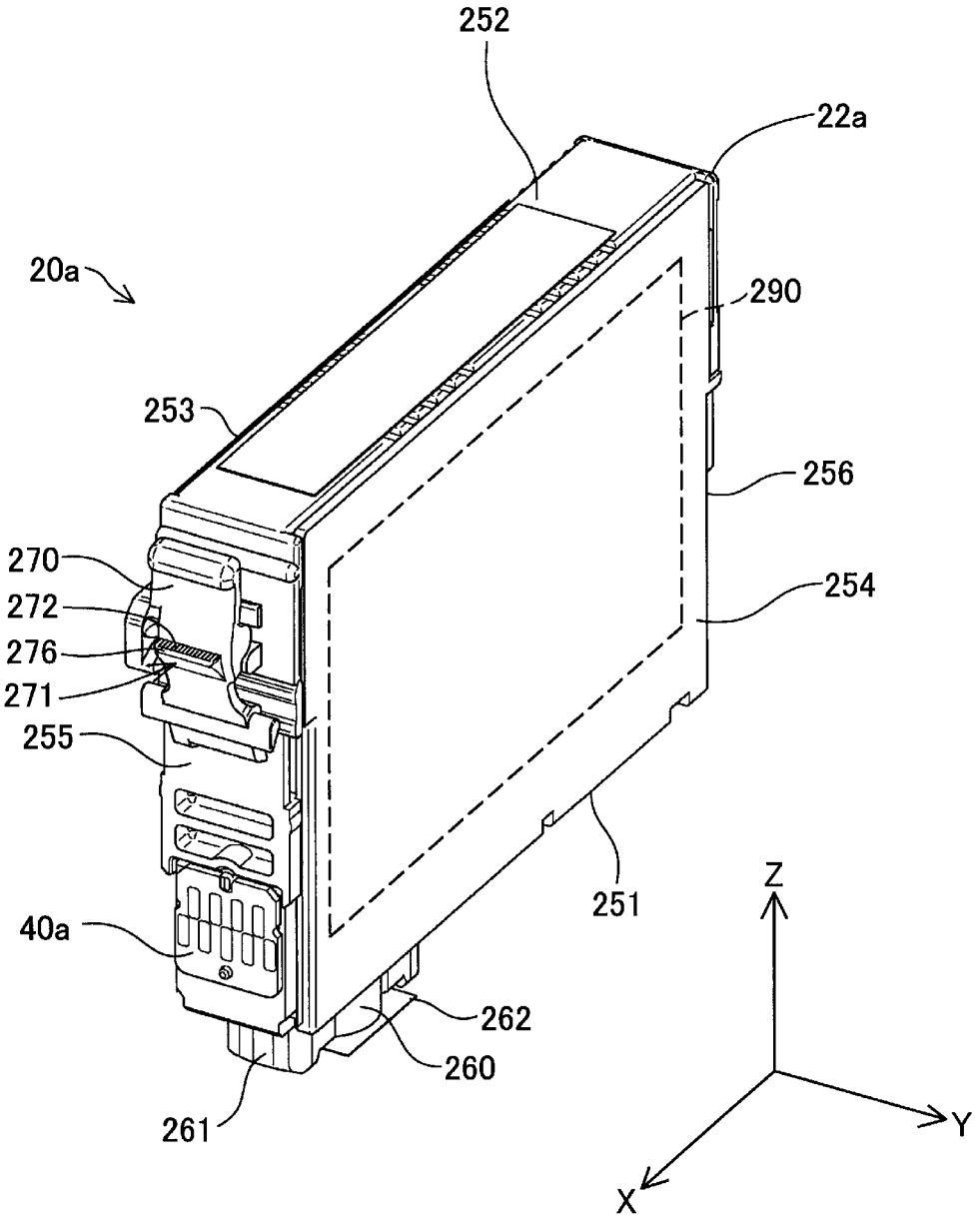
FIG. 23 is a first perspective view illustrating the configuration of a cartridge according to a second embodiment.
Figure 24:
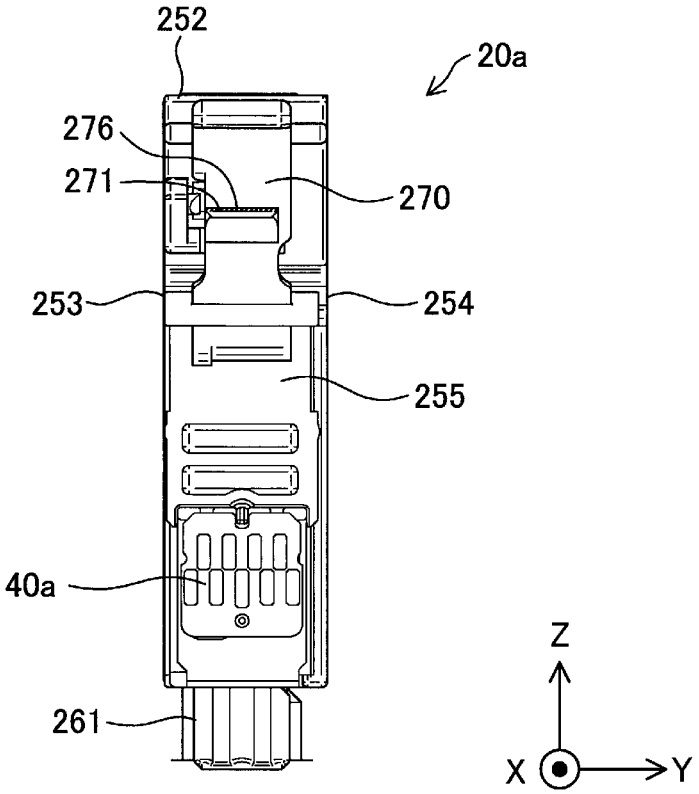
FIG. 24 is a side view illustrating the configuration of the cartridge according to the second embodiment.
Figure 25:
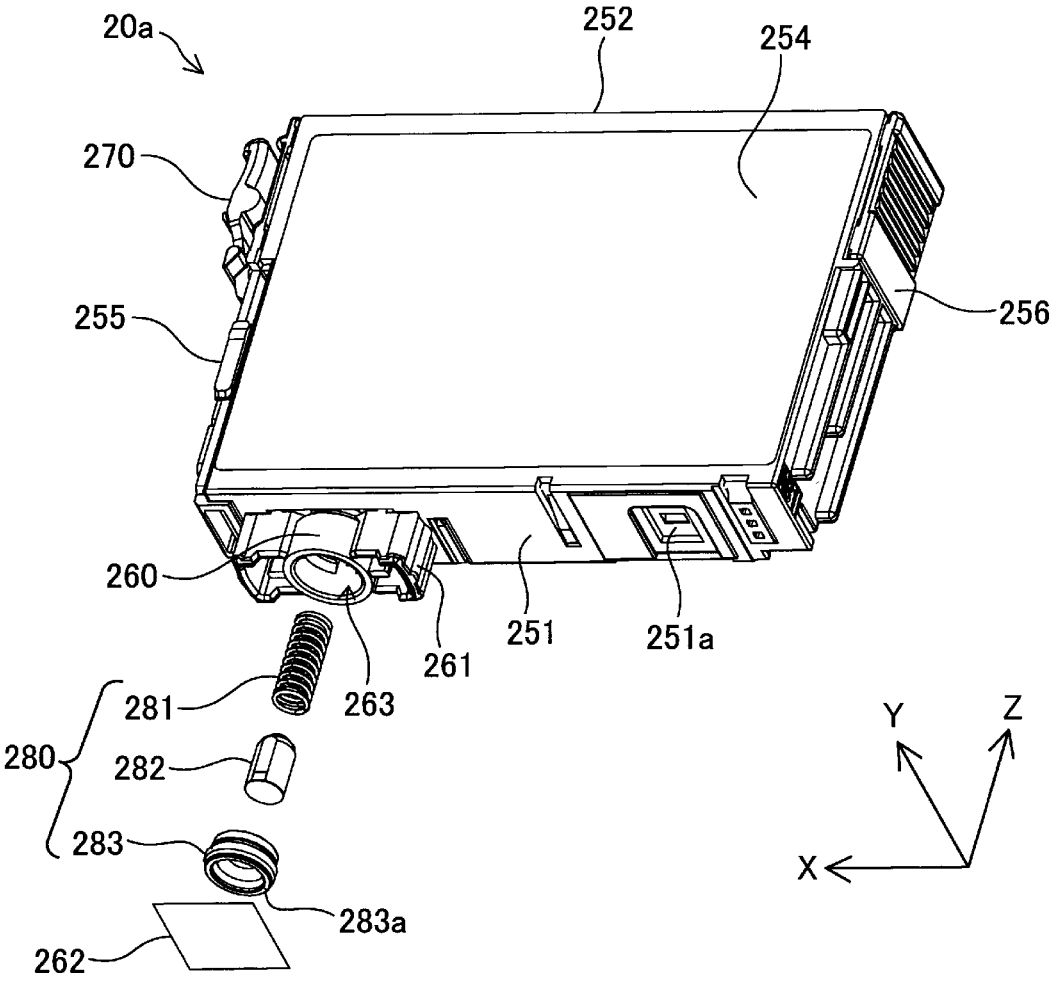
FIG. 25 is a second perspective view illustrating the configuration of the cartridge according to the second embodiment.

FIG. 23 is a first perspective view illustrating the configuration of a cartridge 20*a* according to the second embodiment. FIG. 24 is a side view illustrating the configuration of the cartridge 20*a* according to the second embodiment. FIG. 25 is a second perspective view illustrating the configuration of the cartridge 20*a* according to the second embodiment. The cartridge 20*a* is an open air-type ink cartridge configured such that an ink container portion is continuously open to the ambient air and that the ambient air is introduced with consumption of ink.

The cartridge 20*a* has an approximately rectangular parallelepiped appearance shape. The cartridge 20*a* includes an outer shell 22*a*, a liquid container portion 290, a liquid supply portion 260, a seal portion 261, a lever 270 and a circuit board 40*a*.

The outer shell 22*a* has six faces exposed outside or more specifically has a first face 251, a second face 252, a third face 253, a fourth face 254, a fifth face 255 and a sixth face 256. The positional relationship of the respective faces is similar to the positional relationship of the six faces 201 to 206 in the printer 10 of the first embodiment, and its detailed description is omitted. Unlike the first face 201 of the first embodiment, however, no slope face portion is formed on a +X direction end of the first face 251.

The liquid container portion 290 is formed inside of the outer shell 22*a*. The liquid supply portion 260 is provided on the first face 251. Ink contained in the liquid container portion 290 is supplied to a head unit via the liquid supply portion 260 and an ink intake needle 110 (shown in FIG. 26 and FIG. 29) provided in a holder 61*a* described later. As shown in FIG. 25, the liquid supply portion 260 has a cylindrical appearance shape and has a receiving hole 263 that is extended in the Z-axis direction. The receiving hole 263 is formed as a bottomed hole that has a closed +Z direction end and an open −Z direction end. As shown in FIG. 25, a valve 280 is placed inside of the receiving hole 263. A tubular portion with an ink supply path 285 formed therein as described later is also placed inside of the receiving hole 263. The ink supply path 285 has one end that communicates with the liquid container portion 290 and the other end that communicates with an ink flow path formed inside of the ink intake needle 110 described later in the state that the cartridge 20*a* is mounted to the holder 61*a*.

As shown in FIG. 25, the valve 280 includes a seal member 283, a spring seat 282 and a spring 281 that are provided sequentially from the side near to an opening at a −Z direction end (ink supply port) of the liquid supply portion 260. The seal member 283 seals not to make a gap between an inner wall of the liquid supply portion 260 and an outer wall of the ink intake needle 110 when the ink intake needle 110 of the holder 61*a* described later is inserted in the liquid supply portion 260. The spring seat 282 abuts on the seal member 283 to close an ink flow path in the liquid supply portion 260 when the cartridge 20*a* is not mounted to the holder 61*a* described later. The spring 281 is a coil spring and biases the spring seat 282 in a direction to abut on the seal member 283. When the ink intake needle 110 described later is inserted into the liquid supply portion 260, the ink intake needle 110 pushes the spring seat 282 up to make a gap between the spring seat 282 and the seal member 283 and cause ink to be supplied from this gap into the ink intake needle 110. An end 283*a* on an ink supply port side of the seal member 283 is in a circular shape in planar view. Before the cartridge 20*a* is mounted to the holder 61*a* described later, the ink supply port of the liquid supply portion 260 is sealed by the seal member 262. The seal member 262 is configured by a thin film made of a resin and is bonded to an end face of the ink supply port of the liquid supply portion 260. The seal member 262 is broken by the ink intake needle 110 in the course of mounting.

As shown in FIGS. 23 to 25, the seal portion 261 is provided around the liquid supply portion 260 to suppress leakage of ink to outside. The seal portion 261 is protruded in the −Z direction from the first face 251 to come into contact with an inner bottom face (wall portion 104) of the holder 61*a* described later in the mounted state.

As shown in FIG. 23 and FIG. 25, the circuit board 40*a* is provided on the fifth face 255. The circuit board 40*a* is placed at a different position from that of the circuit board 40 of the first embodiment but otherwise has a similar configuration including functions to that of the circuit board 40 of the first embodiment. Like the first embodiment, mounting detection terminals are provided on the circuit board 40*a* to detect mounting of the cartridge. Among nine terminals provided on the circuit board 40*a*, four terminals serve as the first detector to cause the printer to detect mounting of the cartridge 20*a* to the printer.

As shown in FIGS. 23 to 25, the lever 270 is provided on the fifth face 255. The lever 270 has a thin plate-like appearance shape and is joined with the fifth face 255 to be protruded in the +X direction and in the +Z direction from the fifth face 255. As shown in FIG. 23 and FIG. 24, the lever 270 includes an engaged structure 271 that is placed at an approximate center to be protruded in the +X direction. The engaged structure 271 is engaged with an engagement structure 130 (shown in FIG. 29) of the holder 61*a* described later to restrict the motion of the cartridge 20*a* in the Z-axis direction. In the process of dismounting the cartridge 20*a* from the holder 61*a*, the user operates the lever 270 to be close to the fifth face 255 and thereby disengage the engaged structure 271 from the engagement structure 130 of the holder 61*a* described later. The engaged structure 271 includes an electrically conductive portion 272 that is arranged to face in the +Z direction. Like the electrically conductive portion 272 provided on the second engaged structure 220 of the first embodiment, the electrically conductive portion 272 is a metal layer provided on a face 276 of the engaged structure 271 that faces in the +Z direction. The electrically conductive portion 272 may be formed from a similar material by a similar method to those of the electrically conductive portion 227 of the first embodiment. The electrically conductive portion 227 has similar functions to those of the electrically conductive portion 227 of the first embodiment. More specifically, when the cartridge 20*a* is mounted to the holder 61*a* (shown in FIG. 29) described later, the electrically conductive portion 272 comes into contact with two electrodes C31 and C32 provided on the holder 61*a* (shown in FIG. 27) to provide electrical continuity between the two electrodes C31 and C32. The printer detects that the cartridge 20*a* is mounted to the holder 61*a* of the printer by the electrical continuity between these electrodes C31 and C32. Accordingly, the electrically conductive portion 227 serves as the second detector to cause the printer to detect mounting of the cartridge 20*a* to the printer.

According to the embodiment, the engaged structure 271 is configured by a projection that is elongated in the Y-axis direction and includes the electrically conductive portion 272 that is formed on the face 276 at the leading end thereof that faces in the +Z direction, to be elongated in the Y-axis direction. The shape and the location of the electrically conductive portion 272 are, however, not limited to the configuration of the embodiment. The electrically conductive portion 272 may be formed in any shape and may be provided at any location as long as the electrically conductive portion 272 serve to provide electrical continuity between the first electrode C31 and the second electrode C32.

Figure 26:
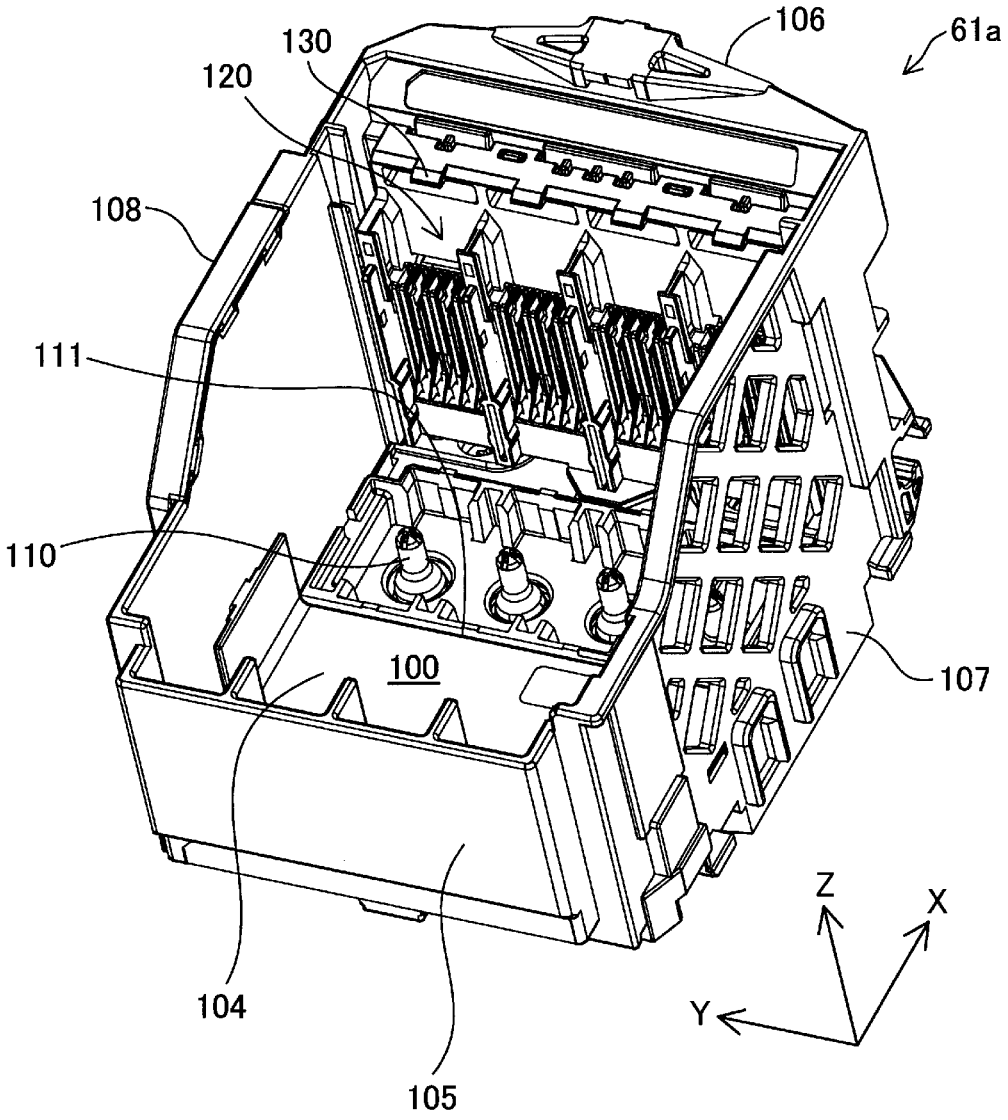
FIG. 26 is a perspective view illustrating the configuration of a holder according to the second embodiment.

FIG. 26 is a perspective view illustrating the configuration of the holder 61*a* according to the second embodiment. The holder 61*a* of the second embodiment is configured to place four cartridges 20*a* therein, unlike the holder 61 of the first embodiment. The holder 61*a* includes a wall portion 104, two wall portions 105 and 106 that are respectively arranged perpendicular to the wall portion 104 and that are opposed to each other, and two wall portions 107 and 108 that are respectively arranged perpendicular to the three wall portions 104 to 106 and that are opposed to each other, and has a box-like appearance shape that is open in the +Z direction (vertically upward). The wall portion 104 corresponds to an inner bottom of the holder 61*a*. The wall portion 105 is arranged at a −X direction end of the holder 61*a*, and the wall portion 106 is arranged at a +X direction end of the holder 61*a*. The wall portion 107 is arranged at a −Y direction end of the holder 61*a*, and the wall portion 108 is arranged at a +Y direction end of the holder 61*a*. These five wall portions 104 to 108 are arranged to form a cartridge chamber 100.

The cartridge chamber 100 includes four slots that are formed to be arrayed in the Y-axis direction. Each slot is provided with the engagement structure 130, a second electrode assembly 120 and the ink intake needle 110. The engagement structure 130 is placed near to a +Z direction end of an inner face of the wall portion 106. The engagement structure 130 is engaged with the engaged structure 271 of the cartridge 20*a* in the state that the cartridge 20*a* is normally mounted to the holder 61*a*. According to the embodiment, the state that the engagement structure 130 and the engaged structure 271 are engaged with each other is called engaged state.

Figure 27:
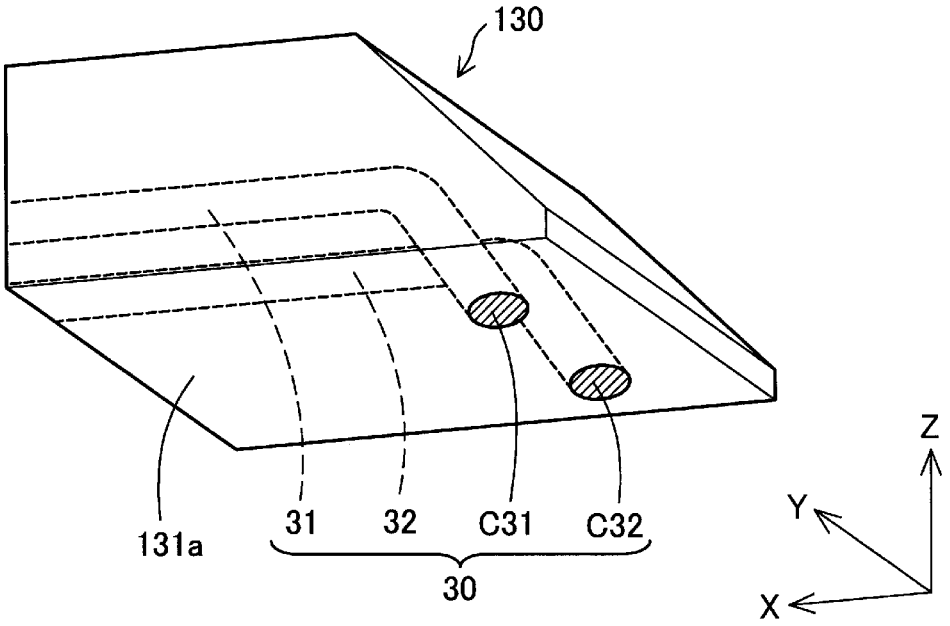
FIG. 27 is a perspective view illustrating the detailed configuration of an engagement structure.

FIG. 27 is a perspective view illustrating the detailed configuration of the engagement structure 130. The engagement structure 130 is formed in a shape protruded in the −X direction. The engagement structure 130 is provided with a first electrode assembly 30. The first electrode assembly 30 plays a similar role to that of the first electrode assembly 90 of the first embodiment. According to the embodiment, the first electrode assembly 30 includes wirings 31 and 32 provided inside of the engagement structure 130 and the electrodes C31 and C32. The two electrodes (first electrode C31 and second electrode C32) are formed on a −Z direction face (bottom face) 131*a* of the engagement structure 130. The two electrodes C31 and C32 are placed near to a −X direction end of the bottom face 131*a* to be arrayed parallel to the Y-axis direction. Both the two electrodes C31 and C32 are formed in an approximately circular shape in planar view. The first electrode C31 is electrically connected with the second mounting detection circuit 553 via the wiring 31 placed inside of the engagement structure 130. Similarly, the second electrode C32 is electrically connected with the second mounting detection circuit 553 via the wiring 32 placed inside of the engagement structure 130. These two electrode C31 and C32 play a similar role to that of the two contact regions C1 and C2 of the first embodiment.

The second electrode assembly 120 shown in FIG. 26 plays a similar role to that of the second electrode assembly 70 of the first embodiment. The second electrode assembly 120 is placed near to a −Z direction end of the inner face of the wall portion 106. The ink intake needle 110 is placed at a position on the wall portion 104 that is nearer to the wall portion 106 than the wall portion 105. The ink intake needle 110 has a circular appearance shape that is extended in the +Z direction from the wall portion 104 and has a +Z direction end that is formed to be tapered. An ink flow path is formed inside of the ink intake needle 110. An opening that corresponds to an end of this ink flow path and that receives ink supplied from the cartridge 20*a* is provided at the +Z direction end of the ink intake needle 110. The ink intake needle 110 is placed inside of a recess that is formed in the wall portion 104 in the −Z direction. Among wall portions arranged to form this recess, a wall portion 111 at a −X direction end comes into contact with a +X direction end of the seal portion 261 in the mounted state.

Figure 28:
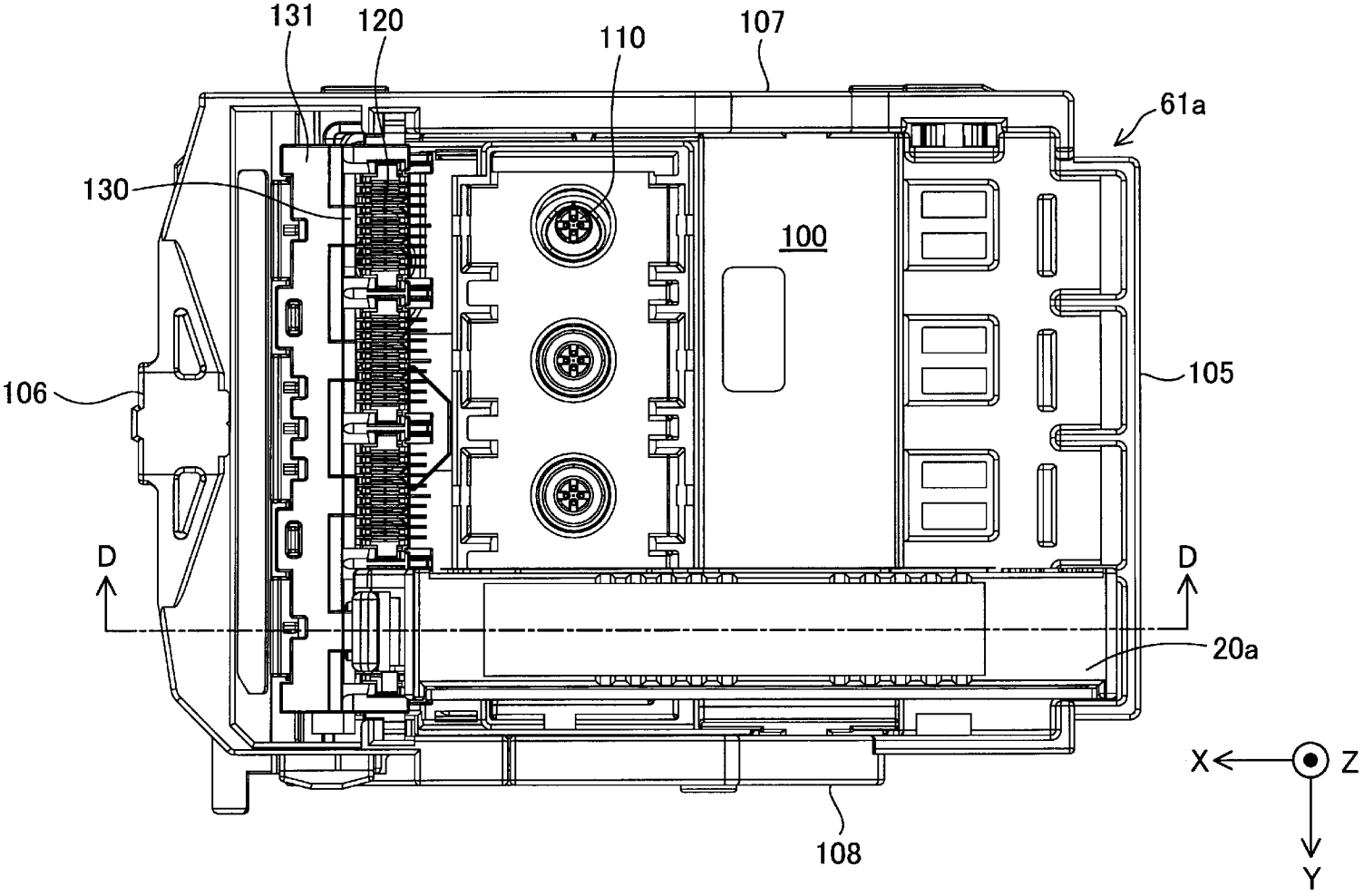
FIG. 28 is a plan view illustrating the configuration of the cartridge and the holder in the mounted state.
Figure 29:
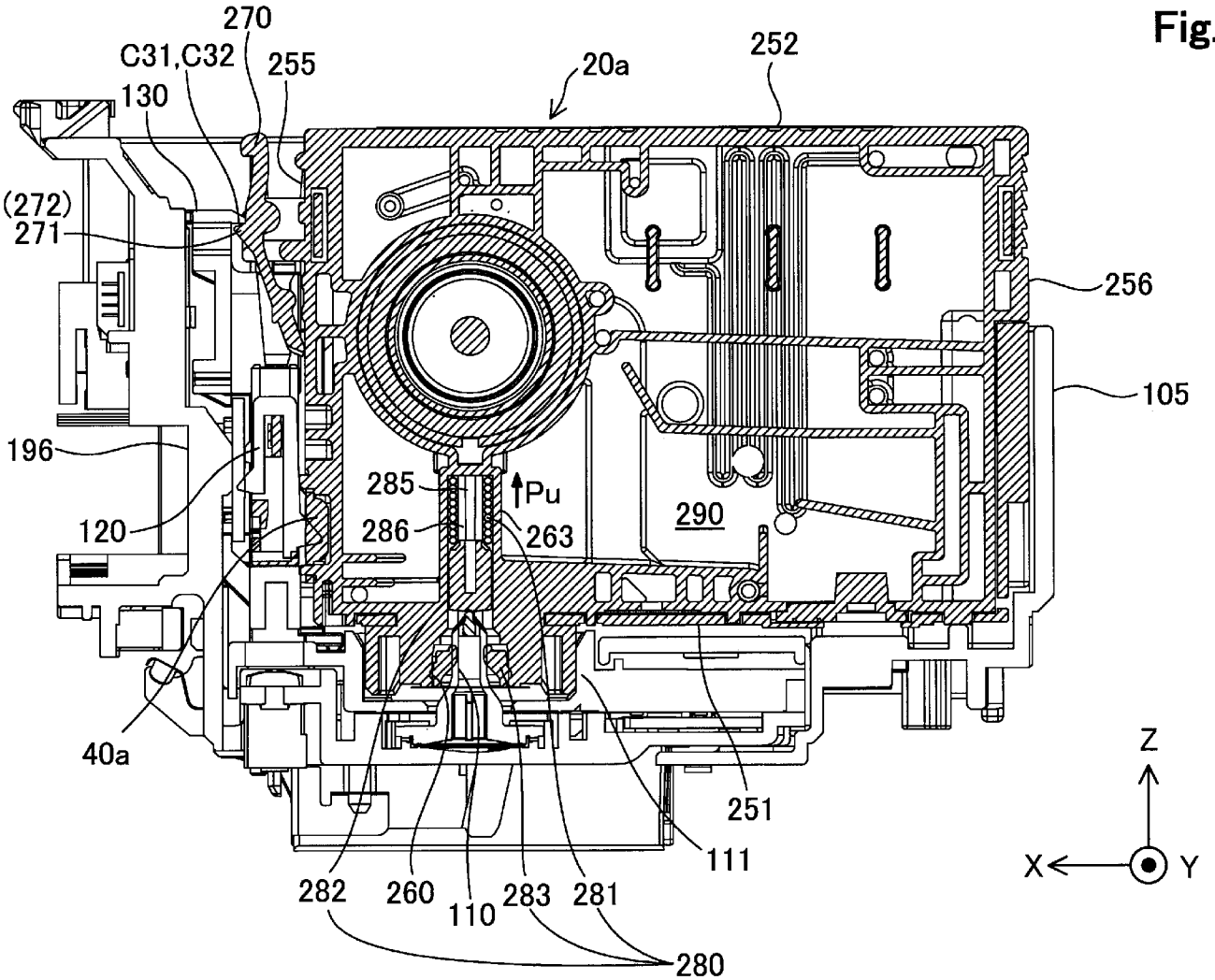
FIG. 29 is a sectional view illustrating the configuration of the cartridge and the holder in the mounted state.

FIG. 28 is a plan view illustrating the configuration of the cartridge 20*a* and the holder 61*a* in the mounted state. FIG. 29 is a sectional view illustrating the configuration of the cartridge 20*a* and the holder 61*a* in the mounted state. FIG. 28 is the plan view of the cartridge 20*a* and the holder 61*a* viewed in the −Z direction. FIG. 29 illustrates a D-D section shown in FIG. 28. The D-D section is a section at a plane that is parallel to an X-Z plane and that passes through the center in the width direction (Y-axis direction) of the cartridge 20*a* that is mounted to a leftmost slot viewed in the +X direction among the respective slots of the holder 61*a*.

As shown in FIG. 29, in the mounted state, the terminals provided on the circuit board 40*a* come into contact with terminals of the second electrode assembly 120. In the mounted state, the engaged structure 271 is engaged with the engagement structure 130. in this state, the two electrodes C31 and C32 of the engagement structure 130 come into contact with the electrically conductive portion 272. This provides electrical continuity between these two electrodes C31 and C32. Accordingly, like the first embodiment, the printer can detect mounting of the cartridge 20*a* to the holder 61*a* of the printer by the first mounting detection circuit and the second mounting detection circuit and also identifies whether the mounted state is normal or not.

As shown in FIG. 29, in the mounted state, the ink intake needle 110 is inserted into the receiving hole 263 to press the spring seat 282 in the +Z direction. The spring seat 282 accordingly presses the spring 281 in the +Z direction. The spring 281 presses back the spring seat 282 in the direction abutting on the seal member 283 (in the −Z direction), while pressing a +Z direction end face of the receiving hole 263 in the +Z direction. The +Z direction end face of the receiving hole 263 is a lower face on the boundary between the liquid container portion 290 and the receiving hole 263. Accordingly, the spring 281 generates a biasing force Pu in the +Z direction by the actions of the ink intake needle 110 and the valve 280. The cartridge 20*a* is biased in the +Z direction by this pressing force Pu. In the engaged state that the engaged structure 271 provided on the lever 270 is engaged with the engagement structure 130 of the holder 61*a*, the engagement structure 130 of the holder 61*a* restricts the motion of the cartridge 20*a* in the +Z direction against this biasing force Pu. The electrically conductive portion 272 of the engages structure 271 accordingly receives a force of repulsion against the biasing force Pu from the engagement structure 130 of the holder 61*a*. The electrically conductive portion 272 is thus pressed against the bottom face 131*a* of the engagement structure 130 provided with the two electrodes C31 and C32 by the biasing force Pu. This restricts the motion of the cartridge 20*a* in the +Z direction and causes the two electrodes C31 and C32 to more reliably come into contact with the electrically conductive portion 272 provided on the engaged structure 271.

As shown in FIG. 29, the spring 281 is arranged to surround a tubular portion 286 placed in the receiving hole 263. In the mounted state, the ink supply path 285 formed at the center inside of the turublar portion 286 communicates with the ink flow path formed inside of the ink intake needle 110 via a groove formed in a side face of the spring seat 282.

The above first electrode assembly 30 is one example of the first electrode assembly in the claims. The engagement structure 130 is one example of the engagement structure in the claims. The cartridge 20*a* is one example of the liquid supply unit in the claims. The engaged structure 271 is one example of the engaged structure in the claims. The electrically conductive portion 272 is one example of the electrically conductive portion in the claims. The circuit board 40*a* is one example of the second electrode assembly in the claims. The electrode electrode assembly 120 is one example of the terminal portion in the claims. The ink intake needle 110 is one example of the liquid intake needle in the claims.

The cartridge 20*a* of the second embodiment described above includes the engaged structure 271 that is engaged with the engagement structure 130 of the holder 61*a* in the mounted state that the cartridge 20*a* is mounted to the printer. The engaged structure 271 is engaged with the engagement structure 130 in the mounted state to restrict the motion of the cartridge 20*a* in the +Z direction. The engaged structure 271 of the cartridge 20*a* is provided with the electrically conductive portion 272. The electrically conductive portion 272 is configured to come into contact with the first electrode C31 and the second electrode C32 provided on the printer in the engaged state that the engaged structure 271 and the engagement structure 130 are engaged with each other, so as to provide electrical continuity between the first electrode C31 and the second electrode C32 and cause the printer to detect mounting of the cartridge 20*a* to the printer. As described above, in the cartridge 20*a* of the embodiment, the engaged structure 271 includes the electrically conductive portion 272 that comes into contact with the first electrode C31 and the second electrode C32 in the engaged state that the engaged structure 271 and the engagement structure 130 are engaged with each other. This configuration suppresses electrical continuity between the first electrode C31 and the second electrode C32 from being provided in the non-engaged state that the engaged structure 271 is not engaged with the engagement structure 130. This configuration accordingly enables the printer to identify the abnormal mounted state of the cartridge 20*a* to the printer, for example, insufficient mounting of the cartridge 20*a* to the holder 61*a*.

In the mounted state, the cartridge 20*a* is biased in the +Z direction by the biasing force Pu that is generated by the spring 281 by the actions of the ink intake needle 110 and the valve 280. The engaged structure 271 is pressed against the bottom face 130*a* of the engagement structure 130 by this biasing force Pu. Accordingly, this configuration enhances the effect of restricting the motion of the cartridge 20*a* in the +Z direction, i.e., the motion of the cartridge 20*a* in the dismounting direction, using the engaged structure 271.

The electrically conductive portion 272 is provided on the face 276 of the engaged structure 271 that faces in the +Z direction. In other words, the electrically conductive portion 272 is formed as part of the lever 270 that is provided with the engaged structure 271. This configuration achieves downsizing and cost reduction of the printer, compared with a configuration that the electrically conductive portion 272 and the engaged structure 271 are formed from separate members. Additionally, this configuration simultaneously achieves the engagement of the engaged structure 271 of the lever 270 with the engagement structure 130 and the contact of the electrically conductive portion 272 with the first electrode C31 and the second electrode C32. This configuration provides electrical continuity between the first electrode C31 and the second electrode C32 only in the case where the engaged structure 271 of the lever 270 is engaged with the engagement structure 130. This configuration thus more reliably identifies the abnormal mounted state of the cartridge 20*a* to the printer.

Furthermore, the first electrode assembly 30 is formed in the engagement structure 130 of the holder 61*a* or more specifically formed integrally with the holder 61*a*. This configuration achieves downsizing of the holder 61*a* and thereby downsizing of the printer.

According to the second embodiment, both the lever 270 provided with the electrically conductive portion and the circuit board 40*a* provided with the cartridge-side terminal group are provided on the fifth face 255 of the cartridge 20*a*. According to a modification, one of the lever 270 and the circuit board 40*a* may be provided on the sixth face 256, and the engagement structure 130 on the holder 61*a*, the first electrode assembly 30 and the second electrode assembly 120 may be provided at corresponding positions. Like the first embodiment, arrangement of the lever 270 and the circuit board 40*a* in this modified positional relationship causes the first detector (the four mounting detection terminals provided on the circuit board 40*a*) and the second detector (the electrically conductive portion 272 provided on the engaged structure 271 of the lever 270) to be provided across the liquid supply portion 260 when the cartridge 20*a* is viewed in the +Z direction from the first face 251-side. The first detector and the second detector may be provided on the first face 251. In other words, the first detector and the second detector may have any configurations that enable the printer to detect mounting of the cartridge 20*a* and are not limited to the configurations and the positions described in this embodiment. The same applies to the first electrode assembly 30 and the second electrode assembly 120 provided on the holder 61*a*.

C. Third Embodiment

C1. Configuration of Apparatus

Figure 30:
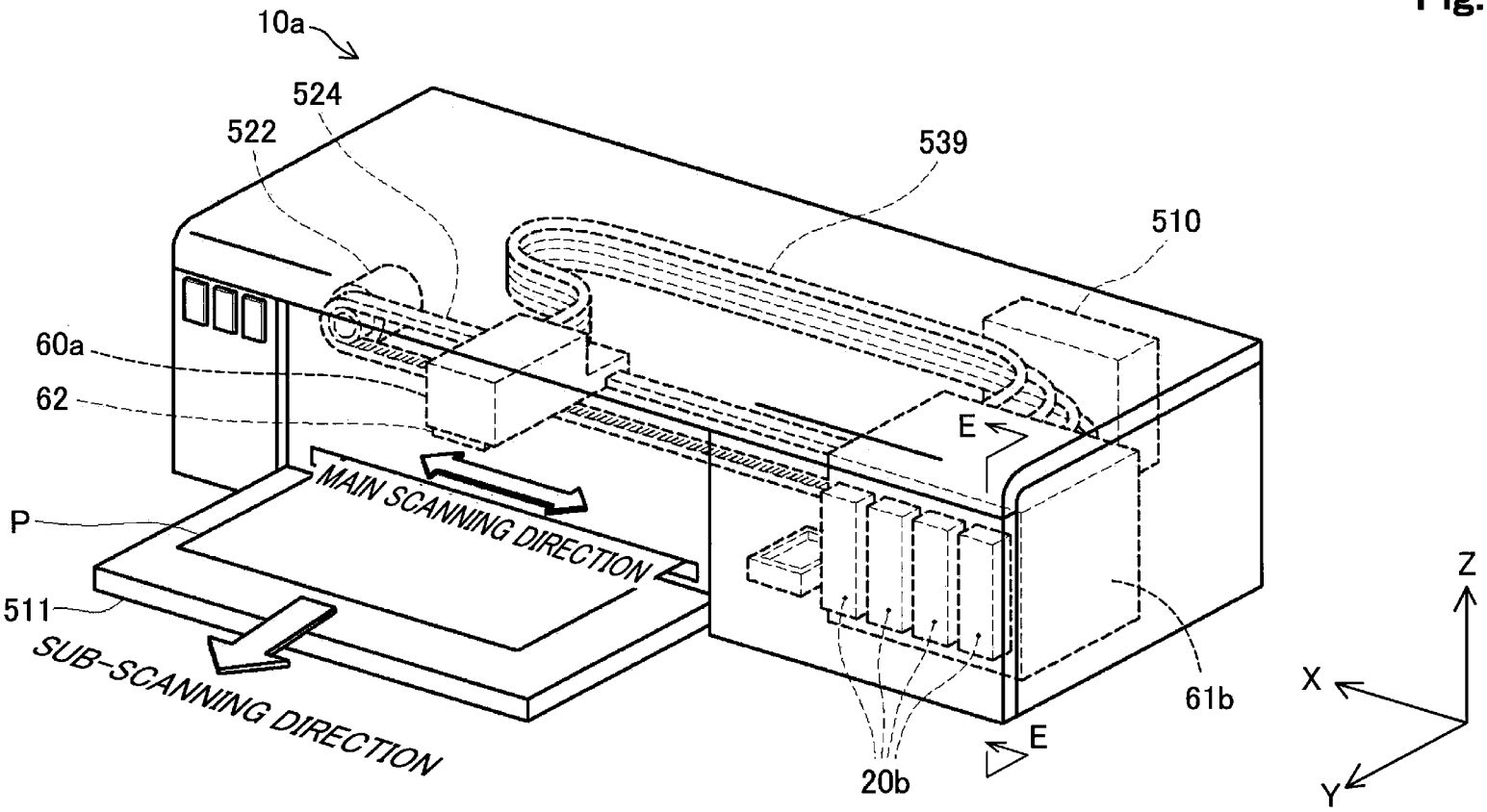
FIG. 30 is a perspective view illustrating the schematic configuration of a printer equipped with ink cartridges as an application of the liquid supply unit according to a third embodiment of the present disclosure.

FIG. 30 is a perspective view illustrating the schematic configuration of a printer equipped with ink cartridges as an application of the liquid supply unit according to a third embodiment of the present disclosure.

A printer 10*a* of the third embodiment is an off-carriage type printer. Like components in the printer 10*a* to those of the printer 10 of the first embodiment are expressed by like reference signs, and their detailed description is omitted. Part of the components, for example, the feed rod 529 and the platen 534 shown in FIG. 1 are omitted from the illustration of FIG. 30.

The printer 10*a* includes a holder 61*b* and a head unit 60*a*. The head unit 60*a* differs from the carriage 60 of the first embodiment by that the head unit 60*a* is not provided with the holder 61 and is connected with tubes 539 described later. According to the third embodiment, the holder 61*b* is not mounted on the head unit 60*a* but is provided at a position different from the head unit 60*a* in the housing of the printer 10*a*. The holder 61*b* and the head unit 60*a* are connected with each other by a plurality of tubes 539 that are provided for respective ink colors. Ink contained in a cartridge 20*b* is sucked by a non-illustrated pump mechanism provided in the printer 10*a* to be supplied to the head unit 60*a*. The holder 61*b* is configured to mount four cartridge 20*b* thereto.

Figure 31:
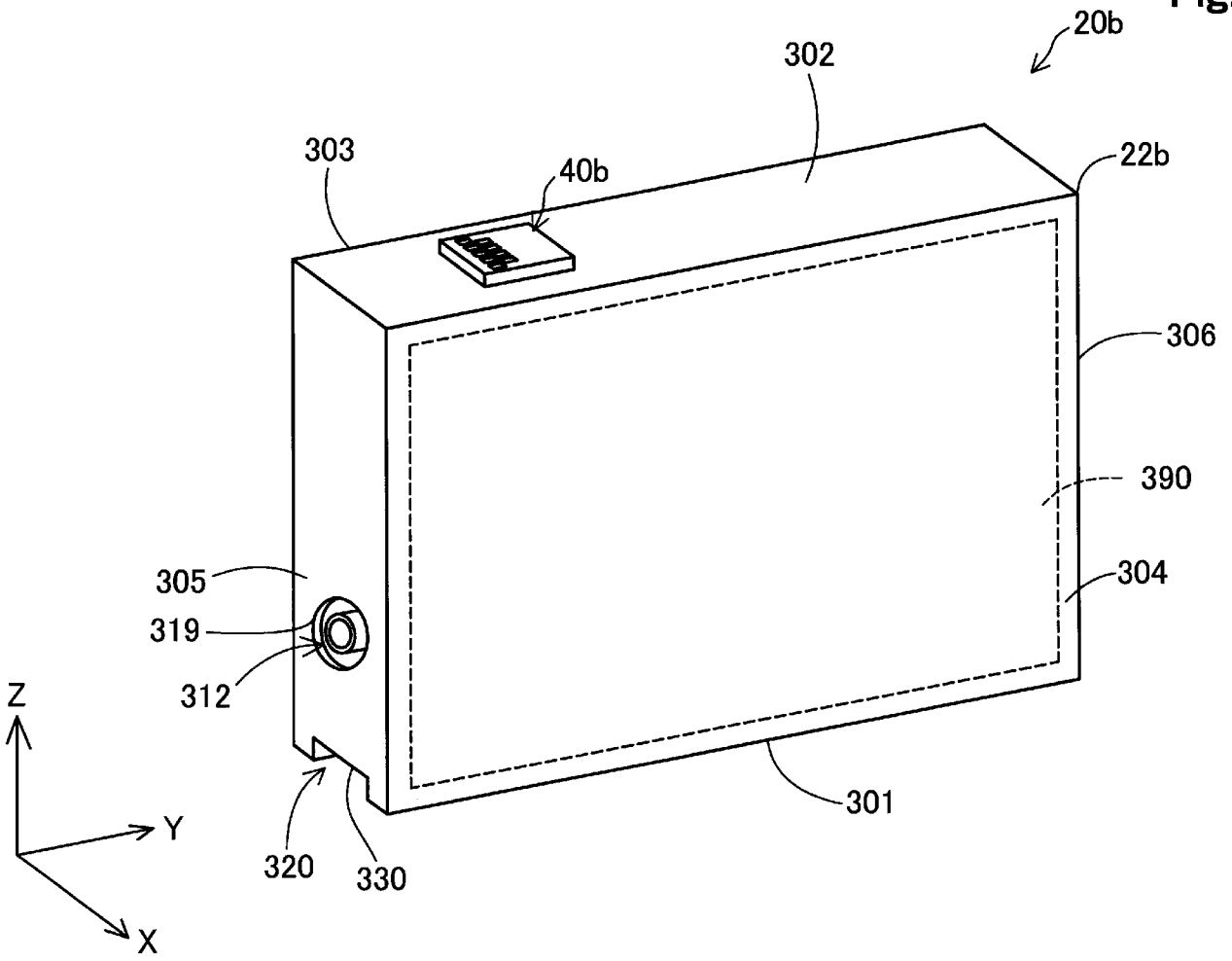
FIG. 31 is an appearance perspective view illustrating a cartridge according to the third embodiment.

FIG. 31 is an appearance perspective view illustrating the cartridge 20*b* according to the third embodiment. The cartridge 20*b* has an approximately rectangular parallelepiped appearance shape. The cartridge 20*b* includes an outer shell 22*b*, a liquid container portion 390, a liquid supply portion 312, and a circuit board 40*b*. The cartridge 20*b* is a sealed type ink cartridge configured such that an ink container portion is sealed from the ambient air. In the sealed type ink cartridge 20*b*, the liquid container portion 390 is generally configured by an ink bag provided in a case that forms the outer shell 22*b*. The sealed type ink cartridge may, however, have various known configurations other than the configuration of the case and the ink bag. The ink cartridge 20*b* of this embodiment may have any of such known configurations.

The outer shell 22*b* has six faces exposed outside or more specifically has a first face 301, a second face 302, a third face 303, a fourth face 304, a fifth face 305 and a sixth face 306. The positional relationship of the respective faces is similar to the positional relationship of the six faces 201 to 206 in the printer 10 of the second embodiment. Unlike the first embodiment and the second embodiment, the liquid supply portion 312 is provided on the fifth face 305. The mounting direction of the cartridge 20*b* to the holder 61*b* is the −Y direction, and the dismounting direction of the cartridge 20*b* from the holder 61*b* is the +Y direction. The circuit board 40*b* is provided on the second face 302, and an engaged structure 344 described later is provided on the first face 301.

The liquid container portion 390 is provided inside of the outer shell 22*b*. As described above, in the seal type cartridge 20*b*, the liquid container portion 390 is generally configured by an ink bag to contain ink therein. The liquid supply portion 312 is a tubular member. The fifth face 305 has an opening 319 that is provided such that one end (−Y direction end) of the liquid supply portion 312 is exposed on the fifth face 305 via the opening 319. Accordingly, the ink supply portion 312 is provided on the fifth face 305. The other end (+Z direction end) of the liquid supply portion 312 communicates with the ink container portion 390. In the mounted state that the cartridge 20*b* is mounted to the holder 61*b* of the printer 10*a*, an ink intake needle 160 provided on the holder 61*b* as described later is inserted into the liquid supply portion 312. Ink contained in the liquid container portion 390 is supplied through the liquid supply portion 312, the ink intake needle 160 provided on the holder 61*b*, and the tube 549 to the head unit 60*a*. The liquid supply portion 312 has an axis that is parallel to the Y-axis direction.

The circuit board 40*b* is provided on the second face 302. The circuit board 40*b* is placed at a different position from that of the circuit board 40 of the first embodiment but otherwise has a similar configuration including functions to that of the circuit board 40 of the first embodiment. Like the first embodiment, mounting detection terminals are provided on the circuit board 40*b* to detect mounting of the cartridge. Among nine terminals provided on the circuit board 40*b*, four terminals serve as the first detector to cause the printer 10*a* to detect mounting of the cartridge 20*b* to the printer 10*a*.

An engaging structure 320 is formed on the first face 301 at a position adjacent to the fifth face 305. The detailed configuration of the engaging structure 320 will be described later with reference to FIG. 34. The following describes the general configuration of the engaging structure 320 and the configuration and the functions of the engaged structure 344 with reference to FIG. 34. The engaging structure 320 includes a loop-shaped guide groove 340 and the engaged structure 344 provided in the middle of the loop of the guide groove 340. The guide groove 340 guides an engagement structure 184 provided on a leading end of a rod-like member 180 (shown in FIG. 33 and FIG. 36) of the holder 61*b* described later in the process of mounting the cartridge 20*b* to the holder 61*b* and in the process of dismounting the cartridge 20*b* from the holder 61*b*. In the mounted state that the cartridge 20*b* is mounted to the holder 61*b*, the engaged structure 344 is engaged with the engagement structure 184 to lock the engagement structure 184 and thereby restrict the motion of the cartridge 20*b* in the +Y direction.

Figure 33:
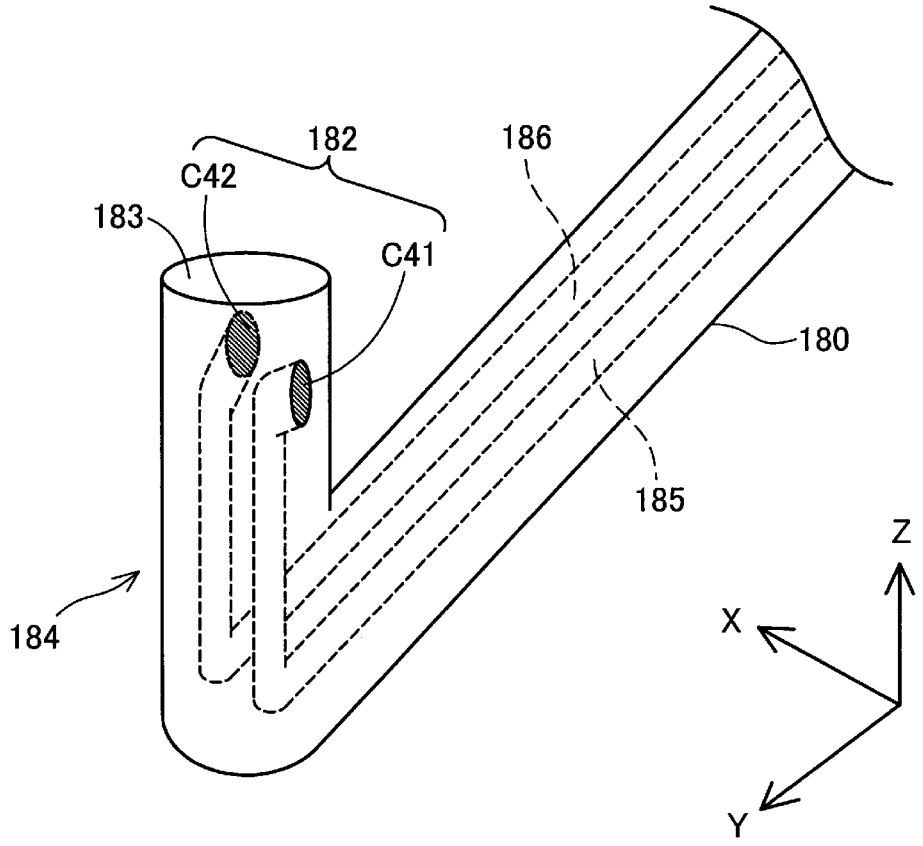
FIG. 33 is a perspective view illustrating the detailed configuration of a rod-like member.
Figure 34:
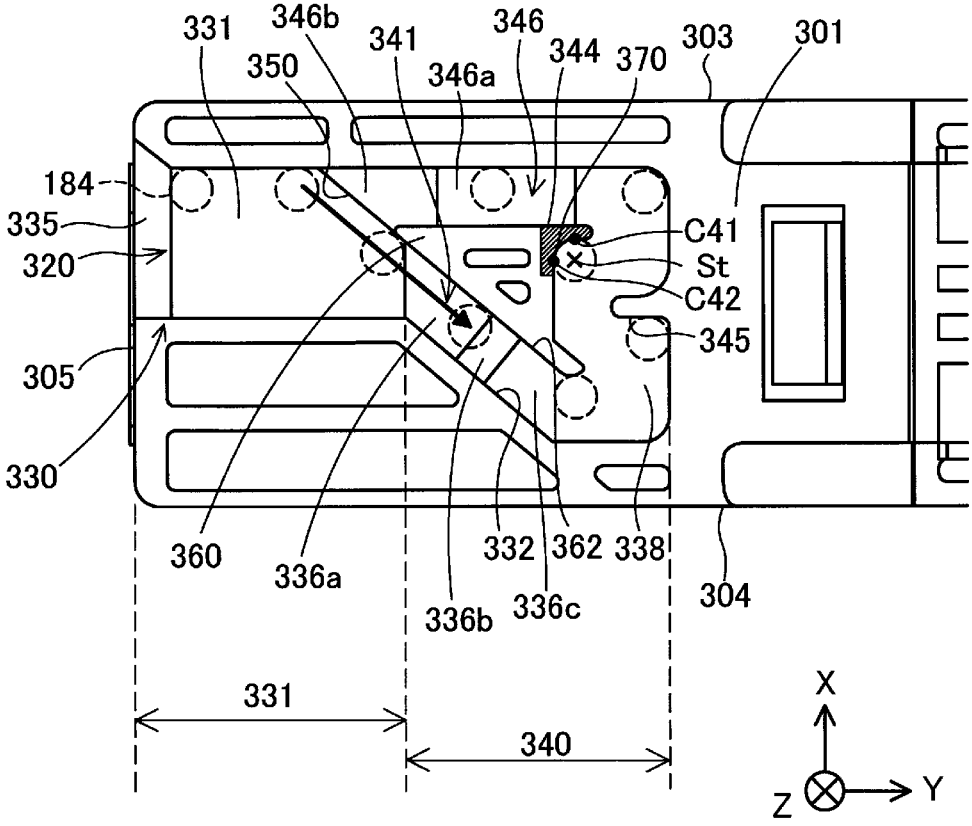
FIG. 34 is a plan view illustrating the detailed configuration of an engaging structure.

As shown in FIG. 34, the engaged structure 344 includes an electrically conductive portion 370. Like the electrically conductive portion 227 provided on the second engaged structure 220 of the first embodiment, the electrically conductive portion 370 is a metal layer provided on the engaged structure 344. According to the embodiment, the electrically conductive portion 370 is provided on a face of an island portion 360 near to the engaged structure 344 as described later. The electrically conductive portion 370 may be formed from a similar material by a similar method to those of the electrically conductive portion 227 of the first embodiment. The electrically conductive portion 370 has similar functions to those of the electrically conductive portion 227 of the first embodiment. More specifically, when the cartridge 20*b* is mounted to the holder 61*b* described later, the electrically conductive portion 370 comes into contact with two electrodes C41 and C42 (shown in FIG. 33) provided on the rod-like member 180 in the holder 61*b* to provide electrical continuity between the two electrodes C41 and C42. The printer 10*a* detects that the cartridge 20*b* is mounted to the holder 61*b* of the printer 10*a* by the electrical continuity between these electrodes C41 and C42. Accordingly, the electrically conductive portion 370 serves as the second detector to cause the printer 10*a* to detect mounting of the cartridge 20*b* to the printer 10*a*.

The shape and the location of the electrically conductive portion 370 are, however, not limited to the configuration of the embodiment. The electrically conductive portion 370 may be formed in any shape and may be provided at any location as long as the electrically conductive portion 370 serve to provide electrical continuity between the first electrode C41 and the second electrode C42.

Figure 32:
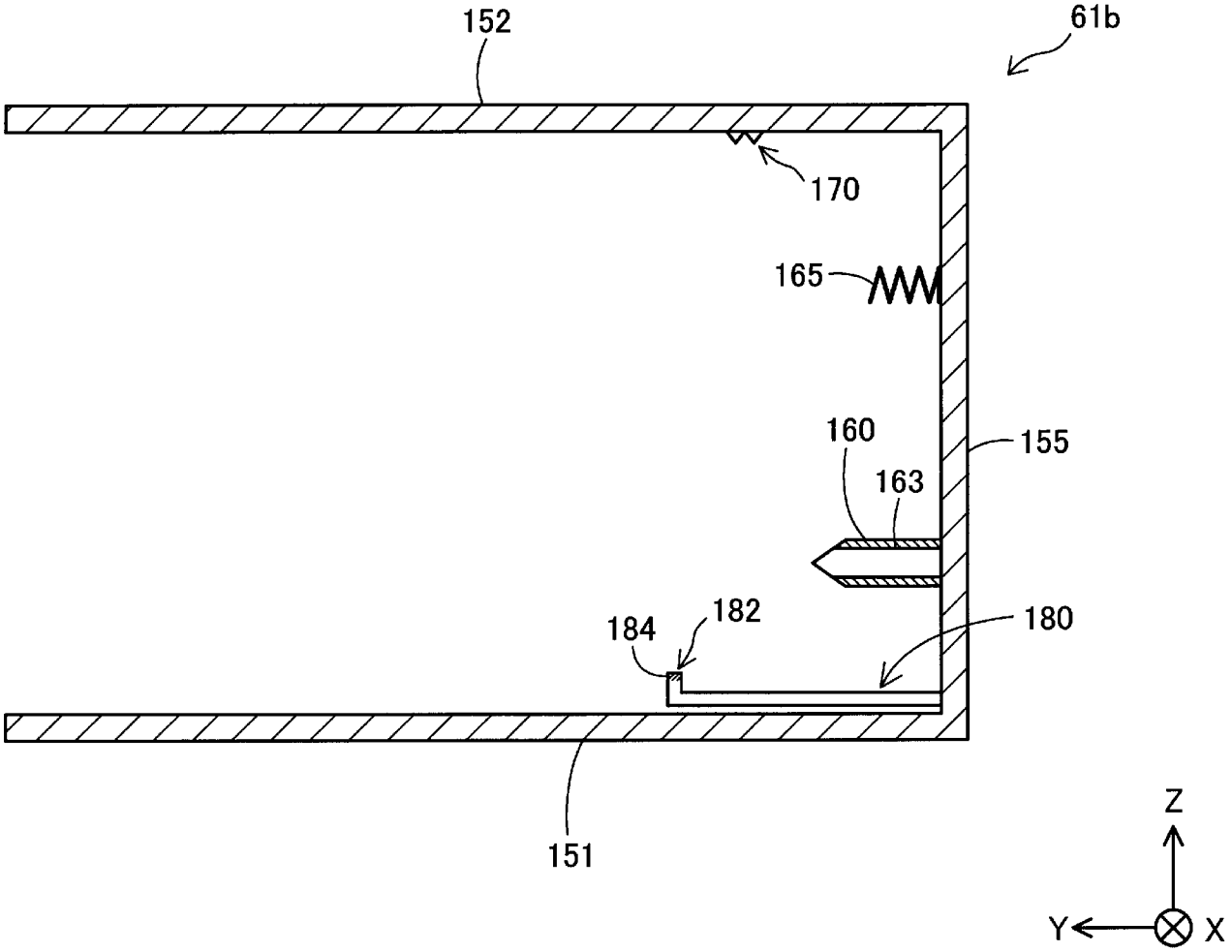
FIG. 32 is a sectional view illustrating a holder according to the third embodiment.

FIG. 32 is a sectional view illustrating the holder 61*b* according to the third embodiment. FIG. 32 illustrates an E-E section shown in FIG. 30. In the state of FIG. 32, the cartridge 20*b* is not mounted to the holder 61*b*.

The holder 61*b* includes a wall portion 155 and two wall portions 151 and 152 that are respectively arranged perpendicular to the wall portion 155 and that are opposed to each other and has a box-like appearance shape that is open in the −X direction. The wall portion 151 corresponds to a bottom (vertically lower portion) of the holder 61*b*. The wall portion 152 corresponds to a top (vertically upper portion) of the holder 61*b*. Each cartridge 20*b* is inserted in the −Y direction to be mounted to the holder 61*b* (to each slot) and is dismounted in the +Y direction.

As shown in FIG. 30, four cartridge 20*b* are placed in the holder 61*b* to be arrayed in the X-axis direction. In other words, the four cartridges 20*b* are mounted to the holder 61*b*, such that the third face 303 of one of two adjoining cartridges 20*b* faces the fourth face 304 of the other cartridge 20*b*. Four slots (mounting spaces) are provided along the Y-axis direction in the holder 61*b*, in order to mount the cartridges 20*b* thereto as described above. The E-E section (shown in FIG. 32) is a section parallel to the X-Z plane at the center position in the Y-axis direction of one of these four slots.

As shown in FIG. 32, each slot includes the ink intake needle 160, an electrode assembly 170, a biasing member 165, and the rod-like member 180. The ink intake needle 160 is inserted into the liquid supply portion 312 of the cartridge 20*b*. The ink intake needle 160 has a tapered tubular appearance shape and has a shaft hole 163 that is formed to allow ink to flow inside thereof. The ink intake needle 160 is arranged to be extended in the +Y direction on a lower side of an inner face of the wall portion 155. A −Y direction end of the ink intake needle 160, i.e., a portion that adjoins to the wall portion 155, is connected with a non-illustrated connector for connection with the tube 539. The shaft hole 163 accordingly communicates with the tube 539 by means of this connector.

The electrode assembly 170 is placed near to a −Y direction end on an inner face of the wall portion 152. The electrode assembly 170 is arranged to come into contact with the circuit board 40*b* of the cartridge 20*b*.

The biasing member 165 is arranged to be extended in the +Y direction on an upper side of the inner face of the wall portion 155. According to the embodiment, the biasing member 165 is configured by a coil spring. In the mounted state that the cartridge 20*b* is mounted to the holder 61*b* of the printer 10*a*, the biasing member 165 comes into contact with the fifth face 305 of the cartridge 20*b* to bias the cartridge 20*b* in the +Y direction.

The rod-like member 180 has a rod-like (cylindrical) appearance shape of a circular section and is arranged to be extended in the +Y direction at a position near to a lower end of the inner face of the wall portion 155. In other words, the rod-like member 180 is arranged along the wall portion 151 and along the Y-axis direction near the wall portion 151. According to the embodiment, the rod-like member 180 is made of a resin. A +Y direction end of the rod-like member 180 is bent in the +Z direction. The rod-like member 180 includes the engagement structure 184 on its leading end. The engagement structure 184 corresponds to a portion of the above+Y direction end bent in the +Z direction. The engagement structure 184 has a columnar appearance shape.

FIG. 33 is a perspective view illustrating the detailed configuration of the rod-like member 180. Part of a −Y direction side of the rod-like member 180 is omitted from the illustration of FIG. 33. As shown in FIG. 33, a first electrode assembly 182 is provided in the engagement structure 184. The first electrode assembly 182 plays a similar role to that of the first electrode assembly 90 of the first embodiment. According to the embodiment, the first electrode assembly 182 includes the electrodes C41 and C42 and wirings 185 and 186 embedded inside of the rod-like member 180. In the mounted state that the cartridge 20*b* is mounted to the holder 61*b* of the printer 10*a*, the engagement structure 184 of the rod-like member 180 is engaged with the engaged structure 344 of the cartridge 20*b* (shown in FIG. 34).

The first electrode assembly 182 includes the first electrode C41 and the second electrode C42. The first electrode C41 is placed in a +Y direction and +Z direction region on an outer circumferential surface of the engagement structure 184. The second electrode C42 is placed in a −X direction and +Z direction region on the outer circumferential surface of the engagement structure 184. Both the two electrodes C41 and C42 are formed in an approximately circular shape in planar view. The first electrode C41 is electrically connected with the second mounting detection circuit 553 via the wiring 185 provided inside of the rod-like member 180. Similarly, the second electrode C42 is electrically connected with the second mounting detection circuit 553 via the wiring 186 provided inside of the rod-like member 180.

FIG. 34 is a plan view illustrating the detailed configuration of the engaging structure 320. FIG. 34 illustrates partial closeup of a −Y direction end provided with the engaging structure 320 on the first face 301 viewed in the +Z direction. The engaging structure 320 includes a recess 330 that is formed in the first face 301 to have its depth direction along the +Z direction and the island portion 360 that is provided inside of the recess 330. A guide groove 340 is formed between a side wall 332 of the recess 330 and a side wall 362 of the island portion 360. As shown in FIG. 31 and FIG. 34, a face of the recess 330 that intersects with the fifth face 305 is open.

As shown in FIG. 34, the engaging structure 320 includes a receiving portion 331 and a guide portion configured by the guide groove 340. The guide groove 340 includes an inlet guide path 341 configured to guide the engagement structure 184 in the process of mounting the cartridge 20*b* to the holder 61*b*, an outlet guide path 346 configured to guide the engagement structure 184 in the process of dismounting the cartridge 20*b* from the holder 61*b*, and a connecting portion 338 provided therebetween. The engaged structure 344 is provided in the connecting portion 338.

The receiving portion 331 is extended in the +Y direction from an open end or a −Y direction end to receive the engagement structure 184 of the rod-like member 180 therein. A guide slope face 335 is formed at an inlet side of the receiving portion 331 adjoining to the fifth face 305 from an open end of the receiving portion 331 to a predetermined distance in the +Y direction. The guide slope face 335 is an inclined face formed to decrease its depth (distance in the +Z direction from the surface of the first face 301) with an increase in distance in the +Y direction. The width of the inlet side of the receiving portion 331 in a direction along the X-axis direction gradually decreases in the +Y direction, along with the guide slope face 335. This configuration enables the engagement structure 184 to be smoothly received in the receiving portion 331 in the process of mounting the cartridge 20*b* to the holder 61*b*. The depth of the receiving portion 331 is larger than the depth of the remaining part of the engaging structure 320. In other words, the remaining part of the engaging structure 320 other than the receiving portion 331 is shallower than the receiving portion 331.

The inlet guide path 341 is a portion configured to guide the engagement structure 184 in the process of mounting the cartridge 20*b* to the holder 61*b*. The inlet guide path 341 is arranged to be continuous with the receiving portion 331. The inlet guide path 341 includes an inclined portion 336*a* formed to decreases its depth with an increase in distance from the receiving portion 331, a first flat portion 336*b* formed to have a uniform depth, and a second flat portion 336*c* formed to have a larger depth than that of the first flat portion 336*b*. There are no steps on the boundary between the receiving portion 331 and the inclined portion 336*a* and on the boundary between the inclined portion 336*a* and the first flat portion 336*b*. There is, however, a step between the first flat portion 336*b* and the second flat portion 336*c*. This configuration suppresses the engagement structure 184 that has moved from the receiving portion 331-side of the inlet guide path 341 to the depth (+Y direction side) of the inlet guide path 341 from going back.

The connecting portion 338 is provided between the inlet guide path 341 and the outlet guide path 346. The depth of the connecting portion 338 is equal to the depth of the second flat portion 336*c* of the inlet guide path 341. The connecting portion 338 has a protruded wall 345 that is protruded in the −Y direction from a +Y direction side wall of the recess 330. The engaged structure 344 is configured by a projection that is located at a +Y direction and +X direction corner of the island portion 360 and that is protruded in the +Y direction. A side face of this projection has an curved surface that is parallel to the X-Y plane. The radius of curvature of this curved surface is approximately equal to the radius of the section of the engagement structure 184. The electrically conductive portion 370 provided on the engaged structure 344 includes a contact region that comes into contact with the first electrode C41 of the engagement structure 184 and a contact region that comes into contact with the second electrode C42 of the engagement structure 184. Out of these two contact regions, the contact region that is in contact with the first electrode C41 is located on a +X direction end of the curved face that composes the electrically conductive portion 370. The contact region that is in contact with the second electrode C42 is located on a −Y direction end of the curved face 370.

The outlet guide path 346 is a portion configured to guide the engagement structure 184 in the process of dismounting the cartridge 20*b* from the holder 61*b*. The outlet guide path 346 includes an inclined portion 346*a* arranged to be continuous with the connecting portion 338 and formed to decrease its depth with an increase in distance from the connecting portion 338, and a flat portion 346*b* arranged to be continuous with the inclined portion 346*a* and formed to have a uniform depth. The receiving portion 331 is arranged to decrease its depth with increase in distance from the connecting portion 338. A step 350 is formed on the boundary between the flat portion 346*b* and the receiving portion 331. As described above, the depth of the receiving portion 331 is larger than the depth of the remaining part of the engaging structure 320. The depth of the receiving portion 331 is thus larger than the depth of the flat portion 346*b*. The step 350 prevents the engagement structure 184 that has moved in the outlet guide path 346 from the connecting portion 338-side toward the receiving portion 331 (in the −Y direction) from going back.

C2. Operations for Mounting

Figure 35:
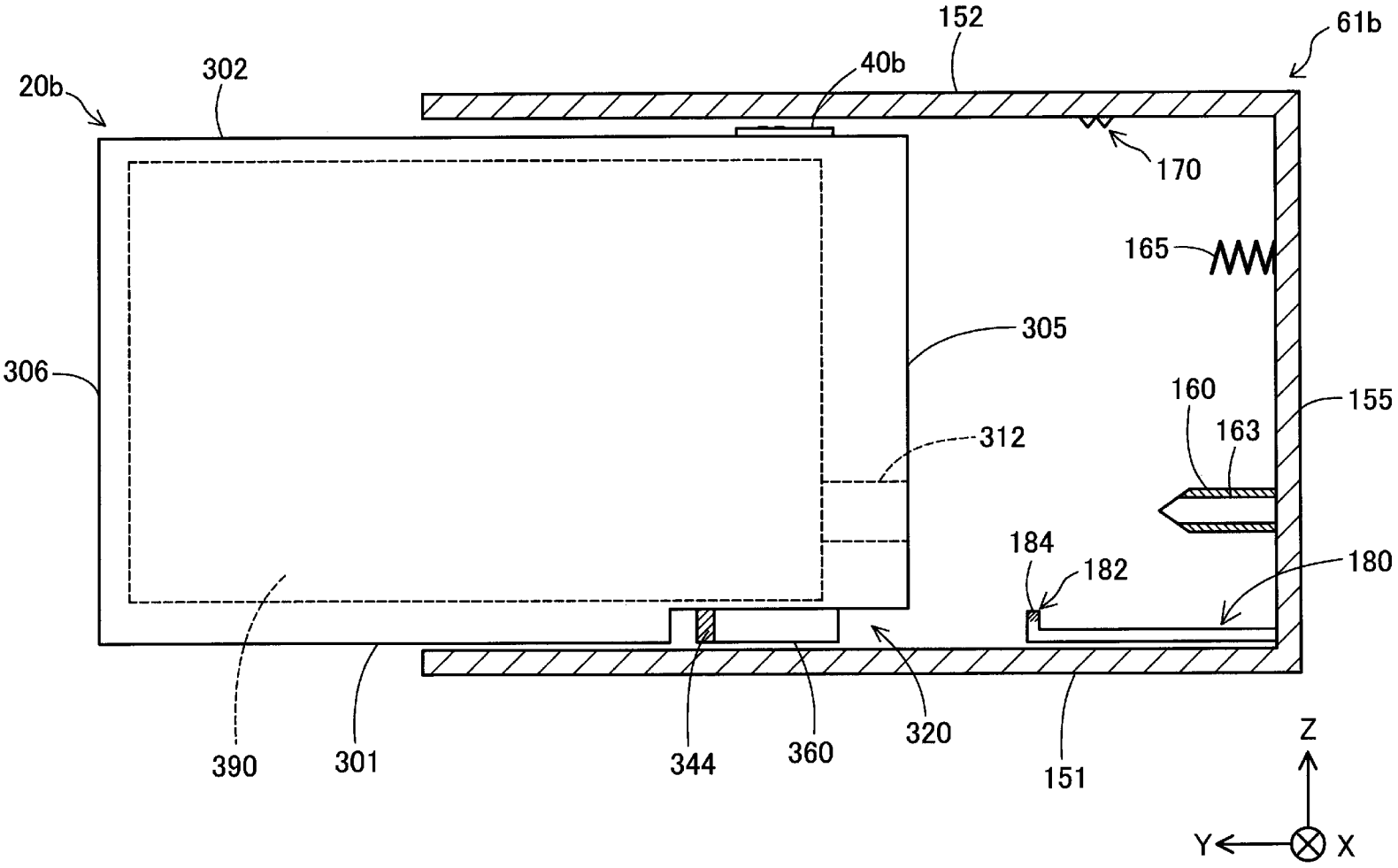
FIG. 35 is a diagram illustrating the arrangement of the cartridge and the holder on start of mounting.
Figure 36:
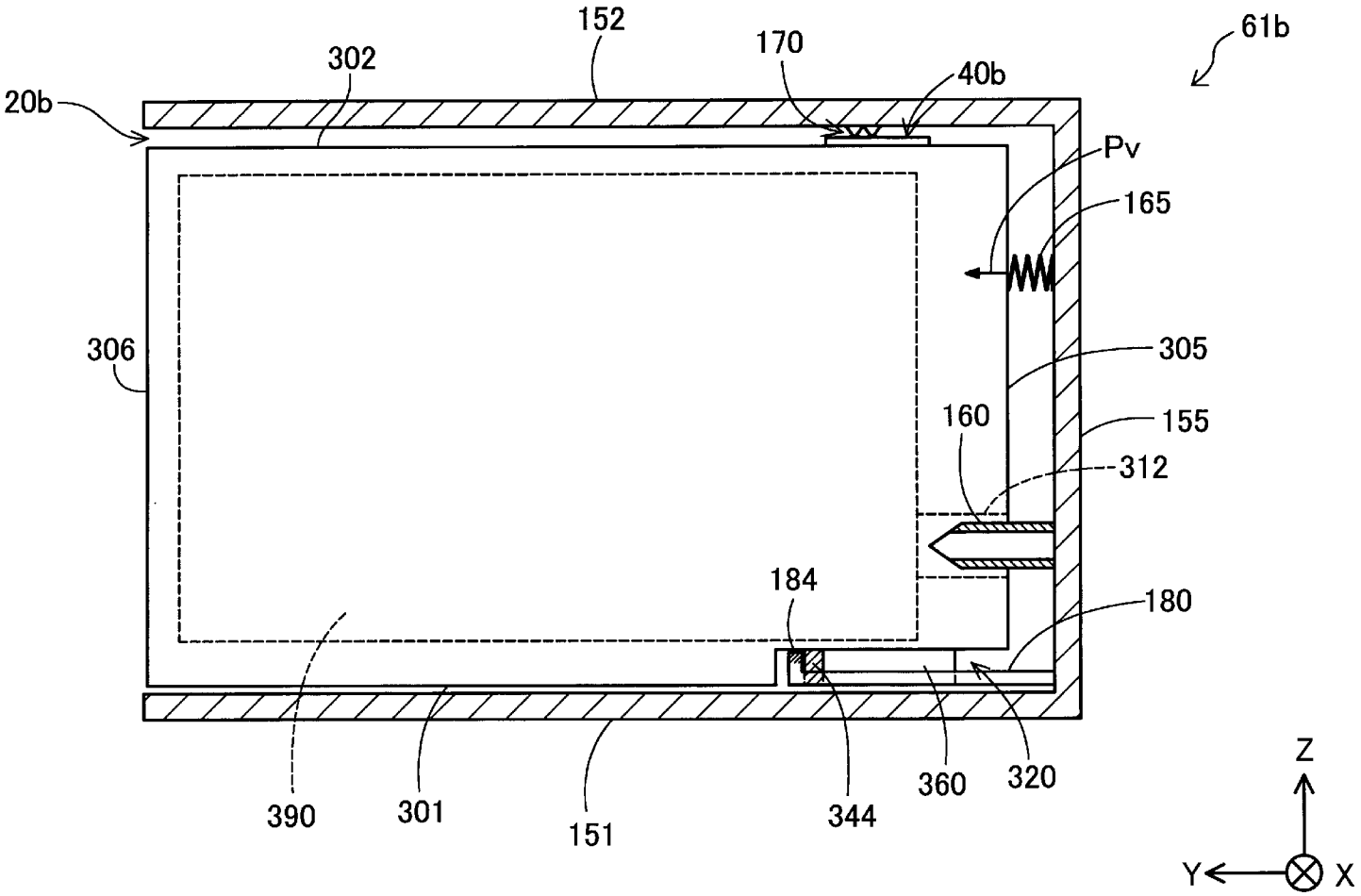
FIG. 36 is a diagram illustrating the arrangement of the cartridge and the holder on completion of mounting.

The following describes mounting and dismounting operations of the cartridge 20*b* to and from the holder 61*b* and the motions of the engagement structure 184 in the engaging structure 320 with reference to FIG. 34 to FIG. 36. FIG. 35 is a diagram illustrating the arrangement of the cartridge 20*b* and the holder 61*b* on start of mounting. FIG. 36 is a diagram illustrating the arrangement of the cartridge 20*b* and the holder 61*b* on completion of mounting.

In the process of mounting the cartridge 20*b* to the holder 61*b*, the user inserts the cartridge 20*b* into the holder 61*b*. As shown in FIG. 35, on start of mounting the cartridge 20*b* to the holder 61*b*, a −Y direction side (fifth face 305-side) of the cartridge 20*b* is inserted into the holder 61*b*, such that the fifth face 305 and the sixth face 306 of the cartridge 20*b* are parallel to the inner face of the wall portion 155. In the state shown in FIG. 35, the ink intake needle 160 of the holder 61*b* is not inserted into the liquid supply portion 312 of the cartridge 20*b*. The fifth face 305 of the cartridge 20*b* is located on the +Y direction side of the engagement structure 184 of the rod-like member 180.

When the user further moves the cartridge 20*b* in the −Y direction from the state shown in FIG. 35, the engagement structure 184 is guided from the receiving portion 331 into the inlet guide path 341 and moves in the inlet guide path 341 as shown in FIG. 34, along with this motion of the cartridge 20*b* (motion in the −Y direction). When the engagement structure 184 abuts on the protruded wall 345, the user is not allowed to further press the cartridge 20*b* into the holder 61*b*. When the user releases the hand from the cartridge 20*b* in this state, the cartridge 20*b* is slightly pressed back in the +Y direction by the biasing member 165 provided in the holder 61*b*. The engagement structure 184 then reaches a locking position St to be locked by the engaged structure 344, along with this motion of the cartridge 20*b* (motion in the +Y direction). The state that the engagement structure 184 is locked by the engaged structure 344 corresponds to the engaged state according to the embodiment. Locking of the engagement structure 184 by the engaged structure 344 completes mounting of the cartridge 20*b* to the holder 61*b* of the printer 10*a*.

As shown in FIG. 36, in the mounted state that the cartridge 20*b* is mounted to the holder 61*b* of the printer 10*a*, terminals (not shown) provided on the circuit board 40*b* come into contact with terminals of the electrode assembly 170. As shown in FIG. 34, in the mounted state, the engagement structure 184 is locked by the engaged structure 344, and the two electrodes C41 and C42 of the engagement structure 184 come into contact with the electrically conductive portion 370. This provides electrical continuity between the two electrodes C41 and C42. Like the first embodiment, a first mounting detection circuit and a second mounting detection circuit (not shown) provided on the printer 10*a* respectively detect mounting of a cartridge and also identify the mounted state of the cartridge.

As shown in FIG. 36, in the mounted state that the cartridge 20*b* is mounted to the holder 61*b*, the cartridge 20*b* is biased in the +Y direction by the biasing member 165 provided in the holder 61*b*. Accordingly, the engagement structure 184 is not allowed to move from the locking position St shown in FIG. 34, and the engaged state that the engagement structure 184 is locked by the engaged structure 344 is maintained. Locking of the engagement structure 184 by the engaged structure 344 restricts the motion of the cartridge 20*b* in the +Y direction. Accordingly, the engaged structure 344 is engaged with the engagement structure 184 to restrict the motion of the cartridge 20*b* in the +Y direction.

In the process of dismounting the cartridge 20*b* from the holder 61*b*, the user presses the cartridge 20*b* in the holder 60*b*. The engagement structure 184 is unlocked from the engaged structure 344 and moves to the outlet guide path 344, along with this motion of the cartridge 20*b* (motion in the −Y direction). The user then moves the cartridge 20*b* in a direction of pulling out the cartridge 20*b* from the holder 60*b*. The engagement structure 184 moves in the outlet guide path 344 and reaches the receiving portion 331 to come out of the cartridge 20*b*, along with this motion of the cartridge 20*b* (motion in the +Y direction).

The above first electrode assembly 182 is one example of the first electrode assembly in the claims. The engagement structure 184 is one example of the engagement structure in the claims. The printer 10*a* is one example of the liquid ejection apparatus in the claims. The cartridge 20*b* is one example of the liquid supply unit in the claims. The engaged structure 344 is one example of the engaged structure in the claims. The electrically conductive portion 370 is one example of the electrically conductive portion in the claims. The second electrode assembly 170 is one example of the second electrode assembly in the claims.

The cartridge 20*b* of the third embodiment described above includes the engaged structure 344 that is engaged with the engagement structure 184 of the holder 61*b* in the mounted state that the cartridge 20*b* is mounted to the printer. In the mounted state, the engaged structure 344 is engaged with the engagement structure 184 to restrict the motion of the cartridge 20*b* in the +Y direction. The engaged structure 344 of the cartridge 20*b* is provided with the electrically conductive portion 370. The electrically conductive portion 370 is configured to come into contact with the first electrode C41 and the second electrode C42 provided on the printer in the engaged state that the engaged structure 344 is engaged with the engagement structure 184, so as to provide electrical continuity between the first electrode C41 and the second electrode C42 and cause the printer to detect mounting of the cartridge 20*b* to the printer. As described above, in the cartridge 20*b* of the embodiment, the engaged structure 344 includes the electrically conductive portion 370 that comes into contact with the first electrode C41 and the second electrode C42 in the engaged state that the engaged structure 344 and the engagement structure 184 are engaged with each other. This configuration suppresses electrical continuity between the first electrode C41 and the second electrode C42 from being provided in the non-engaged state that the engaged structure 344 is not engaged with the engagement structure 184. This configuration accordingly enables the printer to identify the abnormal mounted state of the cartridge 20*b* to the printer 10*a*, for example, insufficient mounting of the cartridge 20*b* to the holder 61*b*.

In the mounted state, the cartridge 20*b* is biased in the +Y direction by a biasing force Pv generated by the spring 165. This biasing force Pv does not allow the engagement structure 184 to move from the locking position St shown in FIG. 34 and maintains the engaged state that the engagement structure 184 is locked by the engaged structure 344. This configuration enhances the effect of restricting the motion of the cartridge 20*b* in the +Y direction, i.e., in the direction of dismounting the cartridge 20*b*, using the engaged structure 344.

The electrically conductive portion 370 is provided on the face of the island portion 360 that is provided with the engaged structure 344. In other words, the electrically conductive portion 370 is formed as part of the island portion 360 provided with the engaged structure 344. This configuration achieves downsizing and cost reduction of the printer, compared with a configuration that the electrically conductive portion 370 and the engaged structure 344 are formed from separate members. Additionally, this configuration simultaneously achieves the engagement of the engaged structure 344 with the engagement structure 184 and the contact of the electrically conductive portion 370 with the first electrode C41 and the second electrode C42. This configuration provides electrical continuity between the first electrode C41 and the second electrode C42 only in the case where the engaged structure 344 is engaged with the engagement structure 184. This configuration thus more reliably identifies the abnormal mounted state of the cartridge 20*b* to the printer.

Furthermore, the first electrode assembly 182 is formed integrally with the rod-like member 180. This configuration achieves downsizing of the holder 61*b* and thereby downsizing of the printer.

According to the third embodiment, the engaged structure 334 provided with the electrically conductive portion 370 is placed on the first face 301 of the cartridge 20*b*, and the circuit board 40*b* provided with a cartridge-side terminal group is placed on the second face 302 of the cartridge 20*b*. Accordingly, the first detector (the four mounting detection terminals provided on the circuit board 40*b*) and the second detector (the electrically conductive portion 370 provided on the engaged structure 344) are provided across the liquid supply portion 312 when the cartridge 20*b* is viewed in the +Y direction from the fifth face 305-side. The configuration that the first detector and the second detector are provided across the liquid supply portion 312 enables the printer 10*a* (controller 510) to identify the abnormal mounted state of the cartridge 20*b* to the printer 10*a*, for example, insufficient mounting of the cartridge 20*b* to the holder 61*b*. The configurations and the positions of the first detector and the second detector are not limited to those described in this embodiment. The requirement is that at least one electrically conductive portion usable for detection of mounting is provided on the +Z direction side and at least one electrically conductive portion usable for detection of mounting is provided on the −Z direction side of the liquid supply portion 312 when the cartridge 20*b* is viewed in the +Y direction from the fifth face 305-side. The first detector and the second detector may be provided on the third face 303 or on the fourth face 304. In other words, the first detector and the second detector may have any configurations that enable the printer to detect mounting of the cartridge 20*b* and are not limited to the configurations and the positions described in this embodiment. The same applies to the first electrode assembly 182 and the second electrode assembly 170 provided on the holder 61*b*.

D. Modifications

D1. Modification 1

According to the first embodiment, the first electrode assembly 90 is formed as a separate body from the wall portion 604. The present disclosure is, however, not limited to this configuration.

Figure 37B:
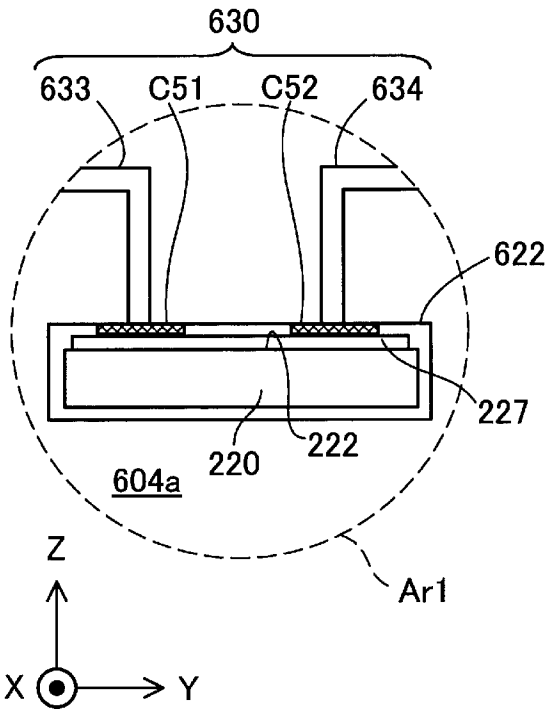
FIG. 37B is diagrams illustrating the configuration of a cartridge and a holder according to Modification 1.
Figure 37A:
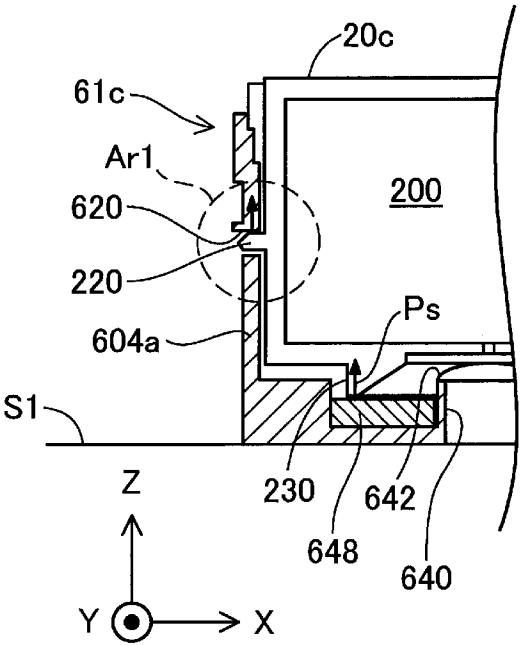
FIG. 37A is diagrams illustrating the configuration of a cartridge and a holder according to Modification 1.

FIG. 37 is diagrams illustrating the configuration of a cartridge 20*c* and a holder 61*c* according to Modification 1. FIG. 37(A) illustrates a partial section of the cartridge 20*c* and the holder 61*c*. FIG. 37(A) illustrates the periphery of a −X direction end of the cartridge 20*c* and the holder 61*c* in the mounted state. FIG. 37(A) illustrates a section at a similar position to that of FIG. 15. FIG. 37(B) illustrates closeup of a region Ar1 shown in FIG. 37(A). FIG. 37(B) corresponds to a plan view when the region Ar1 of FIG. 37(A) is viewed in the −X direction from inside of a liquid container portion 200.

As shown in FIG. 37(A) and FIG. 37(B), the holder 61*c* of Modification 1 differs from the holder 61 of the first embodiment by a first electrode assembly 630 configured to include wirings 633 and 634 provided inside of a wall portion 604*a* and electrodes C51 and C52. Otherwise the configuration of the holder 61*c* is similar to the configuration of the holder 61 of the first embodiment. Like components are expressed by like reference signs, and their detailed description is omitted.

As shown in FIG. 37(B), the first electrode C51 and the second electrode C52 are placed inside of the wall portion 604*a* near to the second engaged structure 220. Both the two electrodes C51 and C52 are exposed on the surface of the upper inner wall portion 622 out of the inner wall arranged to form the through hole 620. The first electrode C51 is electrically connected with the second mounting detection circuit 553 via the wiring 633 placed inside of the wall portion 604*a*. The second electrode C52 is electrically connected with the second mounting detection circuit 553 via the wiring 634 placed inside of the wall portion 604*a*.

The cartridge 20*c* of Modification 1 differs from the cartridge 20 of the first embodiment by that the electrically conductive portion 227 is formed on the first restriction locking face 222 instead of the second slope face 226. Otherwise the configuration of the cartridge 20*c* is similar to the configuration of the cartridge 20 of the first embodiment. Like components are expressed by like reference signs, and their detailed description is omitted.

As shown in FIG. 37(A) and FIG. 37(B), when the cartridge 20*c* is mounted to the holder 61*c* of the printer 10 and the second engaged structure 220 is engaged with the through hole 61 of the holder 61*c*, the electrically conductive portion 227 provided on the first restriction locking face 222 comes into contact with the two electrodes C51 and C52 provided in the through hole 61. In this engaged state, the electrically conductive portion 227 serves to provide electrical continuity between the two electrodes C51 and C52. As shown in FIG. 37(A) and as described in the first embodiment, the leading end of the wall of the liquid supply portion 230 receives the biasing force Ps in the +Z direction from the elastic member 648. The first restriction locking face 222 of the second engaged structure 220 is pressed against the upper inner wall portion 622 of the through hole 620 by this biasing force Ps. This restricts the motion of the cartridge 20*c* in the +Z direction and causes the two electrodes C51 and C52 to more reliably come into contact with the electrically conductive portion 227 provided on the first restriction locking face 222.

The cartridge 20*c* of Modification 1 having the above configuration has similar advantageous effects to those of the cartridge 20 of the first embodiment. The configuration that the first electrode assembly 630 is formed in the wall portion 604*a* of the holder 61*c* and on the surface of the upper inner wall portion 622 of the through hole 620, i.e., that the first electrode assembly 630 is formed integrally with the wall portion of the holder 61*c*, achieves downsizing of the holder 61*c* and thereby downsizing of the printer. Additionally, the arrangement of the two electrodes C51 and C52 to be exposed on the through hole 620 or more specifically on the upper inner wall portion 622 simultaneously achieves the engagement of the second engaged structure 220 with the through hole 620 and the contact of the electrically conductive portion 227 with the electrodes C51 and C52. This configuration provides electrical continuity between the two electrodes C51 and C52 only in the case where the second engaged structure 220 is engaged with the through hole 620. This configuration thus more effectively suppresses the printer 10 from detecting mounting of the cartridge 20*c* in the insufficient mounted state of the cartridge 20*c* to the holder 61*c*.

D2. Modification 2

According to the second embodiment, the first electrode C31 and the second electrode C32 are formed on the engagement structure 130. The present disclosure is, however, not limited to this configuration.

Figure 38:
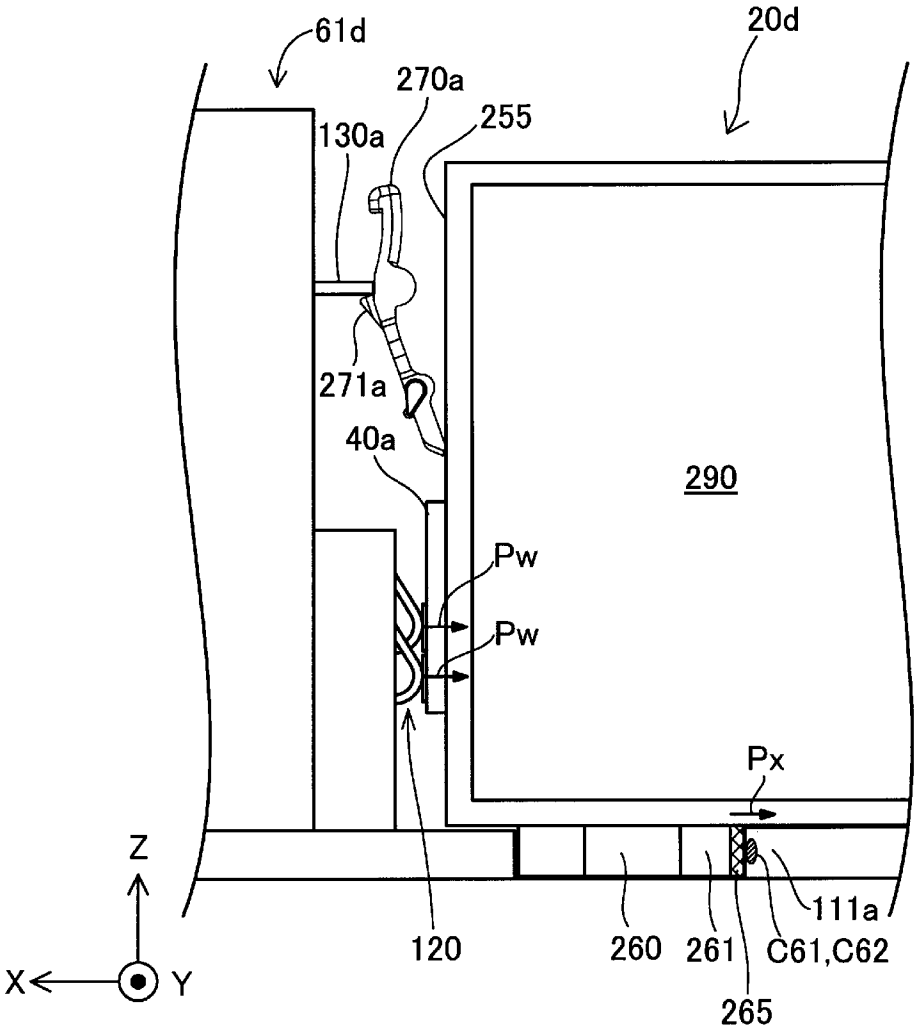
FIG. 38 is a diagram illustrating the configuration of a cartridge and a holder according to Modification 2.

FIG. 38 is a diagram illustrating the configuration of a cartridge 20*d* and a holder 61*d* according to Modification 2. FIG. 38 illustrates a partial section of the cartridge 20*d* and the holder 61*d* in the mounted state. FIG. 38 illustrates a section at a similar position to that of FIG. 29.

The holder 61*d* of Modification 2 differs from the holder 61*a* of the second embodiment by that an engagement structure 130*a* is provided in place of the engagement structure 130 and that a wall portion 111*a* is provided in place of the wall portion 111. Otherwise the configuration of the holder 61*d* of Modification 2 is similar to the configuration of the holder 61*a* of the second embodiment. Like components are expressed by like reference signs, and their detailed description is omitted.

The engagement structure 130*a* differs from the engagement structure 130 of the second embodiment by omission of the two electrodes C31 and C32 and the two wirings 31 and 32 connected therewith. The wall portion 111*a* or more specifically a portion including a −X direction end wall of a recess arranged to place a liquid supply portion 260 and a seal portion 261 therein differs from the wall portion 111 of the second embodiment by that the wall portion 111*a* is provided with a first electrode C61 and a second electrode C62. The two electrodes C61 and C62 are exposed inside of the recess and come into contact with the seal portion 261 (electrically conductive portion 265 described later) of the cartridge 20*d* in the engaged state. These two electrodes C61 and C62 are electrically connected with the second mounting detection circuit 553 via non-illustrated wirings placed inside of the holder 61*d*.

The cartridge 20*d* of Modification 2 differs from the cartridge 20*a* of the second modification by that an electrically conductive portion 265 is formed on a −X direction end of the seal portion 261. Otherwise the configuration of the cartridge 20*d* is similar to the configuration of the cartridge 20*a* of the second embodiment. Like components are expressed by like reference signs, and their detailed description is omitted. FIG. 38 schematically illustrates the inner configuration of the cartridge 20*d*. The electrically conductive portion 265 has electrical conductivity and is formed by metal plating according to the modification.

In the mounted state, the circuit board 40*a* is in contact with the second electrode assembly 120 and receives a biasing force pw in the −X direction from the second electrode assembly 120. Accordingly, the cartridge 20*d* is biased in the −X direction as a whole, and the seal portion 261 receives a biasing force Px in the −X direction. In the mounted state, the seal portion 261 is accordingly pressed against the wall portion 111*a* to restrict the motion of the cartridge 20*d* in the −X direction. In this state, the electrically conductive portion 265 is pressed against the two electrodes C61 and C62 to provide electrical continuity between these two electrodes C61 and C62.

The cartridge 20*d* of Modification 2 having the above configuration has similar advantageous effects to those of the cartridge 20*a* of the second embodiment. The electrically conductive portion 265 and the two electrode C61 and C62 are placed on the seal portion 261 and the wall portion 111*a* that are arranged to press against each other in the mounted state. This configuration enables the electrically conductive portion 265 to definitely come into contact with the two electrodes C61 and C62 and firmly maintains this contact state.

D3. Modification 3

Figure 39:
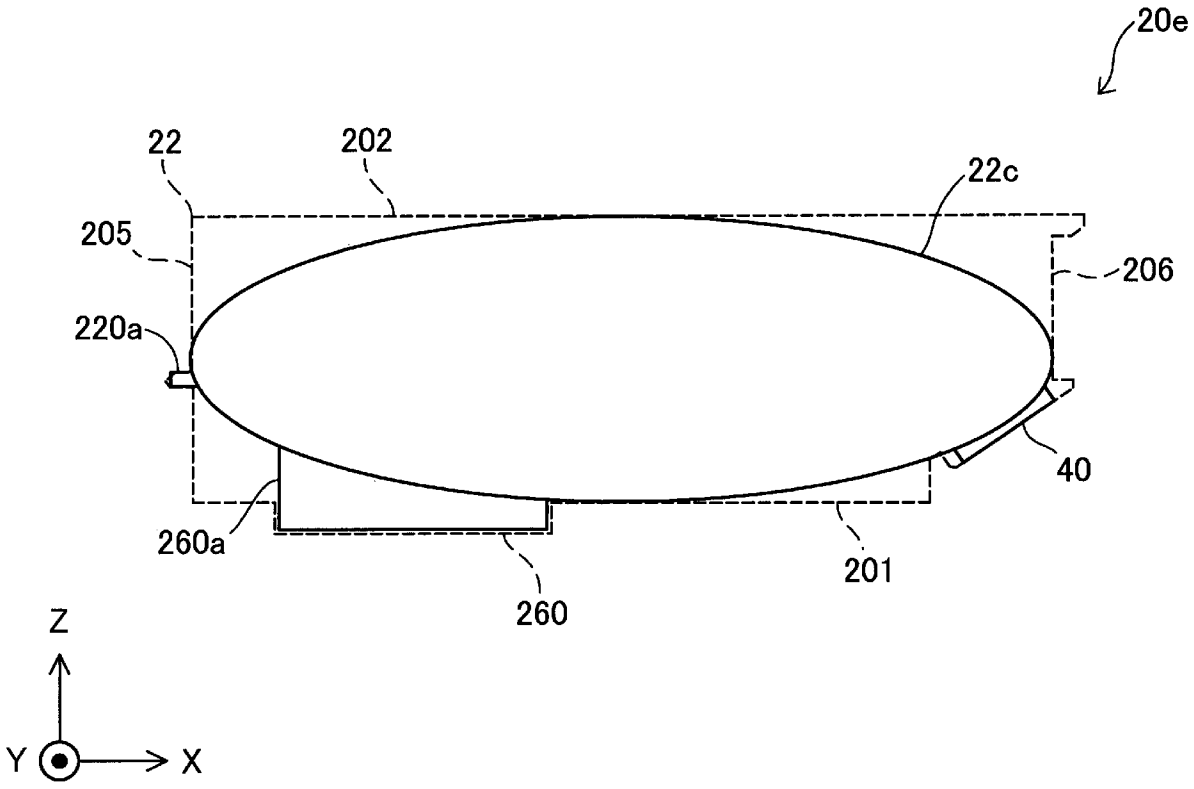
FIG. 39 is a conceptual view illustrating a modification of the shape of the cartridge.

FIG. 39 is a conceptual view illustrating a modification of the shape of the cartridge. FIG. 39 illustrates a modification of the cartridge 20 of the first embodiment as an example. In the respective embodiments, the outer shell 22, 22*a* or 22*b* of the cartridge 20, 20*a* or 20*b* is formed in the approximately rectangular parallelepiped shape (as shown in FIG. 2, FIG. 23 or FIG. 31). The shape of the outer shell is, however, not limited to these embodiments. The outer shell may be formed in any shape that is mountable to the corresponding holder 61, 61*a* or 61*b*. The outer shell 22 of the first embodiment is shown by broken line in FIG. 39.

For example, as shown in FIG. 39, an outer shell 22*c* has an elliptical or oval side face. A cartridge 20*e* has a fixed width along the Y-axis direction when being viewed in the +X direction. A liquid supply portion 260*a* is placed at a position near to a second engaged structure 220*a* on the bottom of the outer shell 22*c*. A circuit board 40 is placed at a position slightly on a −Z direction side of a +X direction end of the outer shell 22*c*.

As described above, as long as the cartridge is compatible with the cartridge 20, 20*a* or 20*b*, the shape of the outer shell is not limited to the shapes of the outer shells 22, 22*a* and 22*b* of the respective embodiments.

D4. Modification 4

Figure 40:
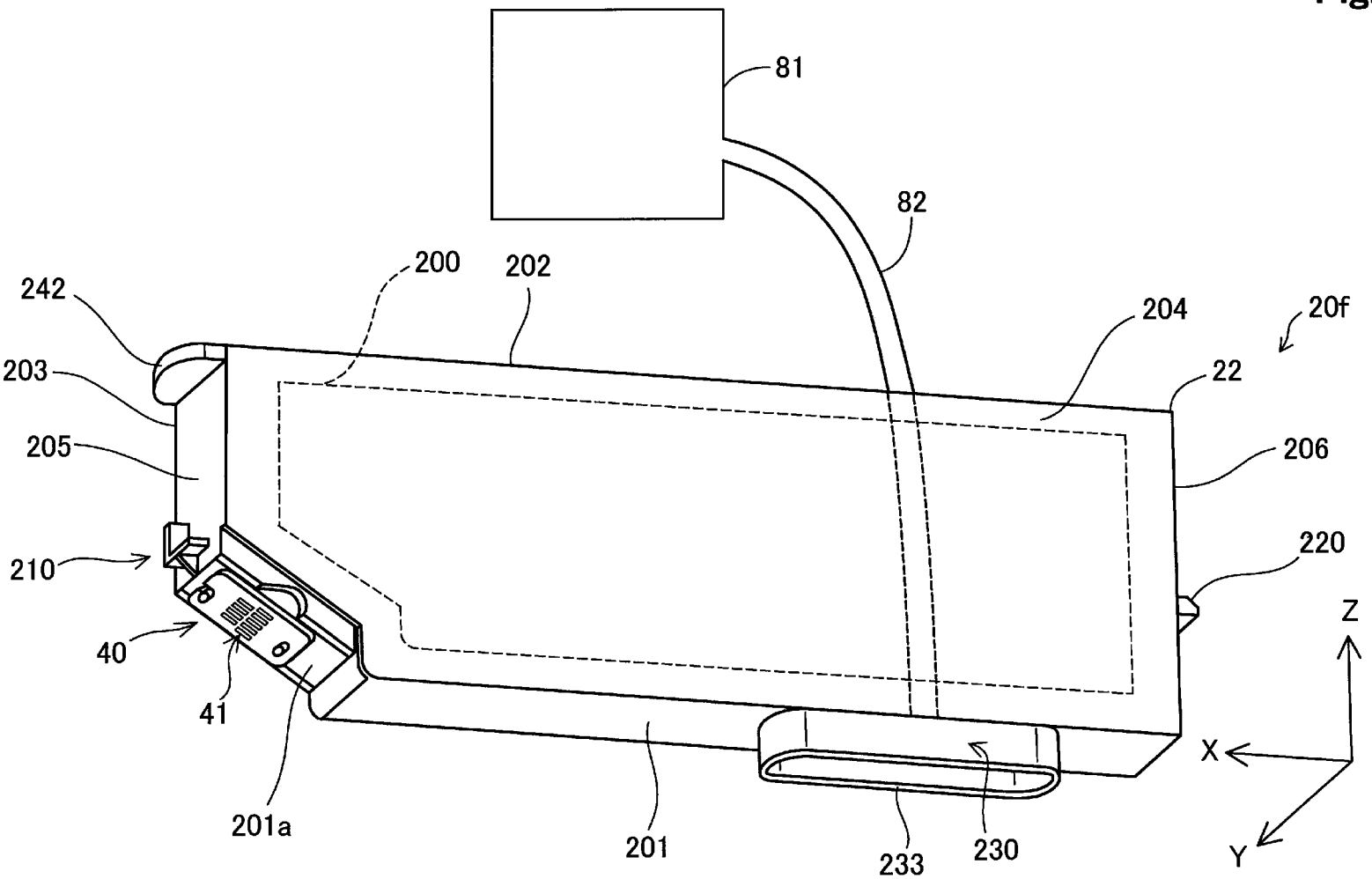
FIG. 40 is a diagram illustrating the configuration of a liquid supply unit according to a modification.

The respective embodiments describe the ink cartridges as the applications of the liquid supply unit of the present disclosure. The present disclosure is, however, not limited to the ink cartridge but may be applied to any liquid supply unit configured to contain ink therein and supply the ink. FIG. 40 is a diagram illustrating the configuration of a liquid supply unit according to a modification. In the respective embodiments, the cartridge 20, 20*a* or 20*b* includes the liquid container portion 200, 290 or 390 placed inside of the outer shell 22, 22*a* or 22*b*. The position of the liquid container portion 200, 290 or 390 is, however, not limited to these embodiments. For example, like a liquid supply unit 20*f* shown in FIG. 40, a tank 81 as a liquid container portion may be placed outside of an outer shell 22. The tank 81 is connected with a liquid supply portion 212 via a tube 82.

D5. Modification 5

According to the first embodiment, the electrically conductive portion 227 is formed by metal plating. The electrically conductive portion may, however, be formed by another technique, for example, by attaching a thin metal piece to an engaged structure. In another example, the entire second engaged structure 220 may be made of an electrically conductive material, for example, a metal such as stainless steel or carbon. The same applies to the second embodiment and the third embodiment.

D6. Modification 6

According to the first embodiment, the electrically conductive portion 227 is formed by metal plating on the entire second slope face 226. It is, however, not necessary to provide the electrically conductive portion 227 on the entire second slope face 226. The electrically conductive portion 227 only needs to include the contact region C21, the contact region C22, and a portion that provides electrical continuity between the two contact regions C21 and C22. The portion that provides electrical continuity between the two contact regions C21 and C22 may be formed by a lead wire, instead of a wiring pattern formed by metal plating or the like. Another modification may directly form a terminal group on the surface of the outer shell 22, 22*a* or 22*b*, instead of providing the circuit board 40, 40*a* or 40*b*. The same applies to the electrically conductive portion 272 of the second embodiment.

D7. Modification 7

The printers 10 and 10*a* are inkjet printers. The present disclosure may, however, be applied to any liquid ejection apparatus configured to eject a liquid other than ink. For example, the present disclosure may be applied to any of various liquid ejection apparatuses given below:

(1) image recording apparatus such as facsimile machine;

(2) color material ejection apparatus used for manufacturing color filters for image display apparatuses such as liquid crystal displays;

(3) electrode material ejection apparatus used for forming electrodes of, for example, organic EL (electroluminescence) displays and field emission displays (FED);

(4) liquid ejection apparatus configured to eject a bioorganic material-containing liquid used for manufacturing biochips;

(5) sample ejection apparatus used as precision pipette;

(6) ejection apparatus of lubricating oil;

(7) ejection apparatus of resin solutions;

(8) liquid ejection apparatus for pinpoint ejection of lubricating oil on precision machines such as watches and cameras;

(9) liquid ejection apparatus configured to eject transparent resin solutions, such as ultraviolet curable resin solution, onto substrates to manufacture hemispherical microlenses (optical lenses) used for, for example, optical communication elements;

(10) liquid ejection apparatus configured to eject acidic or alkaline etching solutions to etch substrates and the like; and

(11) liquid ejection apparatus equipped with a liquid ejection head configured to eject a very small volume of droplets of any other liquid.

The "droplet" described above means the state of liquid ejected from the liquid ejection apparatus and may be in a granular shape, a teardrop shape or a tapered threadlike shape. The "liquid" herein may be any material ejectable by the liquid ejection apparatus. The "liquid" may be any material in the liquid phase. For example, the "liquid" may be any material in the liquid phase. Liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with solvents. Typical examples of the liquid include ink described in the above embodiments and liquid crystal. The ink herein includes general water-based inks and oil-based inks, as well as various liquid compositions, such as gel inks and hot-melt inks.

The present disclosure is not limited to any of the embodiments and the modifications described above but may be implemented by a diversity of configurations without departing from the scope of the disclosure. For example, the technical features of any of the embodiments and the modifications corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein.

REFERENCE SIGNS LIST

10, 10*a* . . . printer, 20, 20*a*-20*f* . . . ink cartridge (cartridge), 20*g* . . . liquid supply unit, 22, 22*a*-22*c* . . . outer shell, 31, 32 . . . wiring, 40, 40*a*, 40*b* . . . circuit board, 60 . . . carriage, 60*a* . . . head unit, 61, 61*a*-61*d* . . . holder, 62 . . . print head, 70 . . . second electrode assembly, 71 . . . apparatus-side terminal, 80 . . . lever, 81 . . . tank, 82 . . . tube, 90 . . . first electrode assembly, 90*a* . . . first electrode, 90*b* . . . second electrode, 91*a*, 91*b* . . . bent portion, 100 . . . cartridge chamber, 103-108 . . . wall portion, 110 . . . ink intake needle, 111, 111*a* . . . wall portion, 120 . . . second electrode assembly, 130, 130*a* . . . engagement structure, 131*a* . . . bottom face, 151, 152, 155 . . . wall portion, 160 . . . ink intake needle, 163 . . . shaft hole, 165 . . . biasing member, 170 . . . electrode assembly, 180 . . . rod-like member, 182, electrode assembly, 184 . . . engagement structure, 185, 186 . . . wiring, 200 . . . liquid container portion, 201 . . . first face, 201*a* . . . slope face portion, 202 . . . second face, 203 . . . third face, 204 . . . fourth face, 205 . . . fifth face, 206 . . . sixth face, 210 . . . first engaged structure, 212 . . . liquid supply portion, 220 . . . second engaged structure, 222 . . . first restriction locking face, 224 . . . first slope face, 226 . . . second slope face, 227 . . . electrically conductive portion, 230 . . . liquid supply portion, 231 . . . wall, 232 . . . ink supply path, 233 . . . opening, 234 . . . thin plate member, 235 . . . leading end, 242 . . . operation projection, 251 . . . first face, 252 . . . second face, 253 . . . third face, 254 . . . fourth face, 255 . . . fifth face, 256 . . . sixth face, 260, 260*a* . . . liquid supply portion, 261 . . . seal portion, 262 . . . seal member, 263 . . . receiving hole, 265 . . . electrically conductive portion, 270 . . . lever, 271 . . . engaged structure, 272 . . . electrically conductive portion, 280 . . . valve, 281 . . . spring, 282 . . . spring seat, 283 . . . seal member, 283*a* . . . end, 284 . . . thin plate member, 285 . . . ink supply path, 286 . . . tubular portion, 290 . . . liquid container portion, 301 . . . first face, 302 . . . second face, 303 . . . third face, 304 . . . fourth face, 305 . . . fifth face, 306 . . . sixth face, 312 . . . liquid supply portion, 319 . . . opening, 320 . . . engaging structure, 330 . . . recess, 331 . . . receiving portion 332 . . . side wall, 335 . . . guide slope face, 336 . . . guide portion, 336*a* . . . inclined portion, 336*b* . . . first flat portion, 336*c* . . . second flat portion, 338 . . . connecting portion, 340 . . . guide groove, 341 . . . inlet guide path, 342 . . . contact wall portion, 344 . . . engaged structure, 345 . . . protruded wall, 346 . . . outlet guide path, 346*a* . . . inclined portion, 346*b* . . . flat portion, 350 . . . step, 360 . . . island portion, 362 . . . side wall, 370 . . . electrically conductive portion, 390 . . . liquid container portion, 400 . . . cartridge-side terminal group, 400P . . . first region, 400T . . . second region, 401 . . . boss groove, 402 . . . boss hole, 405 . . . board end portion, 408 . . . surface, 409 . . . rear face, 420 . . . storage unit, 431-439 . . . terminal (cartridge-side terminal), 510 . . . controller, 517 . . . flexible cable, 522 . . . carriage motor, 524 . . . drive belt, 529 . . . feed rod, 532 . . . feed motor, 534 . . . platen, 539 . . . tube, 550 . . . sub control circuit, 551 . . . memory control circuit, 552 . . . first mounting detection circuit, 553 . . . second mounting detection circuit, 555 . . . comparator, 570 . . . main control circuit, 571 . . . CPU, 572 . . . memory, 580 . . . power supply circuit, 581 . . . first power source, 582 . . . second power source, 590 . . . display panel, 600 . . . cartridge chamber, 601, 603, 604, 604*a*, 605, 606 . . . wall portion, 603W . . . outer wall, 607 . . . first partition plate, 608 . . . second partition plate, 610 . . . placing portion, 620 . . . through hole, 622 . . . upper inner wall portion, 633, 634 . . . wiring, 640 . . . ink intake portion, 642 . . . porous filter, 648 . . . elastic member, 690 . . . holding member, 708 . . . slope face, 709 . . . terminal base, 731 . . . apparatus-side terminal, 739 . . . apparatus-side terminal, 810 . . . engagement structure, 830 . . . operating part, Ar1 . . . region, C1, C2 . . . contact region, C21, C22 . . . contact region, C31 . . . first electrode, C32 . . . second electrode, C41 . . . first electrode, C42 . . . second electrode, C51 . . . first electrode, C52 . . . second electrode, C61 . . . first electrode, C62 . . . second electrode, CL . . . center axis, G1 . . . gap, L1 . . . first terminal array, L2 . . . second terminal array, P . . . printing medium, Ps-Px . . . biasing force, R2 . . . pullup resistance, RST . . . reset signal, S1 . . . bottom face, SCK . . . clock signal, SDA . . . data signal, Sd . . . output signal, St . . . locking position, VDD . . . first source voltage, VHV . . . second source voltage, VSS . . . ground voltage, Yc . . . plane, cp . . . contact

The invention claimed is:

1. A liquid supply unit configured to supply a liquid to a liquid ejection apparatus, the liquid ejection apparatus including a first electrode assembly containing a first electrode and a second electrode; an engagement structure formed as one of a hole or a protruded portion formed in the liquid ejection apparatus; a second electrode assembly;

and a mounting structure which the liquid supply unit is mounted to, the liquid supply unit comprising:

a liquid supply portion configured to supply the liquid to the liquid ejection apparatus;

an engaged structure protruding from a surface of the liquid supply unit and configured to be engaged with the engagement structure and thereby restrict a motion of the liquid supply unit in a first direction that is a direction of dismounting the liquid supply unit from the liquid ejection apparatus, in a mounted state that the liquid supply unit is mounted to the liquid ejection apparatus;

an electrically conductive portion provided in the engaged structure and configured to come into contact with the first electrode and the second electrode, so as to provide electrical continuity between the first electrode and the second electrode and cause the liquid ejection apparatus to detect an engaged state of the engaged structure and the engagement structure; and terminal portions that are provided on a portion of the liquid supply unit, so as to sandwich the liquid supply portion with the electrically conductive portion, wherein the terminal portions are configured to come into contact with the second electrode assembly in the mounted state, wherein the mounted state of the liquid supply unit to the liquid ejection apparatus is based on both the engaged structure being engaged with the engagement structure in the engaged state and the terminal portions contacting the second electrode assembly in a contact state, the mounted stated being configured to be detected by the liquid ejection apparatus.

2. The liquid supply unit according to claim 1, wherein the engaged structure includes an engagement projection inserted into a through hole that is provided as the engagement structure in a wall portion of the mounting structure, in the mounted state.

3. The liquid supply unit according to claim 2, wherein the liquid supply portion has a wall that is provided to be protruded from a face of the liquid supply unit in an opposite direction to the first direction, and in the mounted state, a leading end of the wall comes into contact with an elastic member that is provided in the liquid ejection apparatus, to be biased in the first direction by the elastic member.

4. The liquid supply unit according to claim 3, wherein in the mounted state, the terminal portions are biased in the first direction by the second electrode assembly.

5. The liquid supply unit according to claim 4, further comprising:

a first face provided with the liquid supply portion;

a second face opposed to the first face in the first direction;

a third face arranged to intersect with the first face and the second face;

a fourth face arranged to intersect with the first face and the second face and opposed to the third face;

a fifth face arranged to intersect with the first face, the second face, the third face and the fourth face; and a sixth face provided with the engaged structure, arranged to intersect with the first face, the second face, the third face and the fourth face, and opposed to the fifth face, wherein when the liquid supply unit is viewed from the first face side in the first direction, the liquid supply portion is placed at a position on the first face that is nearer to the sixth face than the fifth face, and the terminal portion is placed at a position on the first face that is nearer to the fifth face than the sixth face.

6. The liquid supply unit according to claim 1, further comprising:

a first face provided with the liquid supply portion;

a second face opposed to the first face in the first direction;

a third face arranged to intersect with the first face and the second face;

a fourth face arranged to intersect with the first face and the second face and opposed to the third face;

a fifth face arranged to intersect with the first face, the second face, the third face and the fourth face;

a sixth face arranged to intersect with the first face, the second face, the third face and the fourth face and opposed to the fifth face; and a lever provided on the fifth face and operated to mount the liquid supply unit to the liquid ejection apparatus and to dismount the liquid supply unit from the liquid ejection apparatus, wherein the engaged structure is provided on the lever.

7. The liquid supply unit according to claim 6, wherein the liquid supply portion includes a valve configured to open a liquid flow path formed in the liquid supply portion when a liquid intake needle provided in the liquid ejection apparatus is inserted in the liquid supply portion and to close the liquid flow path when the liquid intake needle is not inserted in the liquid supply portion, wherein the valve includes a spring seat that is pressed in the first direction by the liquid intake needle in the mounted state, and a spring that biases the spring seat in a second direction opposite to the first direction.

8. A liquid supply unit configured to supply a liquid to a liquid ejection apparatus, the liquid ejection apparatus including a first electrode assembly containing a first electrode and a second electrode; an engagement structure; and a mounting structure which the liquid supply unit is mounted to, the liquid supply unit comprising:

a liquid supply portion configured to supply the liquid to the liquid ejection apparatus;

an engaged structure configured to protrude from a surface of the liquid supply unit and to be engaged with the engagement structure and thereby restrict a motion of the liquid supply unit in a first direction that is a direction of dismounting the liquid supply unit from the liquid ejection apparatus, in a mounted state that the liquid supply unit is mounted to the liquid ejection apparatus; and an electrically conductive portion provided in the engaged structure, wherein the electrically conductive portion is configured to come into contact with the first electrode and the second electrode in an engaged state that the engaged structure is engaged with the engagement structure, so as to provide electrical continuity between the first electrode and the second electrode and cause the liquid ejection apparatus to detect mounting of the liquid supply unit to the liquid ejection apparatus, the engaged structure includes an engagement projection inserted into a through hole that is provided as the engagement structure in a wall portion of the mounting structure, in the mounted state, and the electrically conductive portion is provided on the engagement projection and is arranged at a position to come into contact with the first electrode and the second electrode that is placed in the through hole, in the engaged state.

9. A liquid supply unit configured to supply a liquid to a liquid ejection apparatus, the liquid ejection apparatus including a first electrode assembly containing a first electrode and a second electrode; an engagement structure; and a mounting structure which the liquid supply unit is mounted to, the liquid supply unit comprising:

a liquid supply portion configured to supply the liquid to the liquid ejection apparatus;

an engaged structure configured to protrude from a surface of the liquid supply unit and to be engaged with the engagement structure and thereby restrict a motion of the liquid supply unit in a first direction that is a direction of dismounting the liquid supply unit from the liquid ejection apparatus, in a mounted state that the liquid supply unit is mounted to the liquid ejection apparatus;

an electrically conductive portion provided in the engaged structure, wherein the electrically conductive portion is configured to come into contact with the first electrode and the second electrode in an engaged state that the engaged structure is engaged with the engagement structure, so as to provide electrical continuity between the first electrode and the second electrode and cause the liquid ejection apparatus to detect mounting of the liquid supply unit to the liquid ejection apparatus;

a first face;

a second face opposed to the first face;

a third face arranged to intersect with the first face and the second face;

a fourth face arranged to intersect with the first face and the second face and opposed to the third face;

a fifth face provided with the liquid supply portion and arranged to intersect with the first face, the second face, the third face and the fourth face;

a sixth face arranged to intersect with the first face, the second face, the third face and the fourth face and opposed to the fifth face in the first direction; and a guide groove provided on the first face to guide the engagement structure of the liquid ejection apparatus in a process of mounting the liquid supply unit to the liquid ejection apparatus and in a process of dismounting the liquid supply unit from the liquid ejection apparatus, wherein the guide groove comprises:

an inlet guide path configured to guide the engagement structure in the process of mounting the liquid supply unit to the liquid ejection apparatus; and an outlet guide path configured to guide the engagement structure in the process of dismounting the liquid supply unit from the liquid ejection apparatus, and the engaged structure is provided at a position between the inlet guide path and the outlet guide path in the guide groove.

* * * * *